US006685293B2

(12) United States Patent
Junhua

(10) Patent No.: US 6,685,293 B2
(45) Date of Patent: Feb. 3, 2004

(54) LIQUID JETTING APPARATUS AND METHOD OF DRIVING THE SAME

(75) Inventor: Chang Junhua, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/270,162

(22) Filed: Oct. 15, 2002

(65) Prior Publication Data

US 2003/0085962 A1 May 8, 2003

Related U.S. Application Data

(63) Continuation-in-part of application No. 10/136,428, filed on May 2, 2002.

(30) Foreign Application Priority Data

Oct. 15, 2001 (JP) ..... P2001-316703

(51) Int. Cl.[7] ..... B41J 2/01
(52) U.S. Cl. ..... 347/14; 347/11
(58) Field of Search ..... 347/9–11, 14

(56) References Cited

U.S. PATENT DOCUMENTS 6,217,159 B1 * 4/2001 Morikoshi et al. ..... 347/10
6,502,914 B2 * 1/2003 Hosono et al. ..... 347/11

* cited by examiner

*Primary Examiner*—Stephen D. Meier
*Assistant Examiner*—Julian D. Huffman
(74) *Attorney, Agent, or Firm*—Sughrue Mion, PLLC

(57) ABSTRACT

A liquid jetting head is provided with a pressure chamber, a piezoelectric vibrator which causes pressure fluctuation to the pressure chamber and a nozzle orifice communicated with the pressure chamber. A drive signal generator generates, in every jetting period, a drive signal including a base potential, an initial and termination potential which is a drive potential higher than the base potential, and at least one ejection pulse signal for ejecting a liquid droplet from the nozzle orifice. A drive signal supplier selectively supplies the ejection pulse signal to the piezoelectric vibrator in accordance with jetting data which indicates whether a liquid jetting is performed. A jetting data storage stores the jetting data with regard to each of successive two jetting periods including a present jetting period. A vibrator potential adjuster changes a potential of the piezoelectric vibrator to the base potential when the jetting data stored in the jetting data storage indicates that the liquid jetting is not performed in a latter jetting period, and changes the potential of the piezoelectric vibrator to the drive potential before the ejection pulse is supplied when the jetting data indicates that the liquid jetting is performed in the latter jetting period.

16 Claims, 26 Drawing Sheets

| PRESENT/NEXT | PS1 | PS2 | PS3 | PS4 | DECODED VALUE |
|---|---|---|---|---|---|
| NON-RECORDING/ NON-RECORDING | ○ | × | × | × | 1000 |
| NON-RECORDING/ RECORDING | × | ○ | × | × | 0100 |
| RECORDING/ NON-RECORDING | × | × | ○ | ○ | 0011 |
| RECORDING/ RECORDING | × | × | ○ | × | 0010 |

| PRESENT/NEXT | PS1 | PS2 | PS3 | PS4 | DECODED VALUE |
|---|---|---|---|---|---|
| NON-RECORDING/ NON-RECORDING | ○ | × | × | × | 1000 |
| NON-RECORDING/ RECORDING | × | ○ | × | × | 0100 |
| RECORDING/ NON-RECORDING | × | × | ○ | ○ | 0011 |
| RECORDING/ RECORDING | × | × | ○ | × | 0010 |

| PRESENT/NEXT | PS11 | PS12 | PS13 | PS14 | DECODED VALUE |
|---|---|---|---|---|---|
| NON-RECORDING/ NON-RECORDING | ○ | × | × | × | 1000 |
| NON-RECORDING/ RECORDING | × | ○ | × | × | 0100 |
| RECORDING/ NON-RECORDING | × | × | ○ | ○ | 0011 |
| RECORDING/ RECORDING | × | × | ○ | × | 0010 |

FIG. 12A
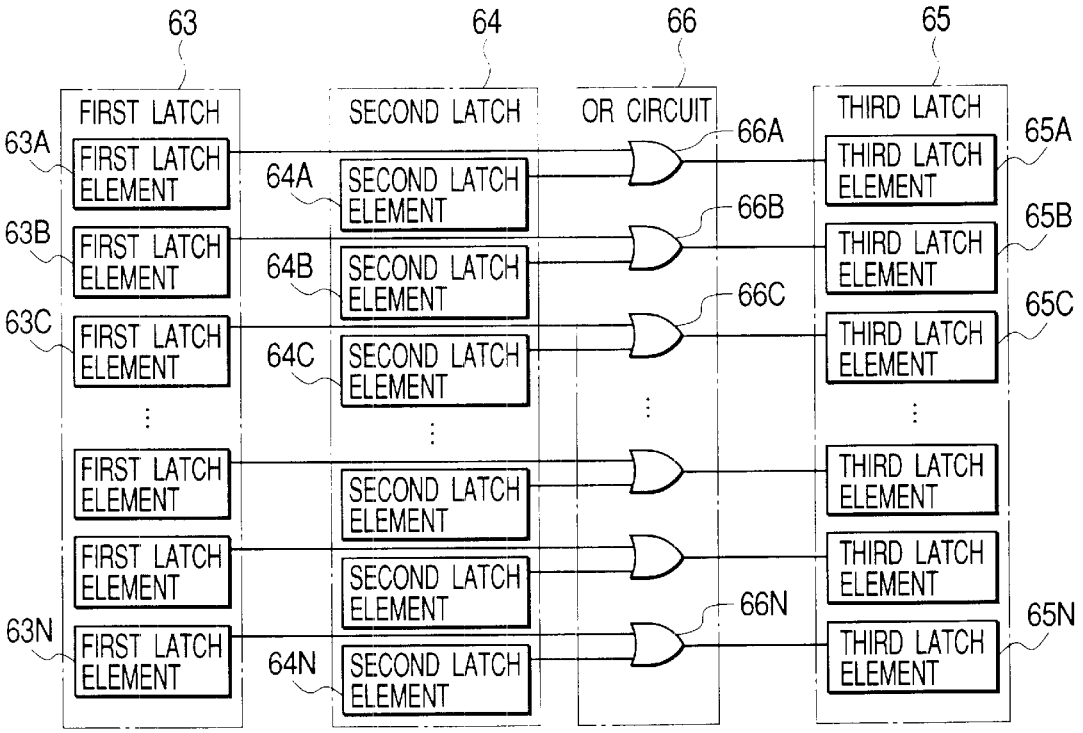
FIG. 12B
| SECOND LATCH | FIRST LATCH | THIRD LATCH |
|---|---|---|
| 0 | 0 | 0 |
| 0 | 1 | 1 |
| 1 | 0 | 1 |
| 1 | 1 | 1 |
FIG. 13
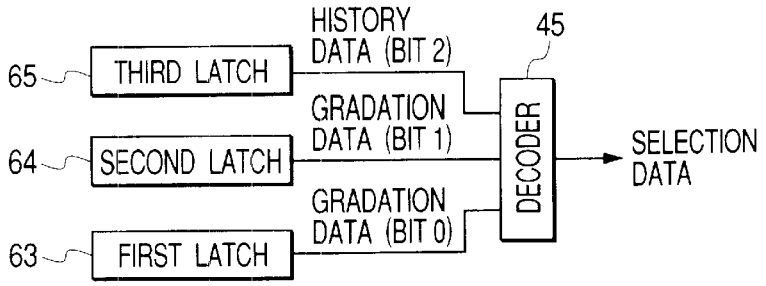

| PRESENT/NEXT | PS20 | PS21 | PS22 | PS23 | PS24 | PS25 | DECODED VALUE |
|---|---|---|---|---|---|---|---|
| NON-RECORDING/ NON-RECORDING (000) | × | ○ | ○ | × | × | × | 011000 |
| NON-RECORDING/ SMALL DOT (001) | × | ○ | × | × | ○ | × | 010010 |
| NON-RECORDING/ MEDIUM DOT (010) | × | ○ | ○ | ○ | ○ | × | 011110 |
| NON-RECORDING/ LARGE-DOT (011) | × | ○ | ○ | ○ | ○ | ○ | 011111 |
| RECORDING/ NON-RECORDING (100) | × | × | ○ | × | × | × | 001000 |
| RECORDING/SMALL DOT (101) | × | × | × | × | ○ | × | 000010 |
| RECORDING/MEDIUM DOT (110) | × | × | ○ | ○ | ○ | × | 001110 |
| RECORDING/LARGE DOT (111) | × | × | ○ | ○ | ○ | ○ | 001111 |

| PRESENT/NEXT | PS31 | PS32 | PS33 | PS34 | PS35 | PS36 | DECODED VALUE |
|---|---|---|---|---|---|---|---|
| NON-RECORDING/ NON-RECORDING (000) | × | × | × | ○ | × | ○ | 000101 |
| SMALL DOT/ NON-RECORDING (010) | × | ○ | × | × | × | ○ | 010001 |
| MEDIUM DOT/ NON-RECORDING (100) | ○ | ○ | × | × | × | ○ | 110001 |
| LARGE DOT/ NON-RECORDING (110) | ○ | ○ | × | × | ○ | ○ | 110011 |
| NON-RECORDING/ RECORDING (001) | × | × | × | ○ | × | × | 000100 |
| SMALL DOT/ RECORDING (011) | × | ○ | × | × | × | × | 010000 |
| MEDIUM DOT/ RECORDING (101) | ○ | ○ | × | × | × | × | 110000 |
| LARGE DOT/ RECORDING (111) | ○ | ○ | × | × | ○ | × | 110010 |

• NON-RECORDING/NON-RECORDING/NON-RECORDING/(NON-RECORDING)

• SMALL DOT / NON-RECORDING/NON-RECORDING/(NON-RECORDING)

• NON-RECORDING/NON-RECORDING/SMALL DOT/(RECORDING)

• LARGE DOT/LARGE DOT/LARGE DOT/(RECORDING)

LIQUID JETTING APPARATUS AND METHOD OF DRIVING THE SAME

CROSS-REFERECE TO RELATED APPLICATION

This is a Continuation-in-Part of Application No. 10/136,428 filed May 2, 2002; the disclosure of which is incorporated herein by reference.

BACKGROUND OF THE INVENTION

This invention relates to a liquid jetting apparatus such as an ink jet recording apparatus having a recording head capable of ejecting ink droplets as piezoelectric vibrators operate, and a method of driving such a liquid jetting apparatus.

An ink jet recording apparatus of a printer, a plotter, a facsimile, etc., ejects ink droplets from a recording head and hitting the ink droplets on a print record medium such as recording paper, a print film, or a CD-R (compact disc recordable), thereby recording dots. The recording head used with the recording apparatus may comprise piezoelectric vibrators (PZT) as pressure generating sources. With the recording head, a pressure chamber is expanded or contract as the piezoelectric vibrator becomes deformed, thereby causing pressure fluctuation to occur in ink in the pressure chamber. The pressure fluctuation of ink is used to eject an ink droplet through a nozzle orifice.

The piezoelectric vibrator has the deformation amount determined in response to the supplied voltage value and also has good responsiveness of deformation to voltage change. Thus, the waveform of an ejection pulse signal for ejecting an ink droplet is set appropriately, whereby the ink pressure can be controlled with high accuracy and an ink droplet of any desired amount can be ejected at any desired speed.

To meet the demands for high quality of a record image, increasing the recording speed, etc., a bias voltage is supplied to the piezoelectric vibrator in the normal state and the piezoelectric vibrator is adjusted to a drive potential.

The purpose of adjusting the piezoelectric vibrator to the drive potential is to hold the pressure chamber in an intermediate volume for enabling the volume to be changed to expansion or contraction.

To eject an ink droplet of an extremely small amount at a high frequency, the initial and termination potential of the ejection pulse signal is also set to the maximum potential in the drive signal. In this case, the bias voltage corresponding to the maximum potential is supplied to the piezoelectric vibrator.

By the way, it is known that if a high load is imposed on the piezoelectric vibrator, the lifetime of the piezoelectric vibrator is shortened. Therefore, in the configuration in which a bias voltage is supplied in the normal state, the bias voltage continues to be supplied to the piezoelectric vibrator over a long time. However, preferably the bias voltage is set low as much as possible from the viewpoint of protection of the piezoelectric vibrator.

SUMMARY OF THE INVENTION

It is therefore an object of the invention to provide a liquid jetting apparatus suitable for protecting piezoelectric vibrators, and a method of driving such a liquid jetting apparatus.

In order to achieve the above object, according to the present invention, there is provided a liquid jetting apparatus, comprising:

a liquid jetting head, provided with a pressure chamber, a piezoelectric vibrator which causes pressure fluctuation to the pressure chamber and a nozzle orifice communicated with the pressure chamber;

a drive signal generator, which generates a drive signal including a base potential, an initial and termination potential which is a drive potential higher than the base potential, and at least one ejection pulse signal for ejecting a liquid droplet from the nozzle orifice, the drive signal generating the drive signal every recording period;

a drive signal supplier, which selectively supplies the ejection pulse signal to the piezoelectric vibrator in accordance with jetting data which indicates whether a liquid jetting is performed;

a jetting data storage, which stores the jetting data with regard to each of successive two jetting periods including a present jetting period; and a vibrator potential adjuster, which changes a potential of the piezoelectric vibrator to the base potential when the jetting data stored in the jetting data storage indicates that the liquid jetting is not performed in a latter jetting period, and changes the potential of the piezoelectric vibrator to the drive potential before the ejection pulse is supplied when the jetting data indicates that the liquid jetting is performed in the latter jetting period.

In the apparatus, the vibrator potential adjuster adjusts the vibrator potential in response to combination of record and non-jetting in the former jetting period and the latter jetting period. For example, if a jetting state is indicated in the former jetting period and a non-jetting state is indicated in the latter jetting period, the vibrator potential just after the ejection pulse signal is supplied is the drive potential and thus then the vibrator potential is dropped from the drive potential to the base potential. On the other hand, if a non-jetting state is indicated in the former jetting period and a jetting state is indicated in the latter jetting period, the vibrator potential is the base potential and thus is raised from the base potential to the drive potential before the ejection pulse signal is supplied. Further, the jetting state remains unchanged in the former jetting period and the latter jetting period, the vibrator potential is not adjusted.

Thus, if liquid jetting is not conducted in the latter jetting period, the vibrator potential is adjusted to the base potential. Since the base potential is a low potential fitted for protecting the piezoelectric vibrator, if a non-jetting state continues and the piezoelectric vibrator is maintained at the base potential over a long time, the load imposed on the piezoelectric vibrator is reduced. Therefore, the piezoelectric vibrator can be protected.

If a non-jetting state is indicated in the former jetting period and a jetting state is indicated in the latter jetting period, the vibrator potential is raised from the base potential to the drive potential. Since the drive potential is also the leading end potential of the ejection pulse signal, when supplying the ejection pulse signal is started, the potentials of the vibrator potential and the ejection pulse signal can be matched with each other and the ejection pulse signal can be supplied smoothly to the piezoelectric vibrator. Thus, the load imposed on the piezoelectric vibrator can be reduced and the piezoelectric vibrator can be protected.

Accordingly, if the piezoelectric vibrator is driven at a high frequency by the ejection pulse signal having the high initial and termination potential, the load imposed on the piezoelectric vibrator can be reduced and the piezoelectric vibrator can be protected. Further, raising and dropping the vibrator potential in a short time is decreased, so that the ink pressure in the pressure chamber is easily stabilized and the deflected flight of an ink droplet can also be prevented.

Preferably, the jetting data is binary data which is associated with whether the liquid jetting is performed. The jetting data storage stores jetting data with regard to the present jetting period and a next jetting period, so that a potential of the piezoelectric vibrator when the present jetting period is terminated is changed to the base potential or the drive potential.

Preferably, the jetting data includes: gradation data which indicates a gradation of an ink dot recording in the present jetting period; and history data which indicates whether an ink dot recording was performed in a previous jetting period.

Preferably, the vibrator potential adjuster includes a resistance element and a switch which connects the piezoelectric vibrator to either a source of the base potential or a source of the drive potential, via the resistance element.

Preferably, a first dummy data indicating that the liquid jetting is not performed is provided before a first data of jetting data associated with one main scanning of the liquid jetting head, and a second dummy data indicating that the liquid jetting is not performed is provided after a last data of the jetting data.

Preferably, the drive signal includes: a first joint pulse signal which raises the potential of the piezoelectric vibrator from the base potential to the drive potential; and a second joint pulse signal which drops the potential of the piezoelectric vibrator from the drive potential to the base potential. The vibrator potential adjuster supplies either the first joint pulse signal or the second joint pulse signal.

Here, it is preferable that the drive signal generator generates the first joint pulse signal before the ejection pulse signal, and generates the second joint pulse signal after the ejection pulse signal.

Alternatively, the drive signal generator may generate the first joint pulse signal and the second joint signal before the ejection pulse signal.

Further, it is preferable that at least one of the first joint pulse signal and the second joint pulse signal constitutes a part of the ejection pulse signal.

Still further, it is preferable that the drive signal includes a vibrating pulse signal which vibrates a meniscus of liquid in the nozzle orifice such an extent that a liquid drop is not ejected from the nozzle orifice. At least one of the first joint pulse signal and the second joint pulse signal constitutes a part of the vibrating pulse signal.

Still further, it is preferable that a time period for which the potential of the piezoelectric vibrator is varied by the first joint pulse signal and the second joint pulse signal is substantially identical with a natural period of ink in the pressure chamber.

According to the present invention, there is also provided a method of driving a liquid jetting apparatus which comprises a liquid jetting head provided with a pressure chamber, a piezoelectric vibrator which causes pressure fluctuation to the pressure chamber and a nozzle orifice communicated with the pressure chamber, the method comprising the steps of:

generating a drive signal every jetting period, the drive signal including a base potential, an initial and termination potential which is a drive potential higher than the base potential, and at least one ejection pulse signal for ejecting a liquid droplet from the nozzle orifice;

storing recording data which indicates whether a liquid jetting is performed, with regard to each of successive two jetting periods including a present jetting period;

changing a potential of the piezoelectric vibrator to the base potential when the jetting data stored in the jetting data storage indicates that the liquid jetting is not performed in a latter jetting period;

changing the potential of the piezoelectric vibrator to the drive potential before the ejection pulse is supplied when the jetting data indicates that the liquid jetting is performed in the latter jetting period; and supplying selectively the ejection pulse signal to the piezoelectric vibrator in accordance with the jetting data.

Preferably, the jetting data is binary data which is associated with whether the liquid jetting is performed. The jetting data storage stores jetting data with regard to the present jetting period and a next jetting period, so that a potential of the piezoelectric vibrator when the present jetting period is terminated is changed to the base potential or the drive potential.

Preferably, the jetting data includes: gradation data which indicates a gradation of an ink dot recording in the present jetting period; and history data which indicates whether an ink dot recording was performed in a previous jetting period.

Preferably, the drive signal includes: a first joint pulse signal which raises the potential of the piezoelectric vibrator from the base potential to the drive potential; and a second joint pulse signal which drops the potential of the piezoelectric vibrator from the drive potential to the base potential. The vibrator potential adjuster supplies either the first joint pulse signal or the second joint pulse signal.

Preferably, the piezoelectric vibrator is connected to either a source of the base potential or a source of the drive potential via a resistance element to adjust the potential of the piezoelectric vibrator.

BRIEF DESCRIPTION OF THE DRAWINGS

In the accompanying drawings:

FIG. 12A is a block diagram to describe the connection relationship among first to third latch circuits and OR circuits;

FIG. 12B is a drawing to describe the contents of data latched in the first to third latch circuits;

FIG. 13 is a block diagram to describe the connection relationship among the first to third latch circuits and a decoder;

DETAILED DESCRIPTION OF THE PREFERRED EMBODIMENTS

Referring now to the accompanying drawings, there are shown preferred embodiments of the invention. In the description that follows, a printer of a representative liquid jetting apparatus is taken as an example.

Figure 1:
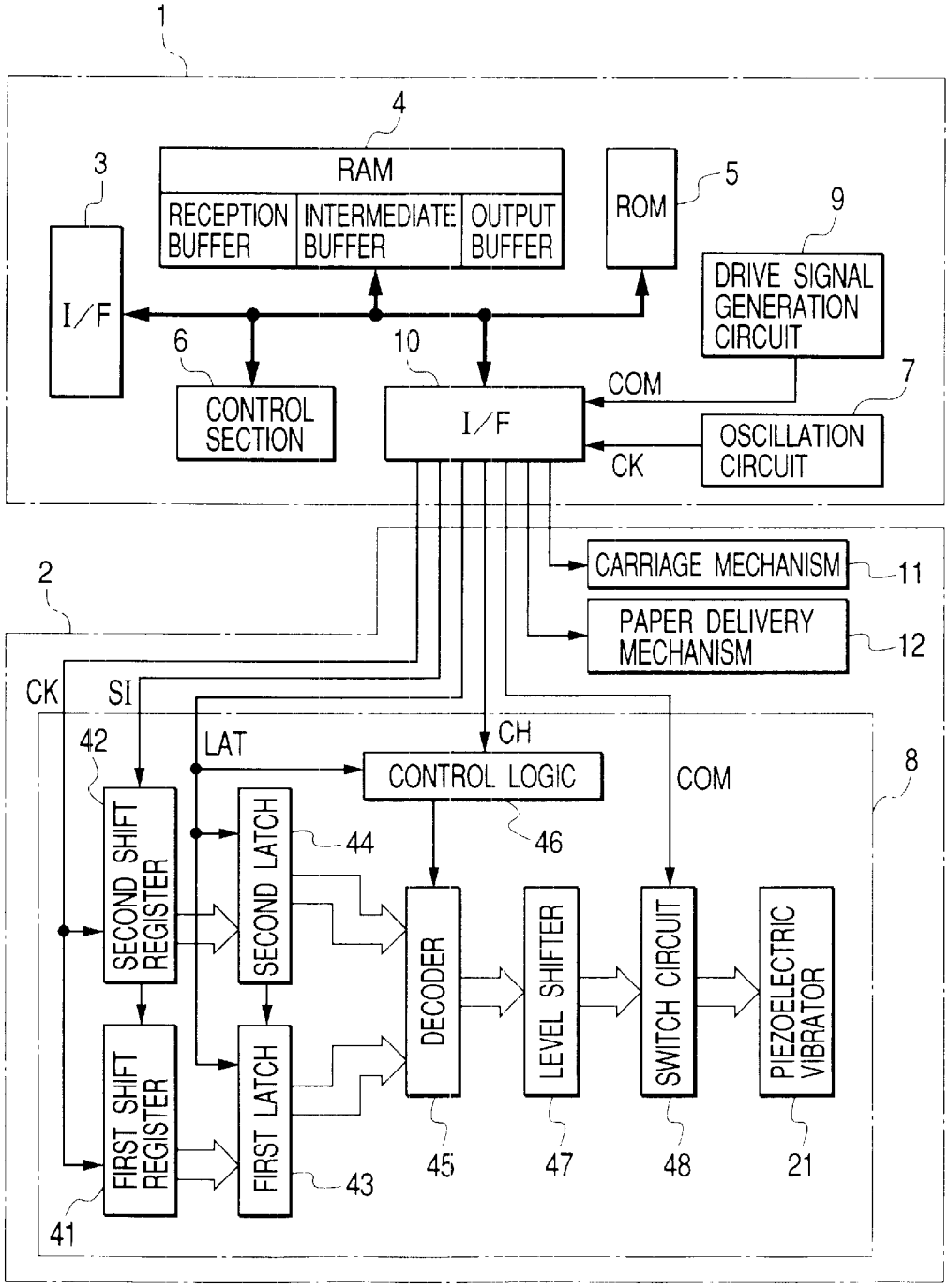
FIG. 1 is a functional block diagram to show the general configuration of a printer incorporating the invention.

A printer illustrated in FIG. 1 is made up of a printer controller 1 and a print engine 2. The printer controller 1 comprises an interface 3 (external I/F 3) for receiving print data, etc., from a host computer (not shown), etc., RAM 4 for storing various pieces of data, etc., ROM 5 storing various data processing routines, etc., a control section 6 made up of a CPU, etc., an oscillation circuit 7 for generating a clock signal (CK), a drive signal generation circuit 9 for generating a drive signal COM supplied to a recording head 8, and an interface 10 (internal I/F 10) for transmitting dot pattern data, the drive signal COM, etc., to the print engine 2.

The external I/F 3 receives print data of any one or more of character code, graphics function, and image data, for example, from the host computer, etc. The external I/F 3 outputs a busy signal (BUSY), an acknowledge signal (ACK), etc., to the host computer.

The RAM 4 is used as a reception buffer, an intermediate buffer, an output buffer, work memory (not shown), etc. The print data received on the external I/F 3 from the host computer is temporarily stored in the reception buffer. Intermediate code data converted into intermediate code by the control section 6 is stored in the intermediate buffer. Record data indicating the record contents for each dot is stored in the output buffer. In the embodiment, 1-bit binary data indicating a recording state or a non-recording state (presence or absence of recording) for each dot is stored as the recording data.

The drive signal generation circuit 9 is a drive signal generator which generates a drive signal COM sequence made up of a plurality of waveform elements based on waveform control information output from the control section 6 (a signal generation controller). The waveform control information is information representing voltage increment/decrement Δv in an extremely short update time period Δt, for example. The control section 6 sets the waveform control information (voltage increment/decrement ±Δv) in a predetermined area of memory. The drive signal generation circuit 9 references the waveform control information set in the area every update time period Δt and adds the voltage increment/decrement Δv to the output voltage at the reference time point to form a new output voltage v. If the voltage is constant, the control section 6 sets a value "0" as the voltage increment/decrement Δv and does not rewrite the value throughout the time period of the constant voltage.

Figure 2:
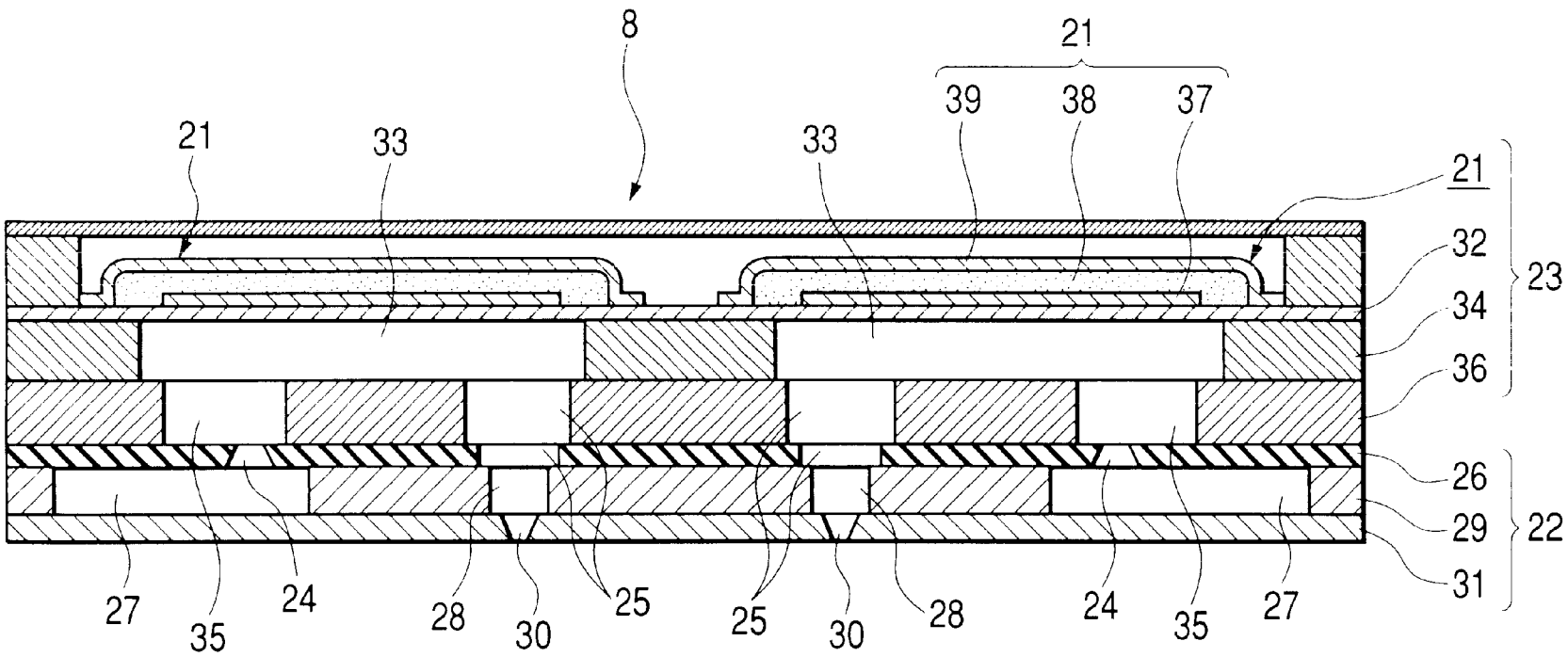
FIG. 2 is a sectional view to show the mechanical structure of a recording head.
Figure 3:
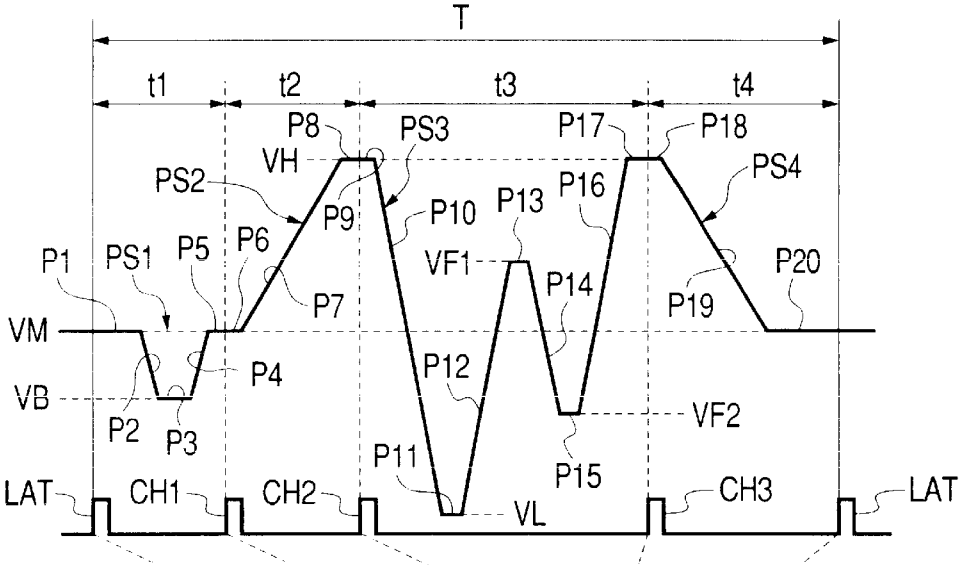
FIG. 3 is a drawing to describe a drive signal.

In the embodiment, the drive signal generation circuit 9 generates a drive signal COM sequence containing a plurality of pulse signals PS1 to PS4, as shown in FIG. 3. The drive signal COM is a signal comprising in one recording period T a first pulse signal PS1 containing a fine vibration pulse signal VP1 (a fine vibration waveform element; see FIG. 4) to agitate ink in the vicinity of a nozzle orifice of the recording head 8 (see FIG. 2), a second pulse signal PS2 (a first joint pulse signal or a first joint waveform element) for raising the potential on a constant gradient from medium potential VM (a base potential) to maximum potential VH (a drive potential), a third pulse signal PS3 containing an ejection pulse signal DP1 (an ejection waveform element; see FIG. 4) to eject an ink droplet, and a fourth pulse signal PS4 (a second joint pulse signal or a second joint waveform element) for dropping the potential on a constant gradient from the maximum potential VH to the medium potential VM. The drive signal generation circuit 9 generates the pulse signals PS1 to PS4 repeatedly every recording period T. The drive signal COM will be described later in detail.

The control section 6 also serves as a recording controller and operates based on the various control routines stored in the ROM 5. For example, the control section 6 reads the print data in the reception buffer, converts the print data into intermediate code, stores the intermediate code data in the intermediate buffer, analyzes the intermediate code data read from the intermediate buffer, refers to the font data, the graphics function, etc., in the ROM 5, and converts the intermediate code data to recording data (SI). As the recording data in the embodiment, one dot is represented by 1-bit data (binary data).

The recording data provided by the control section 6 is stored in the output buffer. When the recording data corresponding to one line (one pass corresponding to one main scanning) is stored, the one-line recording data is transmitted in series to the recording head 8 through the internal I/F 10. When the one-line recording data is output from the output buffer, the contents of the intermediate buffer are cleared and the control section 6 generates another-line recording data.

The control section 6 forms a part of a timing signal generator and supplies a latch signal (LAT) and a channel signal (CH) to the recording head 8 through the internal I/F 10. The latch signal and the channel signal define the initial timings of the pulse signals PS1 to PS4 making up the drive signal COM. In other words, the latch signal and the channel signal become triggers each for defining the generation timing of a timing signal supplied from a control logic 46 to a decoder 45. Specifically, as shown in FIG. 3, the latch signal LAT defines the initial timing of the first pulse signal PS1 and the first channel signal CH1 defines the initial timing of the second pulse signal PS2. The second channel signal CH2 defines the initial timing of the third pulse signal PS3 and the third channel signal CH3 defines the initial timing of the fourth pulse signal PS4.

The print engine 2 comprises the recording head 8, a carriage mechanism 11, and a paper delivery mechanism 12. The carriage mechanism 11 consists of a carriage on which the recording head 8 is mounted, a pulse motor for running the carriage via a timing belt, etc., and the like, and moves the recording head 8 in the main scanning direction. The paper delivery mechanism 12 is made up of a paper delivery motor, a paper delivery roller, etc., and delivers sheets of recording paper (a kind of print record medium) in order and performs subscanning.

Next, the recording head 8 will be discussed. To begin with, the structure of the recording head 8 will be discussed. The recording head 8 illustrated in FIG. 2 has piezoelectric vibrators 21 in the so-called flexure vibration mode and is roughly made up of a flow passage unit 22 and an actuator unit 23.

The flow passage unit 22 is made up of a supply port formation substrate 26 formed with through holes as ink supply ports 24 and through holes each as a part of a first nozzle communication port 25, an ink chamber formation substrate 29 formed with through holes as a common ink chamber 27 and through holes as second nozzle communication ports 28, and a nozzle plate 31 formed with a plurality of (for example, 64) nozzle orifices 30 arranged in the subscanning direction. The nozzle plate 31 is placed on the surface (in the figure, the lower side) of the ink chamber formation substrate 29, the supply port formation substrate 26 is placed on the back (in the figure, the upper side) of the ink chamber formation substrate 29, and the supply port formation substrate 26, the ink chamber formation substrate 29, and the nozzle plate 31 are bonded in one piece.

The actuator unit 23 is made up of a first lid member 32 serving as an elastic plate, a pressure chamber formation substrate 34 formed with through holes as pressure chambers 33, a second lid member 36 formed with through holes as supply side communication ports 35 and through holes each as a part of the first nozzle communication port 25, and the piezoelectric vibrators 21. The first lid member 32 and the second lid member 36 are placed on the back and the surface of the pressure chamber formation substrate 34 respectively, and the pressure chamber formation substrate 34 is sandwiched between the first lid member 32 and the second lid member 36 in one piece.

The piezoelectric vibrators 21 are formed on the back of the first lid member 32. The illustrated piezoelectric vibrator 21 is in the flexure vibration mode as described above; as charged, the piezoelectric vibrator 21 is contracted in a direction orthogonal to the electric field, deforming the first lid member 32 (elastic plate) so as to lessen the volume of the corresponding pressure chamber 33 and as discharged, the piezoelectric vibrator 21 is expanded in the direction orthogonal to the electric field, deforming the first lid member 32 so as to increase the volume of the pressure chamber 33. The piezoelectric vibrator 21 is made up of a common electrode 37 formed on the back of the first lid member 32, a piezoelectric layer 38 formed in a stack state on the back of the common electrode 37, and a drive electrode 39 formed on the back of the piezoelectric layer 38. The piezoelectric vibrators 21 are provided in a one-to-one correspondence with the pressure chambers 33; for example, 64 piezoelectric vibrators 21 are formed.

The piezoelectric vibrator 21 acts like a capacitor. If supply of the drive signal COM is shut off, the piezoelectric vibrator 21 holds the potential just before the shutoff.

In the described recording head 8, an ink flow passage from the common ink chamber 27 through the pressure chamber 33 to the nozzle orifice 30 is formed for each nozzle orifice 30. As the piezoelectric vibrator 21 is charged or discharged, the corresponding pressure chamber 33 is contracted or expanded, causing pressure fluctuation to occur in ink in the pressure chamber 33. As the ink pressure is controlled, an ink droplet can be ejected through the nozzle orifice 30. For example, if the pressure chamber 33 in a stationary state is once expanded and then is rapidly contract, an ink droplet is ejected through the nozzle orifice 30. If the pressure chamber 33 is expanded and contract to such an extent that an ink droplet is not ejected, a meniscus (free surface of ink exposed on the nozzle orifice 30) is finely vibrated. Accordingly, ink in the vicinity of the nozzle orifice is agitated, so that an increase in viscosity of ink in the part can be prevented.

Next, the electric configuration of the recording head 8 will be discussed.

As shown in FIG. 1, the recording head 8 comprises a shift register circuit consisting of a first shift register 41 and a second shift register 42, a latch circuit consisting of a first latch circuit 43 and a second latch circuit 44, a decoder 45, a control logic 46, a level shifter 47, a switch circuit 48, and the piezoelectric vibrators 21. A plurality of sets each consisting of the shift registers 41 and 42, the latch circuits 43 and 44, the decoder 45, the switch circuit 48, and the piezoelectric vibrator 21 are provided in a one-to-one correspondence with the nozzle orifices 30 of the recording head 8. That is, one set is provided for each nozzle orifice 30.

The recording head 8 ejects an ink droplet based on the recording data from the printer controller 1. That is, first the recording data from the printer controller 1 is transmitted in series to the second shift register 42 in synchronization with a clock signal (CK) from the oscillation circuit 7 and then is transmitted in series to the first shift register 41. When the recording data is transmitted in series to the second shift register 42, it is used as the recording data in the next recording period T and when the recording data is transmitted in series to the first shift register 41, it is used as the recording data in the present recording period T.

The recording data is 1-bit data (binary data) of "1" or "0" as described above and is set for each dot, namely, for each nozzle orifice 30.

The first latch circuit 43 is electrically connected to the first shift register 41 and the second latch circuit 44 is electrically connected to the second shift register 42. When a latch signal (LAT) from the printer controller 1 is input to the latch circuits 43 and 44, the first latch circuit 43 latches the recording data in the present recording period T and the second latch circuit 44 latches the recording data in the next recording period T.

A set of the first shift register 41 and the first latch circuit 43 and the second shift register 42 and the second latch circuit 44 performing such operation serves as a recording data storage that can store the recording data in the present recording period T and the recording data in the next recording period T. Further, the pair of the first shift register 41 and the first latch circuit 43 serves as a present recording data storage and the pair of the second shift register 42 and the second latch circuit 44 serves as a next recording data storage.

The recording data latched in the latch circuits 43 and 44 is input to the decoder 45. The decoder 45 translates based on the recording data in the present recording period T and the recording data in the next recording period T and generates pulse signal selection data (that can also be represented as waveform element selection data and will be hereinafter referred to as selection data) to select the pulse signals PS1 to PS4. That is, the decoder 45 performing such operation serves as a selection data generator (a waveform element selection data generator or a translator), and generates the selection data from the recording data.

In the embodiment, the recording data per nozzle orifice is two bits in total in both recording periods T and T, and each recording period T is made up of the four pulse signals PS1 to PS4 and thus the decoder 45 translates the two-bit recording data and generates pieces of four-bit selection data corresponding to the nozzle orifices 30.

A timing signal from the control logic 46 is also input to the decoder 45. The control logic 46 serves as a timing signal generator together with the control section 6 and generates a timing signal in synchronization with input of a latch signal (LAT) and a channel signal (CH).

The four-bit selection data generated by the decoder 45 is input to the level shifter 47 in order starting at the most significant bit at the timing defined by the timing signal. The level shifter 47 serves as a voltage amplifier. When the selection data is "1," the level shifter 47 outputs an electric signal boosted up to a voltage capable of driving the switch circuit 48, for example, a voltage of about several ten volts.

The selection data of "1" provided by the level shifter 47 is supplied to the switch circuit 48 also serving as a supply switcher. The drive signal COM from the drive signal generation circuit 9 is supplied to the input of the switch circuit 48 and the piezoelectric vibrator 21 is connected to the output of the switch circuit 48. The selection data controls the operation of the switch circuit 48. That is, the drive signal COM is supplied to the piezoelectric vibrator 21 in the time period during which the selection data applied to the switch circuit 48 is "1," and the potential of the piezoelectric vibrator 21 (which will be hereinafter also referred to as vibrator potential) changes following the potential of the drive signal COM. On the other hand, in the time period during which the selection data applied to the switch circuit 48 is "0," the level shifter 47 does not output an electric signal for operating the switch circuit 48 and thus the drive signal COM is not supplied to the piezoelectric vibrator 21. In short, a pulse signal set to "1" as the selection data is selectively supplied to the piezoelectric vibrator 21.

Thus, in the embodiment, the decoder 45, the control logic 46, the level shifter 47, and the switch circuit 48 supply selected pulse signals PS1 to PS4 to the piezoelectric vibrator 21 and serve as a drive signal supplier (a waveform element supplier). The parts 45 to 48 also serve as a joint pulse signal supplier (a vibrator potential adjuster or a joint waveform element supplier) and selectively supply a first joint pulse signal (second pulse signal PS2) and a second joint pulse signal (fourth pulse signal PS4) to the piezoelectric vibrator 21, thereby adjusting the vibrator potential.

Next, the drive signal COM generated by the drive signal generation circuit 9 and the selecting operation of the pulse signals PS1 to PS4 in the drive signal COM will be discussed.

First, the drive signal COM will be discussed. The drive signal COM illustrated in FIG. 3 is made up of the first pulse signal PS1 generated in a first period t1 within the recording period T, the second pulse signal PS2 generated in a second period t2, the third pulse signal PS3 generated in a third period t3, and the fourth pulse signal PS4 generated in a fourth period t4. That is, the drive signal generation circuit 9 generates the second pulse signal PS2 as the first joint pulse signal before the ejection pulse signal DP1 and generates the fourth pulse signal PS4 as the second joint pulse signal after the ejection pulse signal DP1.

The drive signal COM is started at the medium potential VM, a kind of base potential, and terminates at the medium potential VM. The medium potential VM in the embodiment is set to about 50% to 60% of the maximum potential VH (the drive potential).

The first pulse signal PS1 is made up of a leading constant potential element P1 constant at the medium potential VM, a fine vibration expansion element P2 generated following the leading constant potential element P1 for dropping the potential on a constant gradient to such an extent that an ink droplet is not ejected from the medium potential VM to a fine vibration potential VB, a fine vibration hold element P3 generated following the fine vibration expansion element P2 for holding the fine vibration potential VB, a fine vibration contraction element P4 generated following the fine vibration hold element P3 for raising the potential on a constant gradient to such an extent that an ink droplet is not ejected from the fine vibration potential VB to the medium potential VM, and a trailing constant potential element P5 constant at the medium potential VM, generated following the fine vibration contraction element P4. Of the waveform elements, the fine vibration expansion element P2, the fine vibration hold element P3, and the fine vibration contraction element P4 make up the fine vibration pulse signal (fine vibration waveform element) VP1.

When the fine vibration pulse signal VP1 is supplied, the piezoelectric vibrator 21 slightly expands the pressure chamber 33 of a stationary volume and then contracts the pressure chamber 33 to the stationary volume. That is, as the fine vibration expansion element P2 is supplied, the piezoelectric vibrator 21 slightly deflects to the side for expanding the pressure chamber 33, and maintains the deflection state over the supply time period of the fine vibration hold element P3. Then, as the fine vibration contraction element P4 is supplied, the piezoelectric vibrator 21 becomes deformed in a return direction, restoring the volume of the pressure chamber 33 to the stationary state. Consequently, some pressure fluctuation occurs in ink in the pressure chamber 33, a meniscus is finely vibrated, and ink in the vicinity of the nozzle orifice is agitated. As the ink is agitated, an increase in viscosity of the ink in the vicinity of the nozzle orifice is prevented.

The second pulse signal PS2, which serves as the first joint pulse signal, is made up of a leading constant potential element P6 constant at the medium potential VM, a first joint element P7 generated following the leading constant potential element P6 for raising the potential on a constant gradient to such an extent that an ink droplet is not ejected from the medium potential VM to the maximum potential VH, and a trailing constant potential element P8 constant at the medium potential VM, generated following the first joint element P7. As the second pulse signal PS2 is supplied, the piezoelectric vibrator 21 deflects in a direction for contracting the pressure chamber 33. Consequently, the pressure chamber 33 becomes the minimum volume defined by the maximum potential VH.

The generation time of the gradient portion of the second pulse signal PS2 (first joint element P7) is determined based on a natural vibration period Tc of ink in the pressure chamber 33. In the embodiment, the natural vibration period Tc is about 10 μs and thus the generation time of the first joint element P7 is set to 10 μs matching the natural vibration period Tc.

If the generation time is thus set, while the defective condition of exciting fruitless vibration in ink when the pressure chamber 33 is contracted is prevented, the pressure chamber 33 can be contract in a short time.

The third pulse signal PS3 is made up of a leading constant potential element P9 constant at the maximum potential VH, a pull-in element P10 generated following the leading constant potential element P9 for dropping the potential on a constant steep gradient from the maximum potential VH to minimum potential VL, a pull-in hold element P11 generated following the pull-in element P10 for holding the minimum potential VL for an extremely short time, an ejection contraction element P12 generated following the pull-in hold element P11 for raising the potential on a constant steep gradient from the minimum potential VL to an ejection contraction potential VF1, a first ejection hold element P13 generated following the ejection contraction element P12 for holding the ejection contraction potential VF1 for an extremely short time, an ejection expansion element P14 generated following the first ejection hold element P13 for dropping the potential on a constant steep gradient from the ejection contraction potential VF1 to ejection expansion potential VF2, a second ejection hold element P15 generated following the ejection expansion element P14 for holding the ejection expansion potential VF2 for an extremely short time, a damping element P16 generated following the second ejection hold element P15 for raising the potential on a constant gradient from the ejection expansion potential VF2 to the maximum potential VH, and a trailing constant potential element P17 constant at the maximum potential VH, generated following the damping element P16.

The waveform elements of the pull-in element P10 to the damping element P16 make up the ejection pulse signal (ejection waveform element) DP1. The ejection pulse signal DP1 is a pulse signal for ejecting an ink droplet and in the embodiment, the initial and termination potential of the ejection pulse signal DP1 is set to the maximum potential VH higher than the medium potential VM. When the ejection pulse signal DP1 is supplied to the piezoelectric vibrator 21, the volume of the pressure chamber 33 changes as follows:

First, the piezoelectric vibrator 21 largely and rapidly expands the pressure chamber 33 in a contraction state as the pull-in element P10 is supplied. Next, it rapidly contracts the pressure chamber 33 as the ejection contraction element P12 is supplied. Subsequently, the piezoelectric vibrator 21 again expands the pressure chamber 33 as the ejection expansion element P14 is supplied, and restores the pressure chamber 33 to the contraction state as the damping element P16 is supplied.

By performing this operation sequence, an ink droplet of an extremely small amount is ejected through the nozzle orifice 30. That is, as the volume of the pressure chamber 33 is changed as described above, the center portion of the meniscus swells like a pillar and extends to the recording paper side (ejection side) and the tip side portion is torn and jetted as an ink droplet of an extremely small amount. Consequently, a high-quality image free of graininess can be recorded.

The fourth pulse signal PS4, which serves as the second joint pulse signal, is made up of a leading constant potential element P18 constant at the maximum potential VH, a second joint element P19 generated following the leading constant potential element P18 for dropping the potential on a constant gradient to such an extent that an ink droplet is not ejected from the maximum potential VH to the medium potential VM, and a trailing constant potential element P20 constant at the medium potential VM, generated following the second joint element P19. As the fourth pulse signal PS4 is supplied, the piezoelectric vibrator 21 is returned to the stationary state corresponding to the medium potential VM. Consequently, the pressure chamber 33 is expanded and restored to the stationary volume from the contraction volume corresponding to the maximum potential VH.

The generation time of the gradient portion of the fourth pulse signal PS4 (second joint element P19) is also determined based on the natural vibration period of ink in the pressure chamber 33. In the embodiment, the generation time is set to 10 $\mu$s like that of the first joint element P7 of the second pulse signal PS2.

Next, the selecting operation of the pulse signals PS1 to PS4 making up the drive signal COM, namely, the operation of the drive signal supplier (waveform element supplier) and the joint pulse signal supplier (the decoder 45, the control logic 46, the level shifter 47, and the switch circuit 48) will be discussed.

In the embodiment, to select the pulse signal in the present recording period T, the drive signal supplier also refers to the recording data (binary data) in the next recording period T and determines the pulse signals PS1 to PS4 to be selected based on the recording or non-recording data in the next recording period T. That is, if recording is to be performed in the next recording period T (corresponding to the following recording period in the invention), the pulse signals PS1 to PS4 are selected so that the vibrator potential at the termination time of the present recording period T (which will be hereinafter also referred to as a termination vibrator potential) reaches the maximum potential VH; if non-recording is to be performed, the pulse signals PS1 to PS4 are selected so that the termination potential in the present recording period T becomes the medium potential VM. In other words, if the recording data in the next recording period T indicates a recording state, the waveform element supplier selects waveform elements so that the termination potential in the present recording period T becomes the drive potential; if the recording data indicates a non-recording state, the waveform element supplier selects waveform elements so that the termination potential in the present recording period T becomes the base potential.

Specifically, if a recording state is indicated in the present recording period T and a recording state is indicated in the next recording period T, the third pulse signal PS3 (ejection pulse signal DP1) is selected and the fourth pulse signal (second joint pulse signal) PS4 is not selected. If a recording state is indicated in the present recording period T and a non-recording state is indicated in the next recording period T, the third pulse signal PS3 and the fourth pulse signal PS4 are selected. On the other hand, if a non-recording state is indicated in the present recording period T and a recording state is indicated in the next recording period T, the second pulse signal (first joint pulse signal) PS2 is selected and the third pulse signal PS3 and the fourth pulse signal PS4 are not selected. If a non-recording state is indicated in the present recording period T and a non-recording state is indicated in the next recording period T, only the first pulse signal PS1 (fine vibration pulse signal VP1) is selected and the second pulse signal PS2, the third pulse signal PS3, and the fourth pulse signal PS4 are not selected.

In this case, the decoder 45 translates (decodes) the recording data in the present recording period T latched in the first latch circuit 43 and the recording data in the next recording period T latched in the second latch circuit 44 in a pair for each nozzle orifice 30 to generate selection data corresponding to the nozzle orifice 30.

For example, if the recording data in the present recording period T and the recording data in the next recording period T are "00" indicating a non-recording state and a non-recording state respectively, the decoder 45 generates selection data "1000." If the recording data in the present recording period T and the recording data in the next recording period T are "01" indicating a non-recording state and a recording state respectively, the decoder 45 generates selection data "0100." Further, if the recording data in the present recording period T and the recording data in the next recording period T are "10" indicating a recording state and a non-recording state respectively, the decoder 45 generates selection data "0011." If the recording data in the present recording period T and the recording data in the next recording period T are "11" indicating a recording state and a recording state respectively, the decoder 45 generates selection data "0010."

Figure 4A:
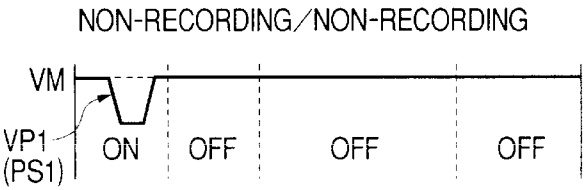
FIGS. 4A to 4D are drawings to describe pulse signal selection patterns.
Figure 4B:
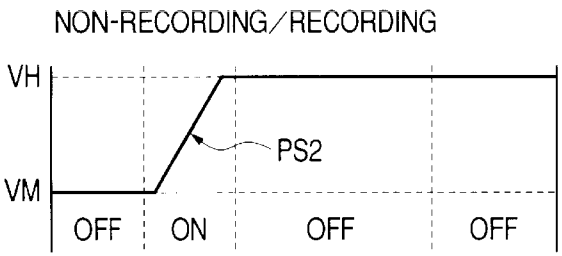
Figure 4C:
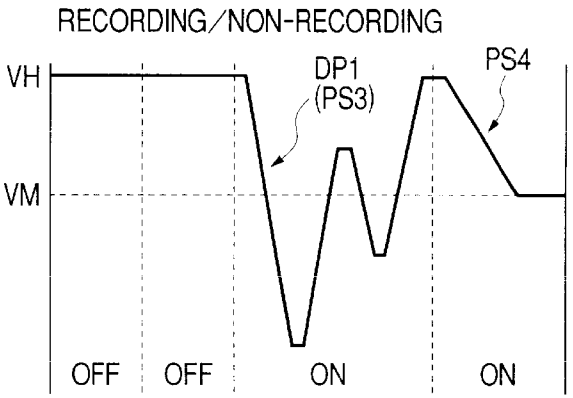
Figure 4D:
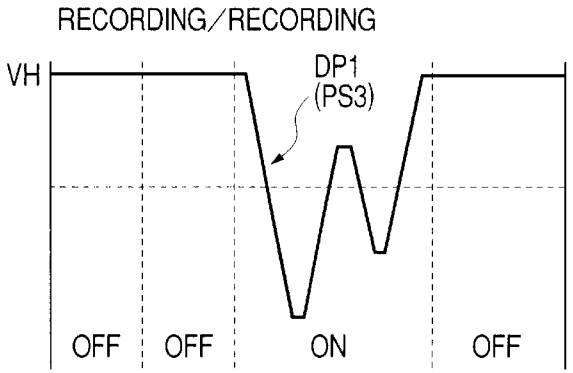

Accordingly, if a non-recording state continues in the present recording period T and the next recording period T, only the first pulse signal PS1 is supplied to the piezoelectric vibrator 21 and the termination vibrator potential in the present recording period T becomes the medium potential VM, as shown in FIG. 4A. If a non-recording state is indicated in the present recording period T and a recording state is indicated in the next recording period T, only the second pulse signal PS2 is supplied to the piezoelectric vibrator 21 and the termination vibrator potential reaches the maximum potential VH, as shown in FIG. 4B. Likewise, if a recording state is indicated in the present recording period T and a non-recording state is indicated in the next recording period T, the third pulse signal PS3 and the fourth pulse signal PS4 are supplied to the piezoelectric vibrator 21 and the termination vibrator potential becomes the medium potential VM, as shown in FIG. 4C. If a recording state continues in the present recording period T and the next recording period T, only the third pulse signal PS3 is supplied to the piezoelectric vibrator 21 and the termination vibrator potential reaches the maximum potential VH, as shown in FIG. 4D.

Figure 5A:
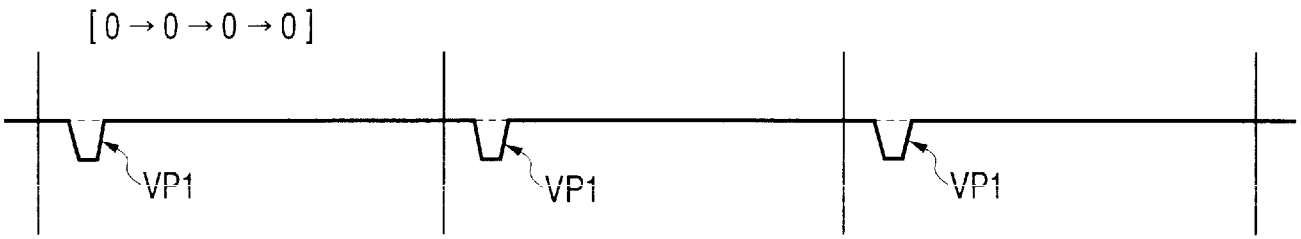
FIG. 5A is a drawing to describe a pulse signal selection pattern when a non-recording state continues.

Therefore, if a non-recording state continues, the piezoelectric vibrator 21 is held in the potential equal to or less than the medium potential VM, as shown in FIG. 5A. Accordingly, the load on the piezoelectric vibrator 21 is reduced and the piezoelectric vibrator 21 can be protected. Since the fine vibration pulse signal VP1 is supplied to the piezoelectric vibrator 21, an increase in viscosity of ink in the vicinity of the nozzle orifice can be prevented.

Figure 5B:
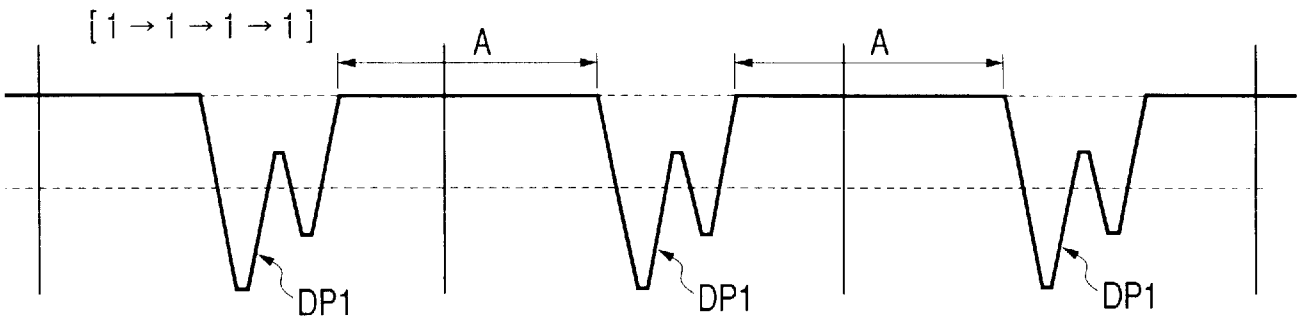
FIG. 5B is a drawing to describe a pulse signal selection pattern when a recording state continues.

On the other hand, if a recording state continues, the maximum potential VH is supplied to the piezoelectric vibrator 21 in time period A from the supply termination of the ejection pulse signal DP1 in the present recording period T to the supply start of the ejection pulse signal DP1 in the next recording period T, as shown in FIG. 5B. However, the vibrator potential in the time period A is constant and thus the load on the piezoelectric vibrator 21 is smaller than that when the vibrator potential is raised and dropped in a short time. Therefore, in this case, the piezoelectric vibrator 21 can also be protected. Further, in this case, the time period during which the vibrator potential is held constant is long and thus the ink pressure in the pressure chamber 33 can be stabilized and the deflected flight of an ink droplet can also be prevented.

Figure 6A:
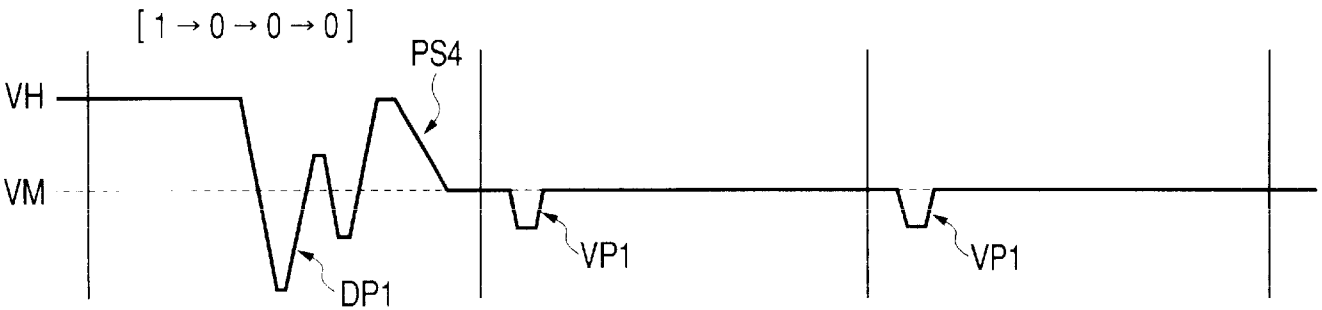
FIG. 6A is a drawing to describe a pulse signal selection pattern when recording state is switched to the non-recording state.

When the recording state is switched to the non-recording state, as shown in FIG. 6A, the third pulse signal PS3 (ejection pulse signal DP1) and the fourth pulse signal (second joint pulse signal) PS4 generated following the third pulse signal PS3 are supplied to the piezoelectric vibrator 21 and thus the vibrator potential can be dropped to the medium potential VM before the next recording period T is started. Accordingly, when the present recording period T and the next recording period T are switched, the vibrator potential and the leading end potential of the first pulse signal PS1 can be matched with each other and the drive signal COM can be supplied smoothly to the piezoelectric vibrator 21. In other words, rapid deformation caused by excessively large potential difference can be prevented.

Figure 6B:
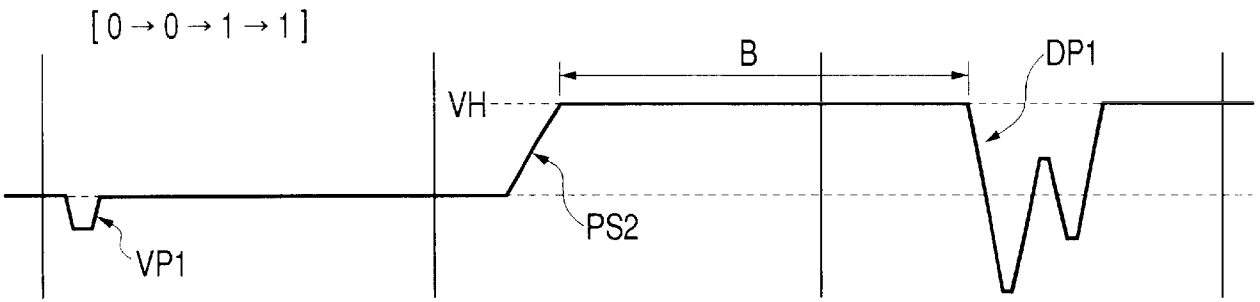
FIG. 6B is a drawing to describe a pulse signal selection pattern when non-recording state is switched to the recording state.

On the other hand, when the non-recording state is switched to the recording state, as shown in FIG. 6B, the second pulse signal (first joint pulse signal) PS2 is supplied in the recording period T just before recording is performed, and the vibrator potential is switched from the medium potential VM to the maximum potential VH in the recording period T. Thus, relatively long time B can be provided until supply of the third pulse signal PS3 (ejection pulse signal DP1) is started after the vibrator potential is adjusted to the maximum potential VH. In doing so, the vibrator potential can be prevented from being raised and dropped rapidly in a short time, and the piezoelectric vibrator 21 can be protected. Further, the ink pressure in the pressure chamber 33 can be stabilized and the deflected flight of an ink droplet can also be prevented.

By the way, the drive signal supplier and the joint pulse signal supplier determine the termination vibrator potential in the present recording period T in response to the contents of the recording data in the next recording period T (namely, information indicating a recording state or a non-recording state), as described above. Thus, the first recording data in one line (one pass) does not involve the corresponding recording data in the preceding recording period T and becomes undefined without taking any measures.

Figure 7:
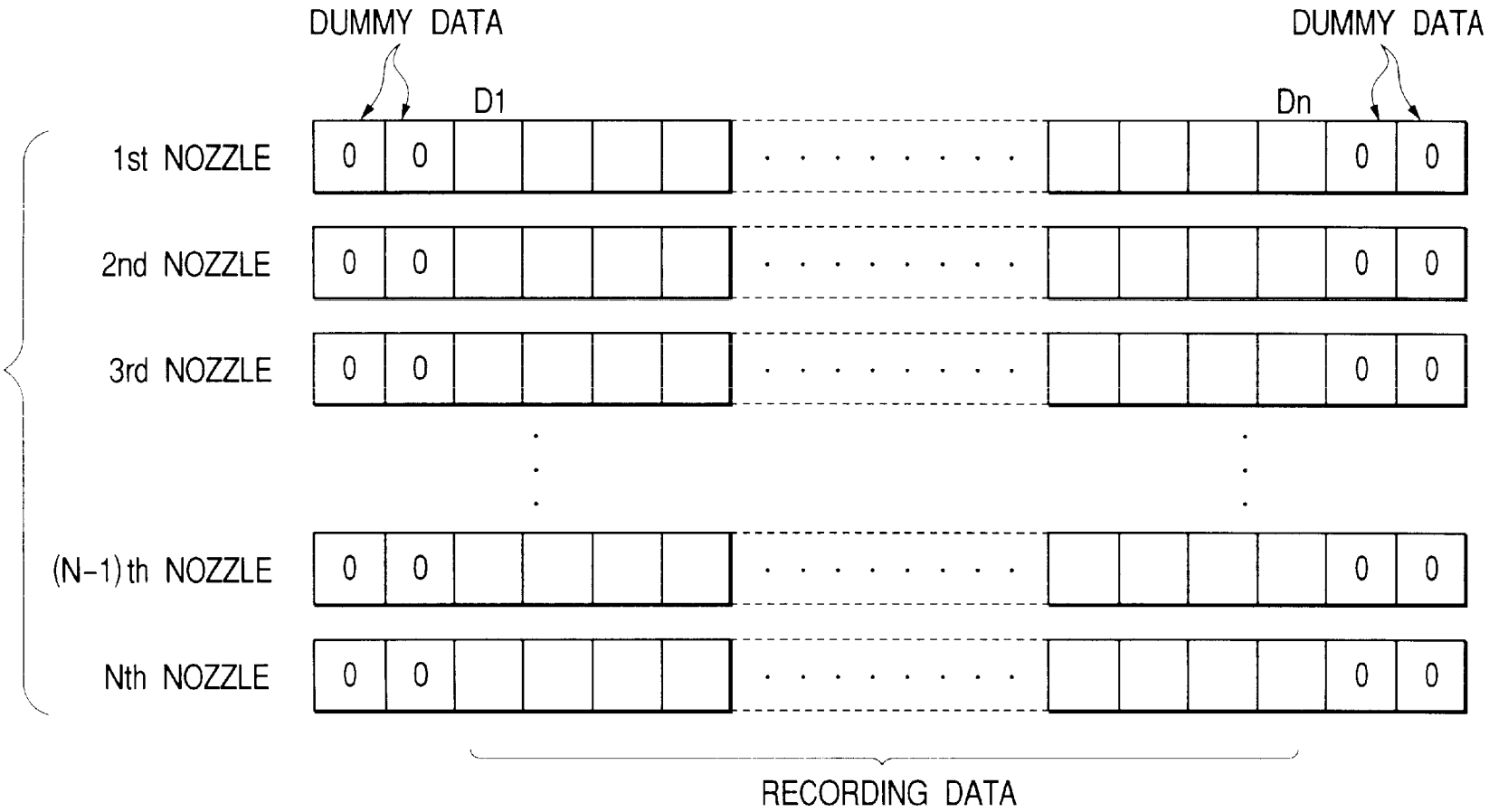
FIG. 7 is a drawing to describe dummy data.

Considering this point, in the embodiment, the control section 6 is made to serve as a dummy data provider which sets recording data indicating a non-recording state as leading dummy data preceding the first data D1 in the recording data corresponding to one line, as shown in FIG. 7.

That is, to expand print data to recording data (binary data), the control section 6 sets recording data of "0" indicating a non-recording state in the top part of one line (for example, as much as two recording periods T).

In doing so, preparation can also be made for the first recording data D1. That is, the drive signal supplier first determines "non-recording/non-recording condition" which means non-recording in the present recording period and non-recording in the next recording period, based on the first leading dummy data and the second leading dummy data. Thus, as shown in FIG. 4A, the first pulse signal PS1 is supplied to the piezoelectric vibrator 21 in the recording period T corresponding to the first leading dummy data. Next, the drive signal supplier makes a determination based on the second leading dummy data and the first print data D1. Here, if the print data D1 indicates a non-recording state, the drive signal supplier determines "non-recording/non-recording" condition, and also supplies the first pulse signal PS1 to the piezoelectric vibrator 21, as shown in FIG. 4A, in the recording period T corresponding to the second leading dummy data. On the other hand, if the print data D1 indicates a recording state, the drive signal supplier determines "non-recording/record" condition (which means non-recording in the present recording period and record in the next recording period). Accordingly, the drive signal supplier supplies the second pulse signal PS2 to the piezoelectric vibrator 21, as shown in FIG. 4B, in the recording period T corresponding to the second leading dummy data. Consequently, preparation can be made for the print data D1 and the signal can be supplied smoothly to the piezoelectric vibrator 21.

The leading dummy data is set to as much as two recording periods T (two bits) in the embodiment, but may be set to as much as one recording period T (one bit) or three recording periods T or more (three bits or more).

In the printer, after the termination of main scanning over one line, immediately main scanning is executed over the next line. Thus, concatenation of one line and the next line also becomes important. Assume that one line terminates at the maximum potential VH. In this case, the potential of the piezoelectric vibrator 21 just before the start of the next line becomes in the vicinity of the maximum potential VH. Thus, if the medium potential VM is supplied to the piezoelectric vibrator 21 on the next line, the piezoelectric vibrator 21 rapidly becomes deformed because of the potential difference. Accordingly, the ink pressure in the pressure chamber 33 can be disordered and abnormal ejection of an ink droplet can also occur in some cases.

Then, in the embodiment, as shown in FIG. 7, the control section 6 (dummy data provider) sets recording data indicating a non-recording state as trailing dummy data following the last data Dn in the recording data corresponding to one line. That is, to expand print data to recording data, the control section 6 sets recording data of "0" indicating a non-recording state as the trailing dummy data in the last part of one line (as much as two recording periods T).

In doing so, concatenation with main scanning over the next line can be accomplished smoothly. That is, the vibrator potential at the termination time of main scanning over one line is set to the medium potential VM regardless of the contents of the recording data Dn in the immediately preceding recording period T. Therefore, if the medium potential VM is supplied to the piezoelectric vibrator 21 in main scanning over the next line, the vibrator potential does not change and smooth concatenation can be conducted. The trailing dummy data is not limited to as much as two recording periods T (two bits) and may be set to as much as one recording period T (one bit) or three recording periods T or more (three bits or more).

Next, a second embodiment of the invention will be discussed. The second embodiment differs from the first embodiment in the waveform of the drive signal COM and the configuration of the recording data storage.

Figure 8:
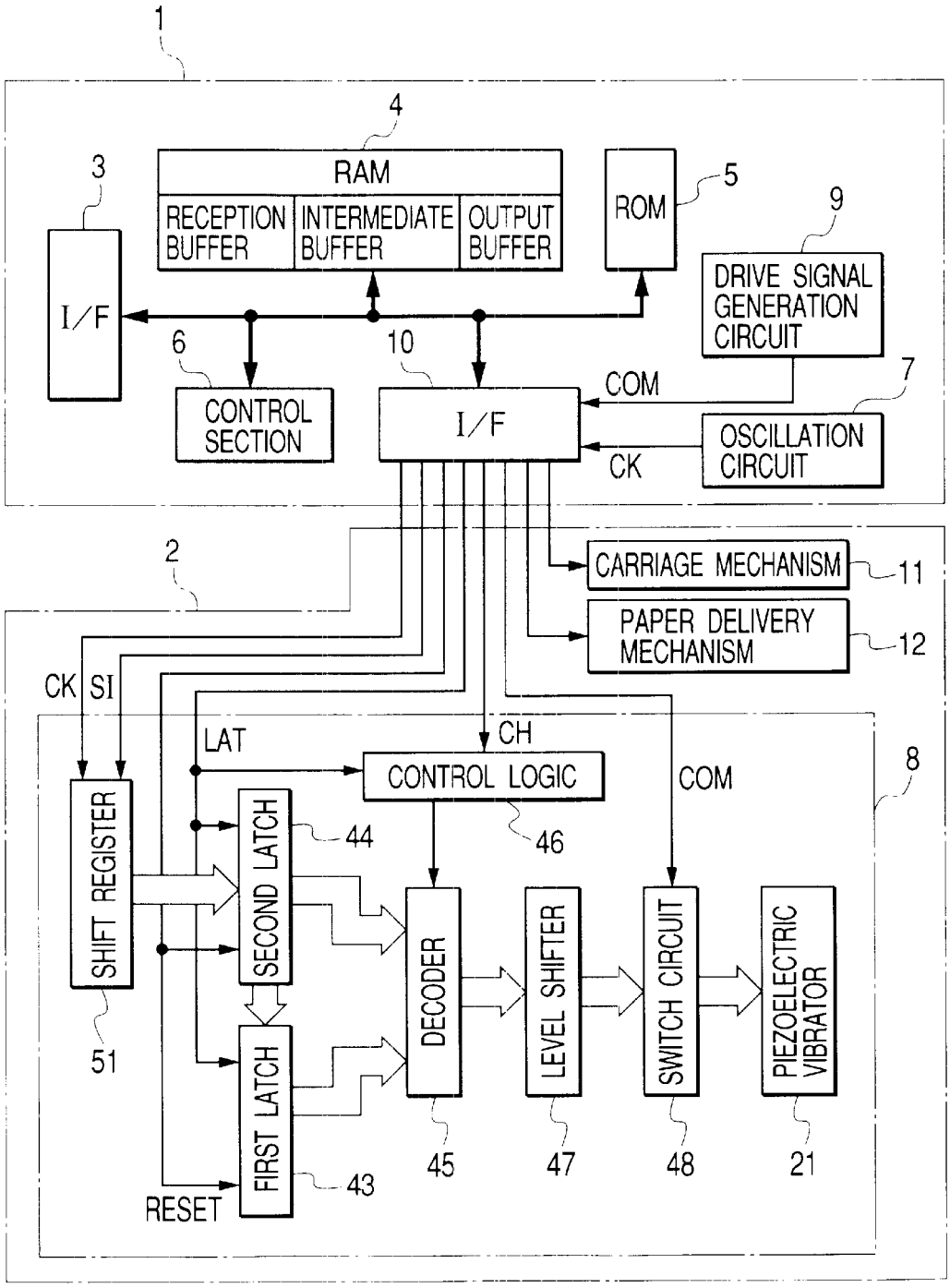
FIG. 8 is a functional block diagram to show the general configuration of a second embodiment of the invention.

First, the configuration of a printer will be discussed with reference to a functional block diagram of FIG. 8. The printer of the second embodiment differs from that of the first embodiment in the configurations of the shift register circuit and the latch circuit.

That is, the printer is provided with a single shift register circuit 51 in place of the two shift registers 41 and 42 in the first embodiment. The shift register circuit 51 is implemented as a circuit in which recording data in one recording period T can be set. A second latch circuit 44 is electrically connected to the shift register circuit 51 and latches the recording data set in the shift register circuit 51 as a latch signal (LAT) is input. A first latch circuit 43 is electrically connected to the second latch circuit 44 and latches the recording data latched in the second latch circuit 44 when the latch signal is input. Thus, when the latch signal is input, the recording data set in the shift register circuit 51 is latched in the second latch circuit 44 and the recording data held in the second latch circuit 44 is latched in the first latch circuit 43. Therefore, in the embodiment, the first latch circuit 43 serves as a present recording data storage and the second latch circuit 44 serves as a next recording data storage.

A reset signal (RESET) from a control section 6 can be input to the first latch circuit 43 and the second latch circuit 44. When the reset signal is input, the latch circuits 43 and 44 clear the held contents, namely, the latched recording data and set initial data indicating a non-recording state, namely, data of "0." In this case, the control section 6 serves as an initializer for resetting the recording data.

Next, a drive signal COM generated by a drive signal generation circuit 9 will be discussed.

Figure 9:
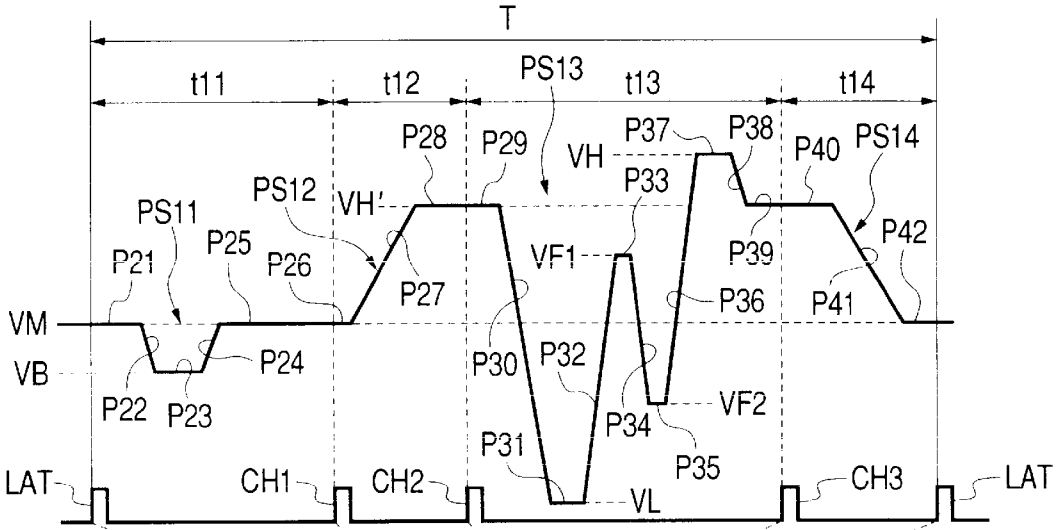
FIG. 9 is a drawing to describe a drive signal in the second embodiment of the invention.

The drive signal COM illustrated in FIG. 9 is made up of a first pulse signal PS11 generated in a first period t11 within the recording period T, a second pulse signal PS12 generated in a second period t12, a third pulse signal PS13 generated in a third period t13, and a fourth pulse signal PS14 generated in a fourth period t14.

The first pulse signal PS11 is similar to the first pulse signal PS1 described above and is made up of a leading constant potential element P21 constant at medium potential VM (a kind of base potential in the invention), a fine vibration expansion element P22 for dropping the potential on a constant gradient to such an extent that an ink droplet is not ejected from the medium potential VM to a fine vibration potential VB, a fine vibration hold element P23 for holding the fine vibration potential VB, a fine vibration contraction element P24 for raising the potential on a constant gradient to such an extent that an ink droplet is not ejected from the fine vibration potential VB to the medium potential VM, and a trailing constant potential element P25 constant at the medium potential VM. Of the waveform elements, the fine vibration expansion element P2, the fine vibration hold element P3, and the fine vibration contraction element P4 make up a fine vibration pulse signal VP2 (a fine vibration waveform element; see FIG. 10A).

When the fine vibration pulse signal VP2 is supplied to a piezoelectric vibrator 21, some pressure fluctuation occurs in ink in a pressure chamber 33, a meniscus is finely vibrated, and ink in the vicinity of a nozzle orifice is agitated.

The second pulse signal PS12, which serves as a first joint pulse signal, is made up of a leading constant potential element P26 constant at the medium potential VM, a first joint element P27 for raising the potential on a constant gradient to such an extent that an ink droplet is not ejected from the medium potential VM to second maximum potential VH', and a trailing constant potential element P28 constant at maximum potential VH. The second maximum potential VH' is a kind of drive potential in the invention and is set to a potential slightly lower than the maximum potential VH.

The third pulse signal PS13 is made up of a leading constant potential element P29 constant at the second maximum potential VH', a pull-in element P30 for dropping the potential on a constant steep gradient from the second maximum potential VH' to minimum potential VL, a pull-in hold element P31 for holding the minimum potential VL for an extremely short time, an ejection contraction element P32 for raising the potential on a constant steep gradient from the minimum potential VL to an ejection contraction potential VF1, a first ejection hold element P33 for holding the ejection contraction potential VF1 for an extremely short time, an ejection expansion element P34 for dropping the potential on a constant steep gradient from the ejection contraction potential VF1 to ejection expansion potential VF2, a second ejection hold element P35 for holding the ejection expansion potential VF2 for an extremely short time, a first damping element P36 for raising the potential on a constant gradient from the ejection expansion potential VF2 to the maximum potential VH, a damping hold element P37 for holding the maximum potential VH, a second damping element P38 for dropping the potential on a constant gradient from the maximum potential VH to the second maximum potential VH', and a trailing constant potential element P39 constant at the second maximum potential VH'.

The waveform elements of the pull-in element P30 to the second damping element P38 make up an ejection pulse signal (an ejection waveform element) DP2. The ejection pulse signal DP2 is a pulse signal for ejecting an ink droplet and in the embodiment, the initial and termination potential of the ejection pulse signal DP2 is set to the second maximum potential VH'.

When the ejection pulse signal DP2 is supplied, the piezoelectric vibrator 21 operates in a similar manner to that when the ejection pulse signal DP1 in the first embodiment is supplied, and ejects an ink droplet of an extremely small amount through the nozzle orifice 21.

That is, the piezoelectric vibrator 21 largely and rapidly expands the pressure chamber 33 in a contraction state as the pull-in element P30 is supplied, and rapidly contracts the pressure chamber 33 as the ejection contraction element P32 is supplied. Subsequently, the piezoelectric vibrator 21 again expands the pressure chamber 33 as the ejection expansion element P34 is supplied, and contracts the pressure chamber 33 to the minimum volume as the first damping element P36 is supplied. Then, the piezoelectric vibrator 21 restores the pressure chamber 33 to the volume defined by the second maximum potential VH' after the expiration of the time defined by the damping hold element P37.

The fourth pulse signal PS14, which serves as a second joint pulse signal, is made up of a leading constant potential element P40 constant at the second maximum potential VH', a second joint element P41 for dropping the potential on a constant gradient to such an extent that an ink droplet is not ejected from the second maximum potential VH' to the medium potential VM, and a trailing constant potential element P42 constant at the medium potential VM.

As the fourth pulse signal PS14 is supplied, the piezoelectric vibrator 21 is returned to the stationary state corresponding to the medium potential VM. Consequently, the pressure chamber 33 is expanded and restored to the stationary volume from the contraction volume corresponding to the maximum potential VH.

Next, the selecting operation of the pulse signals PS11 to PS14, namely, the operation of a drive signal supplier (a waveform element supplier) and a joint pulse signal supplier (decoder 45, control logic 46, level shifter 47, and switch circuit 48) will be discussed.

Also in the embodiment, as in the first embodiment, the drive signal supplier and the joint pulse signal supplier determine the pulse signals PS11 to PS14 to be selected based on information indicating recording or non-recording in the next recording period T. That is, if the recording data is "00," the decoder 45 generates selection data "1000." If the recording data is "01," the decoder 45 generates selection data "0100." If the recording data is "10," the decoder 45 generates selection data "0011." If the recording data is "11," the decoder 45 generates selection data "0010."

Figure 10A:
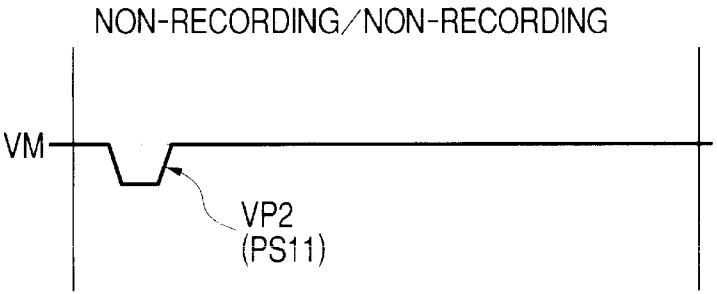
FIGS. 10A to 10D are drawings to describe pulse signal selection patterns in the second embodiment of the invention.
Figure 10B:
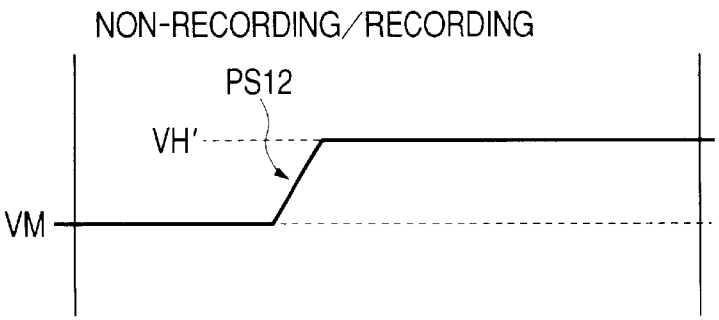

Therefore, if a non-recording state continues, only the fine vibration pulse signal VP2 (first pulse signal PS11) is supplied to the piezoelectric vibrator 21 and the termination vibrator potential in the present recording period T becomes the medium potential VM, as shown in FIG. 10A. If a non-recording state is indicated in the present recording period T and a recording state is indicated in the next recording period T, the second pulse signal (first joint pulse signal) PS12 is supplied to the piezoelectric vibrator 21 and the termination vibrator potential in the present recording period T reaches the second maximum potential VH', as shown in FIG. 10B.

Figure 10C:
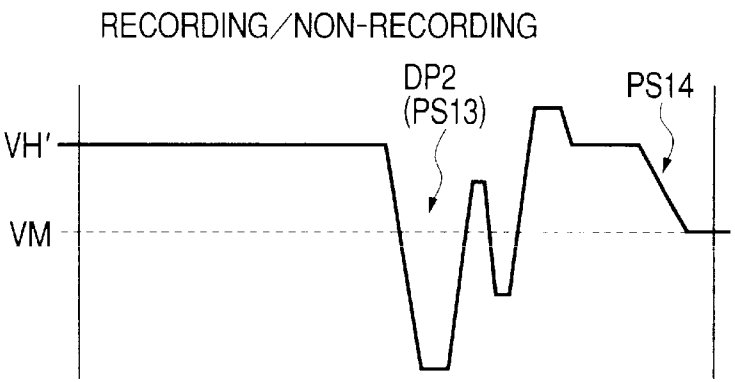
Figure 10D:
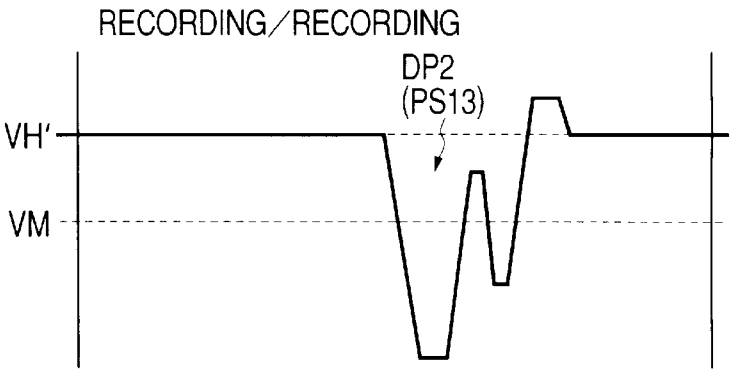

Likewise, if a recording state is indicated in the present recording period T and a non-recording state is indicated in the next recording period T, the ejection pulse signal DP2 (third pulse signal PS13) and the fourth pulse signal (second joint pulse signal) PS14 are supplied to the piezoelectric vibrator 21 and the termination vibrator potential in the present recording period T becomes the medium potential VM, as shown in FIG. 10C. If a recording state continues in the present recording period T and the next recording period T, only the third pulse signal PS13 is supplied to the piezoelectric vibrator 21 and the termination vibrator potential in the present recording period T reaches the second maximum potential VH', as shown in FIG. 10D.

Thus, also in the second embodiment, if a non-recording state continues, the vibrator potential is adjusted to the medium potential VM, so that the load on the piezoelectric vibrator 21 is reduced. If a recording state continues, the vibrator potential becomes constant at the second maximum potential VH' in the time period in which the third pulse signal PS13 is not supplied. Further, when the recording state is switched in the next recording period T, the potential is adjusted in the present recording period T, so that the potential can be prevented from being raised and dropped in a short time.

Consequently, if the piezoelectric vibrator 21 is driven at a high frequency by the ejection pulse signal DP2 having the initial and termination potential set to the second maximum potential VH' higher than the medium potential VM, the piezoelectric vibrator 21 can be protected. Further, raising and dropping the vibrator potential in a short time is decreased, so that the ink pressure in the pressure chamber 33 is easily stabilized and the deflected flight of an ink droplet can also be prevented.

Next, the operation of the second embedment will be discussed centering on the transmission method of data from the printer controller 1 and how the recording data is used in the recording head 8.

In the embodiment, if one-line (one-pass) recording data is obtained, the control section 6 serves as an initializer and outputs a reset signal to the latch circuits 43 and 44, whereby the storage contents of the latch circuits 43 and 44 are cleared to data of "0" (non-recording). If the latch circuits 43 and 44 are reset, the control section 6 transmits the recording data (binary data) of the first dot for all nozzle orifices. The transmitted recording data is set in the shift register circuit 51.

If the recording data for all nozzle orifices is set in the shift register circuit 51, the control section 6 outputs a latch signal to the latch circuits 43 and 44. Upon reception of the latch signal, the first latch circuit 43 latches the recording data in the second latch circuit 44 and the second latch circuit 44 latches the recording data of the first dot set in the shift register circuit 51. That is, the recording data in the second latch circuit 44 is moved to the first latch circuit 43 and the recording data in the shift register circuit 51 is moved to the second latch circuit 44.

The latch circuits 43 and 44 may be reset before the latch signal is output. For example, the latch circuits 43 and 44 may be reset while the recording data of the first dot is being set in the shift register circuit 51, or may be reset just after the recording data of the first dot is set.

Reception of the latch signal triggers the decoder 45 to select the pulse signals PS11 to PS14 using the data latched in the first latch circuit 43 as the recording data in the present record time period T and the data latched in the second latch circuit 44 (the recording data of the first dot) as the recording data in the next record time period T. Accordingly, preparation is made for recording the first dot.

Next, the control section 6 sets the recording data of the second dot in the shift register circuit 51 and outputs a latch signal to the latch circuits 43 and 44. Upon reception of the latch signal, the first latch circuit 43 latches the recording data of the first dot and the second latch circuit 44 latches the recording data of the second dot. Consequently, the first dot is recorded and preparation is made for recording the second dot.

After this, the record operation is performed in a similar manner. The control section 6 suffixes "0" for one dot (namely, one bit of "0") as trailing dummy data to the recording data of the last dot (termination of one line). Accordingly, the trailing dummy data is latched in the second latch circuit 44 with the recording data of the last dot latched in the first latch circuit 43. Therefore, at the record termination time of the last dot, the potentials of all piezoelectric vibrators 21 can be matched with the medium potential VM and when the next line (next pass) is recorded, abnormal deformation of the piezoelectric vibrator 21 caused by the gap between the vibrator potential and the leading end potential of the drive signal can be prevented.

Thus, also in the second embodiment, the defective condition in which the corresponding recording data becomes undefined can be prevented and concatenation with the next line can also be made smoothly.

In the embodiment, the latch circuits 43 and 44 are reset before one-line recording is started (before the recording data of the first dot is latched) and thus the trailing dummy data may be omitted.

Next, a third embodiment of the invention will be discussed. The third embodiment is an embodiment provided by applying the invention to a printer capable of recording with multiple gradations. The third embodiment basically has the same configuration as each of the above-described embodiments; they differ in the waveform of the drive signal COM and the configuration of the recording data storage.

Figure 11:
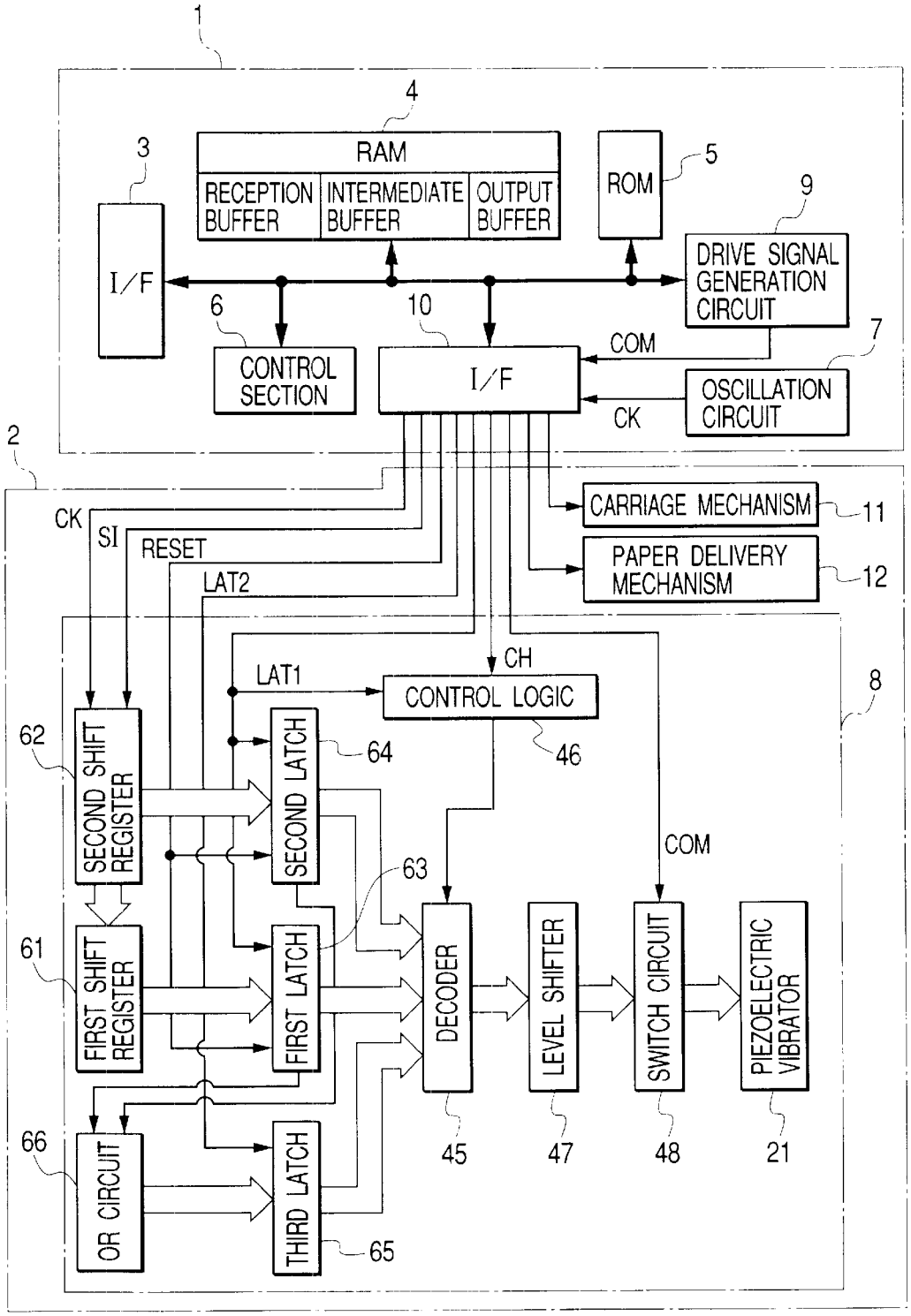
FIG. 11 is a functional block diagram to show the general configuration of a third embodiment of the invention.

First, the configuration difference will be discussed with reference to a functional block diagram of FIG. 11. A printer of the second embodiment differs from that of the first embodiment in the electric configuration of recording head 8. That is, the recording head 8 comprises a shift register circuit consisting of a first shift register 61 and a second shift register 62, a latch circuit consisting of a first latch circuit 63, a second latch circuit 64, and a third latch circuit 65, an OR circuit 66, a decoder 45, a control logic 46, a level shifter 47, a switch circuit 48, and a piezoelectric vibrator 21.

In the embodiment, as recording data, one dot is represented by two-bit gradation data. For example, the gradation data is gradation data "00" indicating a non-recording state (fine vibration), gradation data "01" indicating recording with a small dot, gradation data "10" indicating recording with a medium dot, or gradation data "11" indicating recording with a large dot. Therefore, each dot can be represented with four gradations. The gradation data is separated into the high-order bit and the low-order bit so as to be latched (stored) in the first latch circuit 63 and the second latch circuit 64. That is, the high-order bit data of the gradation data is latched in the second latch circuit 64 and the low-order bit data is latched in the first latch circuit 63.

A plurality of sets each consisting of the shift registers 61 and 62, the latch circuits 63 to 65, the OR circuit 66, the level shifter 47, the switch circuit 48, and the piezoelectric vibrator 21 are provided in a one-to-one correspondence with nozzle orifices 30 of the recording head 8. For example, as shown in FIG. 12A, the first latch circuit 63 comprises first latch elements 63A to 63N and the second latch circuit 64 comprises second latch elements 64A to 64N. The third latch circuit 65 comprises third latch elements 65A to 65N and the OR circuit 66 comprises OR gates 66A to 66N.

The first latch circuit 63 is electrically connected to the first shift register 61 and the second latch circuit 64 is electrically connected to the second shift register 62. When a first latch signal (LAT1) from a printer controller 1 (control section 6) is input to the first and second latch circuits, the first latch circuit 63 latches the low-order bit of the gradation data in present recording period T and the second latch circuit 64 latches the high-order bit of the gradation data in the present recording period T. A set of the first shift register 61 and the first latch circuit 63 and the second shift register 62 and the second latch circuit 64 operating in such a manner serves as a gradation data storage (a kind of the recording data storage) for storing the recording data in the present recording period T (namely, the gradation data).

The OR circuit 66 determines whether the gradation data indicates a recording state or a non-recording state based on the gradation data latched in the first latch circuit 63 and the second latch circuit 64. That is, the OR circuit 66 serves as a recording state determinant for determining the presence or absence of recording in the recording period T.

In the embodiment, the gradation data of non-recording is "00," the gradation data of a small dot is "01," the gradation data of a medium dot is "10," and the gradation data of a large dot is "11," as described above. This means that the gradation data involved in record contains data of "1." The OR gates 66A to 66N as the OR circuits 66 are provided in a one-to-one correspondence with the nozzle orifices 30 and one input terminal of each of the OR gates 66A to 66N is electrically connected to the corresponding one of the first latch circuits 63A to 63N. Likewise, the other input terminal is electrically connected to the corresponding one of the second latch circuits 64A to 64N. Thus, as shown in FIG. 12B, when the OR circuit 66 executes OR-operation the low-order bit of the gradation data latched in the first latch circuit 63 and the high-order bit of the gradation data latched in the second latch circuit 64, the OR circuit 66 outputs the logical operation result of "0" for non-recording or "1" to record any of a small dot, a medium dot, or a large dot. Thus, the output of the OR circuit 66 serves as determination data indicating the presence or absence of recording in the recording period T.

Reception of a second latch signal (LAT2) from the printer controller 1 (control section 6) triggers the third latch circuit 65 to latch the output of the OR circuit 66, namely, the determination data indicating the presence or absence of recording. The second latch signal is supplied to the third latch circuit 65 before the first latch signal is supplied, as described later. That is, the third latch circuit 65 latches the gradation data just before new gradation data in the present recording period T is latched in the first latch circuit 63 and the second latch circuit 64. Thus, the output of the OR circuit 66 becomes the determination data indicating the presence or absence of recording in the preceding recording period T, and the data latched in the third latch circuit 65 becomes history data indicating the presence or absence of recording in the preceding recording period T.

Thus, the third latch circuit 65 serves as a history data storage (a kind of the recording data storage). The OR circuit 66 can also be referred to as a history data generator for generating the history data in the preceding recording period T.

The recording head 8 ejects an ink droplet based on the recording data (SI) from the print controller 1.

Also in the embodiment, before an ink droplet is ejected, first the recording data from the print controller 1 is transmitted in series to the shift register circuit in synchronization with a clock signal (CK) from an oscillation circuit 7. The recording data is made up of the high-order bit data and the low-order bit data for all nozzle orifices 30. First, the low-order bit data is set in the second shift register 62 and then the high-order bit data is set in the second shift register 62. Therefore, as the high-order bit data is set in the second shift register 62, the low-order bit data is shifted and is set in the first shift register 61.

If the high-order bit data of the gradation data is set in the second shift register 62 and the low-order bit data is set in the first shift register 61 or while the high-order bit data and the low-order bit data are being set in the shift registers 61 and 62, the control section 6 of the printer controller 1 outputs a second latch signal. This second latch signal triggers the third latch circuit 65 to latch the determination result based on the gradation data just before being rewritten (output of the OR circuit 66) as the history data in the preceding recording period T. If the third latch circuit 65 latches the history data and the gradation data in the present recording period T is set in the shift registers 61 and 62, the control section 6 outputs a first latch signal. This first latch signal triggers the first latch circuit 63 to latch the low-order bit of the gradation data and the second latch circuit 64 to latch the high-order bit of the gradation data.

The gradation data and the history data latched in the first latch circuit 63, the second latch circuit 64, and the third latch circuit 65 are input to the decoder 45, as shown in FIG. 13. In the embodiment, the low-order bit of the gradation data latched in the first latch circuit 63 is the least significant bit (bit 0). The high-order bit of the gradation data latched in the second latch circuit 64 is the second bit (bit 1) and the history data latched in the third latch circuit 65 is the most significant bit (bit 2).

The contents of the data input to the decoder 45 are not limited to those described above and may be set as desired. For example, the history data may be bit 0 and the gradation data may be bits 1 and 2.

The decoder 45 serves as a selection data generator (a waveform element selection data generator or a translator) which generates selection data to select pulse signals PS20 to PS25 (see FIG. 14) from the history data and the gradation data in the present recording period T. That is, the decoder 45 translates based on the three-bit data latched in the latch circuits 63, 64, and 65 to generate six-bit selection data.

The bits of the selection data correspond to the pulse signals PS20 to PS25. In the embodiment, the most significant bit (bit 5) corresponds to a preparation pulse signal PS20 and the fifth bit (bit 4) corresponds to a first pulse signal PS21. The fourth bit (bit 3) corresponds to a second pulse signal PS22 and the third bit (bit 2) corresponds to a third pulse signal PS23. Likewise, the second bit (bit 1) corresponds to a fourth pulse signal PS24 and the least significant bit (bit 0) corresponds to a fifth pulse signal PS25.

A timing signal from the control logic 46 is also input to the decoder 45. The control logic 46 serves as a timing signal generator together with the control section 6 to generate a timing signal in synchronization with input of the first latch signal (LAT1) and a channel signal (CH).

Also in the embodiment, the decoder 45, the control logic 46, the level shifter 47, and the switch circuit 48 serve as a drive signal supplier (a waveform element supplier) and a joint pulse signal supplier (a kind of the vibrator potential adjuster) of the invention for selecting the pulse signals PS20 to PS25 out of a drive signal COM based on the history data and the gradation data and for supplying the selected pulse signal to the piezoelectric vibrator 21.

Next, the drive signal COM generated by a drive signal generation circuit 9 and the selecting operation of the pulse signals PS20 to PS25 in the drive signal COM will be discussed.

Figure 14:
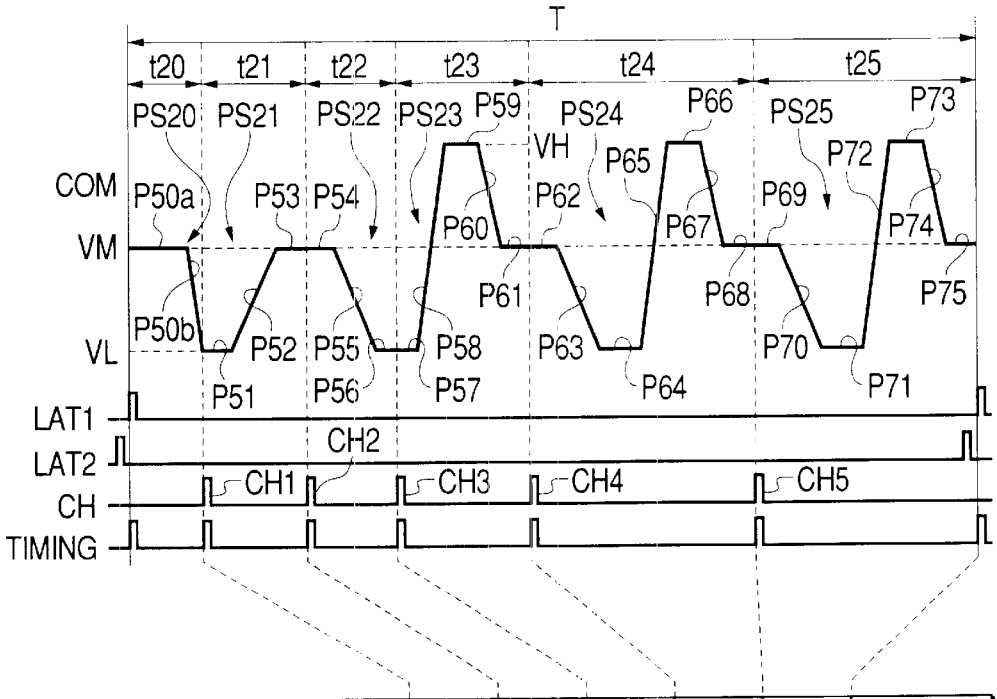
FIG. 14 is a drawing to describe a drive signal in the third embodiment of the invention.

To begin with, the drive signal COM will be discussed. The drive signal COM illustrated in FIG. 14 is also a signal sequence made up of a plurality of waveform elements. The drive signal COM in the embodiment is made up of a preparation pulse signal PS20 generated in a preparation period t20 within the recording period T, a first pulse signal PS21 generated in a first period t21, a second pulse signal PS22 generated in a second period t22, a third pulse signal PS23 generated in a third period t23, a fourth pulse signal PS24 generated in a fourth period t24, and a fifth pulse signal PS25 generated in a fifth period t25.

The preparation pulse signal PS20 is made up of a leading constant potential element P50*a* constant at medium potential VM and a connection element P50*b* for dropping the potential on a steep gradient as much as possible from the medium potential VM to minimum potential VL.

The minimum potential VL is the lowest potential in the drive signal COM and is a kind of the base potential. In the embodiment, the minimum potential VL is set to ground potential appropriate for protecting the piezoelectric vibrator 21. The medium potential VM is the initial and termination potential of ejection pulse signal (ejection waveform element) DP3 to DP5 and is a kind of the drive potential.

The preparation pulse signal PS20 is not supplied to the piezoelectric vibrator 21.

The first pulse signal PS21 is a kind of first joint pulse signal and forms a part of an ejection pulse signal (first ejection pulse signal DP3) described later. The first pulse signal PS21 is made up of a leading constant potential element P51 constant at the minimum potential VL, a first joint element P52 for raising the potential on a constant gradient to such an extent that an ink droplet is not ejected from the minimum potential VL to the medium potential VM, and a trailing constant potential element P53 constant at the medium potential VM.

The second pulse signal PS22 is made up of a leading constant potential element P54 constant at the medium potential VM, a second joint element P55 for dropping the potential on a constant gradient to such an extent that an ink droplet is not ejected from the medium potential VM to the minimum potential VL, and a trailing constant potential element P56 constant at the minimum potential VL.

The third pulse signal PS23 is made up of a leading constant potential element P57 constant at the minimum potential VL, a first ejection element P58 for raising the potential on a steep gradient from the minimum potential VL to the maximum potential VH, a first damping hold element P59 for holding the maximum potential VH for a predetermined time, a first damping element P60 for dropping the potential on a constant gradient from the maximum potential VH to the medium potential VM, and a trailing constant potential element P61 constant at the medium potential VM.

The fourth pulse signal PS24 is made up of a leading constant potential element P62 constant at the medium potential VM, a first expansion element P63 for dropping the potential on a constant gradient to such an extent that an ink droplet is not ejected from the medium potential VM to the minimum potential VL, a first expansion hold element P64 for holding the minimum potential VL, a second ejection element P65 for raising the potential on a steep gradient from the minimum potential VL to the maximum potential VH, a second damping hold element P66 for holding the maximum potential VH for a predetermined time, a second damping element P67 for dropping the potential on a constant gradient from the maximum potential VH to the medium potential VM, and a trailing constant potential element P68 constant at the medium potential VM.

The fifth pulse signal PS25 is made up of a leading constant potential element P69 constant at the medium potential VM, a second expansion element P70 for dropping the potential on a constant gradient to such an extent that an ink droplet is not ejected from the medium potential VM to the minimum potential VL, a second expansion hold element P71 for holding the minimum potential VL, a third ejection element P72 for raising the potential on a steep gradient from the minimum potential VL to the maximum potential VH, a third damping hold element P73 for holding the maximum potential VH for a predetermined time, a third damping element P74 for dropping the potential on a constant gradient from the maximum potential VH to the medium potential VM, and a trailing constant potential element P75 constant at the medium potential VM.

Figure 15:
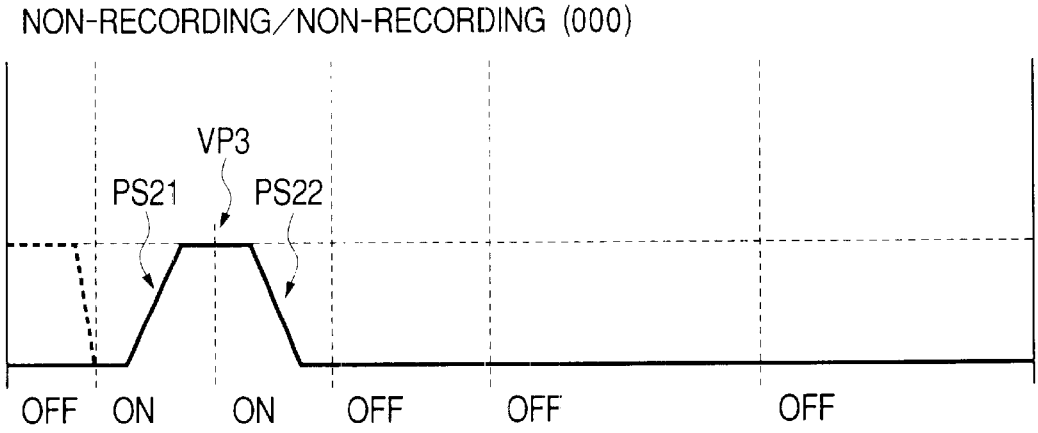
FIG. 15 is a drawing to describe a pulse signal selection pattern in the third embodiment of the invention, wherein the non-recording state is indicated in both the preceding recording period and the present recording period.

The drive signal COM contains a plurality of drive pulse signals. That is, as shown in FIGS. 15 and 16, the drive signal COM contains a fine vibration pulse signal VP3 for preventing an increase in viscosity of ink in the vicinity of the nozzle orifice and ejection pulse signals for ejecting an ink droplet (first ejection pulse signal DP3, second ejection pulse signal DP4, and third ejection pulse signal DP5).

The fine vibration pulse signal VP3 is made up of the first joint element P52 and the trailing constant potential element P53 of the first pulse signal PS21 and the leading constant potential element P54 and the second joint element P55 of the second pulse signal PS22.

Therefore, to supply the fine vibration pulse signal VP3 to the piezoelectric vibrator 21, the first pulse signal PS21 and the second pulse signal PS22 are selected from among the preparation pulse signal PS20 to the fifth pulse signal PS25 making up the drive signal COM. When the fine vibration pulse signal VP3 is supplied to the piezoelectric vibrator 21, ink in the vicinity of the nozzle orifice is agitated.

That is, as the first joint element P52 is supplied, the piezoelectric vibrator 21 becomes deformed and a pressure chamber 33 is contracted relatively moderately from the maximum volume defined by the minimum potential VL to the reference volume defined by the medium potential VM. As the pressure chamber 33 is contracted, ink in the pressure chamber 33 is slightly pressurized and a meniscus is slightly moved to the ejection side. Next, the trailing constant potential element P53 and the leading constant potential element P54 are supplied consecutively, and the contraction state of the pressure chamber 33 is maintained over the supply time period. As the second joint element P55 is supplied, the pressure chamber 33 is expanded relatively moderately from the reference volume to the maximum volume. As the pressure chamber 33 is expanded, ink in the pressure chamber 33 is slightly depressurized and the meniscus is slightly moved to the pressure chamber 33 side. As the meniscus is thus moved, ink in the vicinity of the nozzle orifice is agitated an increase in viscosity of ink is prevented.

The first ejection pulse signal DP3 is made up of the second joint element P55 and the trailing constant potential element P56 of the second pulse signal PS22 and the leading constant potential element P57, the first ejection element P58, the first damping hold element P59, and the first damping element P60 of the third pulse signal PS23.

To supply the first ejection pulse signal DP3 to the piezoelectric vibrator 21, the second pulse signal PS22 and the third pulse signal PS23 are selected from among the preparation pulse signal PS20 to the fifth pulse signal PS25 making up the drive signal COM. When the first ejection pulse signal DP3 is supplied to the piezoelectric vibrator 21, an ink droplet of about 13 pL (picoliters), for example, is ejected through the nozzle orifice 30.

That is, as the second joint element P55 is supplied, the pressure chamber 33 is expanded relatively moderately from the reference volume to the maximum volume. Next, the trailing constant potential element P56 and the leading constant potential element P57 are supplied consecutively, and the expansion state of the pressure chamber 33 is maintained over the supply time period. As the first ejection element P58 is supplied, the pressure chamber 33 is contracted rapidly from the maximum volume to the minimum volume defined by the maximum potential VH. As the pressure chamber 33 is contracted rapidly, ink in the pressure chamber 33 is strongly pressurized. Ink pushed out as it is pressurized is ejected as an ink droplet through the nozzle orifice 30. The contraction state of the pressure chamber 33 is maintained by the first damping hold element P59, and the first damping element P60 is supplied at the timing at which fluctuation of the ink pressure after the ink droplet is ejected can be canceled. As the first damping element P60 is supplied, the pressure chamber 33 is expanded from the minimum volume to the reference volume and as the ink is depressurized accordingly, fluctuation of the ink pressure can be canceled efficiently.

The second ejection pulse signal DP4 is set to the same waveform as the first ejection pulse signal DP3. That is, the second ejection pulse signal DP4 is made up of the first expansion element P63, the first expansion hold element P64, the second ejection element P65, the second damping hold element P66, and the second damping element P67 of the fourth pulse signal PS24. The first expansion element P63 corresponds to the second joint element P55 and the first expansion hold element P64 corresponds to the trailing constant potential element P56 and the leading constant potential element P57 and the potential differences and the supply times are made uniform. The second ejection element P65, the second damping hold element P66, and the second damping element P67 correspond to the first ejection element P58, the first damping hold element P59, and the first damping element P60 respectively.

To supply the second ejection pulse signal DP4 to the piezoelectric vibrator 21, the fourth pulse signal PS24 is selected from among the preparation pulse signal PS20 to the fifth pulse signal PS25 making up the drive signal COM. When the second ejection pulse signal DP4 is supplied to the piezoelectric vibrator 21, an ink droplet of about 13 pL, for example, is ejected through the nozzle orifice 30.

A brief description is given. As the first expansion element P63 is supplied, the pressure chamber 33 is expanded from the reference volume to the maximum volume. As the first expansion hold element P64 is supplied, the expansion state of the pressure chamber 33 is maintained. Then, to eject an ink droplet, the second ejection element P65 is supplied and the pressure chamber 33 is contracted rapidly to the minimum volume. The contraction state of the pressure chamber 33 is maintained over the supply time period of the second damping hold element P66. To suppress fluctuation of the ink pressure after the ink droplet is ejected, the second damping element P67 is supplied, and the pressure chamber 33 is expanded to the reference volume.

The third ejection pulse signal DP5 is also set to the same waveform as the first ejection pulse signal DP3 and the second ejection pulse signal DP4. That is, the third ejection pulse signal DP5 is made up of the second expansion element P70, the second expansion hold element P71, the third ejection element P72, the third damping hold element P73, and the third damping element P74 of the fifth pulse signal PS25. The second expansion element P70 corresponds to the second joint element P55 and the second expansion hold element P71 corresponds to the trailing constant potential element P56 and the leading constant potential element P57. The third ejection element P72, the third damping hold element P73, and the third damping element P74 correspond to the first ejection element P58, the first damping hold element P59, and the first damping element P60 respectively.

To supply the third ejection pulse signal DP5 to the piezoelectric vibrator 21, the fifth pulse signal PS25 is selected from among the preparation pulse signal PS20 to the fifth pulse signal PS25 making up the drive signal COM. When the third ejection pulse signal DP5 is supplied to the piezoelectric vibrator 21, an ink droplet of about 13 pL, for example, is ejected through the nozzle orifice 30.

In the embodiment, if the gradation data in the present recording period T indicates a non-recording state (gradation value "00"), usually the fine vibration pulse signal VP3 is supplied to the piezoelectric vibrator 21 for finely vibrating a meniscus. If the gradation data indicates a small dot (gradation value "01"), only the second ejection pulse signal DP4 is supplied to the piezoelectric vibrator 21 for ejecting one ink droplet. If the gradation data indicates a medium dot (gradation value "10"), the first ejection pulse signal DP3 and the second ejection pulse signal DP4 are supplied to the piezoelectric vibrator 21 for ejecting two ink droplets. If the gradation data indicates a large dot (gradation value "11"), the first ejection pulse signal DP3, the second ejection pulse signal DP4, and the third ejection pulse signal DP5 are supplied to the piezoelectric vibrator 21 for ejecting three ink droplets.

The control will be discussed below:

In the embodiment, the drive signal supplier (waveform element supplier) and the joint pulse signal supplier (the decoder 45, the control logic 46, the level shifter 47, and the switch circuit 48) determine the pulse signals PS20 to PS25 to be selected based on the history data in the preceding recording period T (corresponding to the preceding recording period in the invention) and the gradation data in the present recording period T (corresponding to the following recording period in the invention), because the initial potential of the drive signal COM in the present recording period T varies depending on the recorded gradation (gradation data) and the vibrator potential at the termination time point of the preceding recording period T also varies depending on the recorded gradation.

For example, if a non-recording state is indicated in the present recording period T, the initial potential of the drive signal COM becomes the minimum potential VL of the leading end potential of the first pulse signal PS21. If a small dot is to be recorded, the initial potential becomes the medium potential VM of the leading end potential of the fourth pulse signal PS24. Likewise, if a medium dot or a large dot is to be recorded, the initial potential also becomes the medium potential VM of the leading end potential of the second pulse signal PS22.

On the other hand, if a non-recording state is indicated in the preceding recording period T, the termination vibrator potential in the preceding recording period T becomes the minimum potential VL of the termination potential of the fine vibration pulse signal VP3. When any of a small dot, a medium dot, or a large dot was recorded in the preceding recording period T, the termination vibrator potential becomes the medium potential VM of the termination potential of the ejection pulse signal.

Therefore, if ejection control in the present recording period T is performed without considering the presence or absence of recording in the preceding recording period T, a large gap occurs between the potential of the drive signal COM and the vibrator potential and a rapid drop or rise of the vibrator potential occurs.

For example, if the first pulse signal PS21 is supplied in the present recording period T although the termination vibrator potential in the preceding recording period T is the medium potential VM, the vibrator potential rapidly drops to the minimum potential VL from the medium potential VM. In this case, the piezoelectric vibrator 21 becomes largely deformed and the pressure chamber 33 is rapidly expanded, causing fruitless pressure fluctuation to occur in ink in the pressure chamber 33. Since an excessive load is imposed on the piezoelectric vibrator 21, there is also a probability of shortening the lifetime of the piezoelectric vibrator 21.

Likewise, if the second pulse signal PS22 is supplied without supplying the first pulse signal PS21 in the present recording period T although the termination vibrator potential in the preceding recording period T is the minimum potential VL, the vibrator potential rapidly rises from the minimum potential VL to the medium potential VM. In this case, fruitless pressure fluctuation also occurs in ink in the pressure chamber 33 and there is also a probability of shortening the lifetime of the piezoelectric vibrator 21.

Considering the situation, in the embodiment, the history data indicating the presence or absence of recording in the preceding recording period T is added to the gradation data in the present recording period T to generate selection data. If a non-recording state is indicated in the present recording period T, the vibrator potential is adjusted to the base potential and if a recording state is indicated in the present recording period T, the vibrator potential is adjusted to the drive potential before the ejection pulse signal is supplied.

For example, if a non-recording state is indicated in the preceding recording period T and a recording state is indicated in the present recording period T, the first pulse signal PS21 as the first joint pulse signal (first joint element P52) is supplied to the piezoelectric vibrator 21, whereby the vibrator potential is raised from the minimum potential VL (base potential) to the medium potential VM (drive potential) so as to prevent a gap from occurring between the vibrator potential and the potential of the drive signal COM (ejection pulse signal DP3 to DP5). On the other hand, if a recording state is indicated in the preceding recording period T and a non-recording state is indicated in the present recording period T, the second pulse signal PS22 as the second joint pulse signal (second joint element P55) is supplied to the piezoelectric vibrator 21, whereby the vibrator potential is dropped from the medium potential VM to the minimum potential VL for aggressively holding the vibrator potential low.

How to execute the control will be discussed specifically. To begin with, the control applied if a non-recording state is indicated in the preceding recording period T will be discussed.

For example, if the history data in the preceding recording period T is "0" indicating a non-recording state and the gradation data in the present recording period T is "00" indicating a non-recording state, the decoder 45 generates selection data "011000." Accordingly, the first pulse signal PS21 and the second pulse signal PS22 are selected from among the preparation pulse signal PS20 to the fifth pulse signal PS25 and are supplied to the piezoelectric vibrator 21. That is, as shown in FIG. 15, the switch circuit 48 is turned on in time periods t21 and t22 and the drive signal COM is supplied to the piezoelectric vibrator 21 and the switch circuit 48 is turned off in time periods t20 and t23 to t25 and supplying the drive signal COM to the piezoelectric vibrator 21 is stopped.

Consequently, the fine vibration pulse signal VP3 is supplied to the piezoelectric vibrator 21 for agitating ink in the vicinity of the nozzle orifice. After the fine vibration pulse signal VP3 is supplied, the vibrator potential becomes the minimum potential VL and thus the voltage supplied to the piezoelectric vibrator 21 is reduced. Accordingly, the load on the piezoelectric vibrator 21 is reduced and the lifetime of the piezoelectric vibrator 21 can be extended.

Figure 16A:
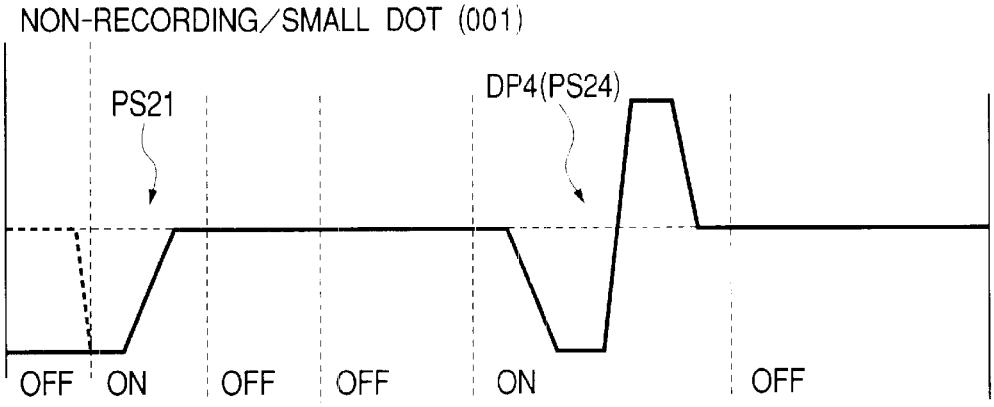
FIGS. 16A to 16C are drawings to describe pulse signal selection patterns in the third embodiment of the invention, wherein the a non-recording state is indicated in the preceding recording period and the recording state is indicated in the present recording period.

If the history data in the preceding recording period T is "0" indicating a non-recording state and the gradation data in the present recording period T is "01" indicating a small dot, the decoder 45 generates selection data "010010." Accordingly, the first pulse signal PS21 and the fourth pulse signal PS24 are selected from among the preparation pulse signal PS20 to the fifth pulse signal PS25 and are supplied to the piezoelectric vibrator 21. That is, as shown in FIG. 16A, the switch circuit 48 is turned on in time periods t21 and t24 and the drive signal COM is supplied to the piezoelectric vibrator 21 and the switch circuit 48 is turned off in time periods t20, t22, t23, and t25 and supplying the drive signal COM to the piezoelectric vibrator 21 is stopped.

Accordingly, the vibrator potential is raised from the minimum potential VL to the medium potential VM in the time period t21 and the medium potential VM is held in the time periods t22 and t23. After this, supplying the drive signal COM, namely, the second ejection pulse signal DP4 is started in the time period t24. The vibrator potential and the leading end potential of the second ejection pulse signal DP4 at the initial time point are both matched with the medium potential VM.

Thus, the second ejection pulse signal DP4 can be smoothly supplied to the piezoelectric vibrator 21 without rapidly changing the vibrator potential. That is, the first pulse signal (first joint pulse signal) PS21 is supplied in the time period t21 for adjusting the vibrator potential to the medium potential VM and then the second ejection pulse signal DP4 is supplied. Thus, if the termination vibrator potential in the preceding recording period T is the minimum potential VL, the second ejection pulse signal DP4 can be supplied without imposing load on the piezoelectric vibrator 21.

When the second ejection pulse signal DP4 is supplied in the time period t24 and an ink droplet is ejected, the switch circuit 48 is turned off in the time period t25. The vibrator potential in the time period t25 becomes the medium potential VM of the termination potential of the second ejection pulse signal DP4 supplied immediately before.

Figure 16B:
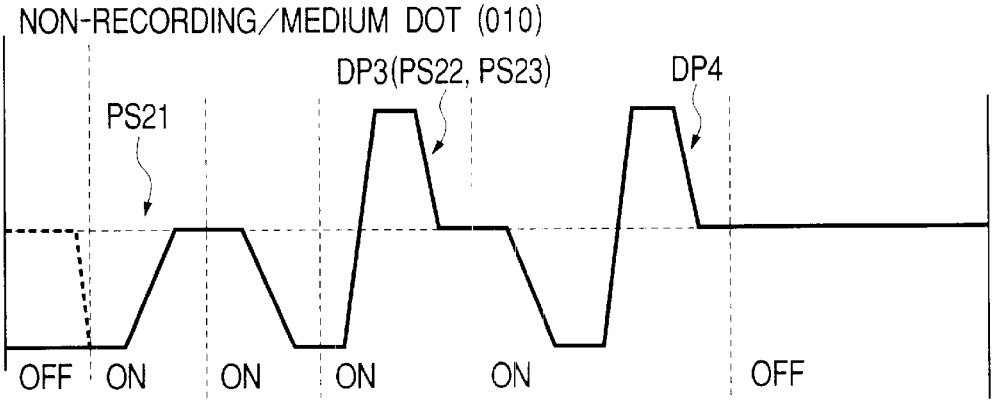

If the history data in the preceding recording period T is "0" indicating a non-recording state and the gradation data in the present recording period T is "10" indicating a medium dot, the decoder 45 generates selection data "011110." Accordingly, the four pulse signals of the first pulse signal PS21 to the fourth pulse signal PS24 are selected from among the preparation pulse signal PS20 to the fifth pulse signal PS25 and are supplied to the piezoelectric vibrator 21. That is, as shown in FIG. 16B, the switch circuit 48 is turned on in the time periods t21 to t24 and the drive signal COM is supplied to the piezoelectric vibrator 21 and the switch circuit 48 is turned off in the time periods t20 and t25 and supplying the drive signal COM to the piezoelectric vibrator 21 is stopped.

Accordingly, the first pulse signal (first joint pulse signal) PS21 is supplied to the piezoelectric vibrator 21 in the time period t21 and thus the vibrator potential is raised from the minimum potential VL to the medium potential VM. After this, the first ejection pulse signal DP3 is supplied to the piezoelectric vibrator 21 in the time periods t22 and t23. The vibrator potential at the initial time point of the first ejection pulse signal DP3 and the leading end potential of the first ejection pulse signal DP3 are both matched with the medium potential VM. Thus, also in this case, the first ejection pulse signal DP3 can be smoothly supplied to the piezoelectric vibrator 21 without rapidly changing the vibrator potential.

When the first ejection pulse signal DP3 is supplied and a first ink droplet is ejected, the second ejection pulse signal DP4 is supplied in the time period t24. Since the termination potential of the first ejection pulse signal DP3 and the leading end potential of the second ejection pulse signal DP4 are both the medium potential VM, the second ejection pulse signal DP4 can also be smoothly supplied.

When the second ejection pulse signal DP4 is supplied in the time period t24 and a second ink droplet is ejected, the switch circuit 48 is turned off in the time period t25. The vibrator potential in the time period t25 becomes the medium potential VM of the termination potential of the second ejection pulse signal DP4 supplied immediately before.

Figure 16C:
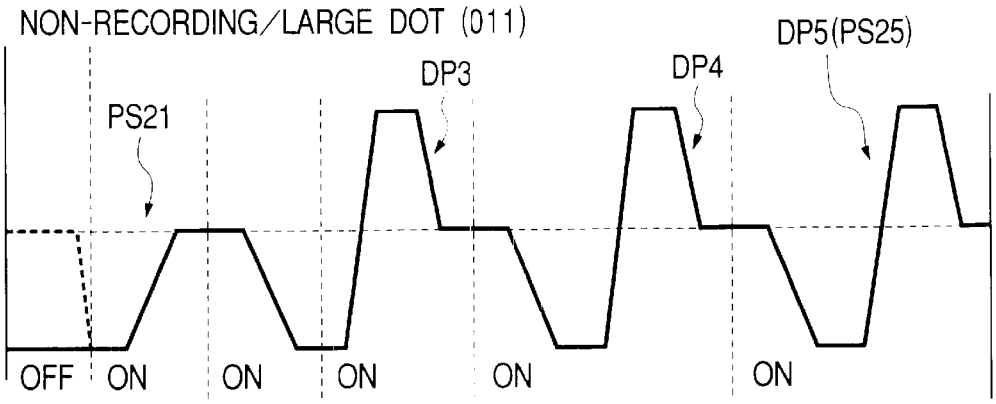

If the history data in the preceding recording period T is "0" indicating a non-recording state and the gradation data in the present recording period T is "11" indicating a large dot, the decoder 45 generates selection data "011111." Accordingly, the pulse signals of the first pulse signal PS21 to the fifth pulse signal PS2 are selected and are supplied to the piezoelectric vibrator 21. That is, as shown in FIG. 16C, the switch circuit 48 is turned on in the time periods t21 to t25 and the drive signal COM is supplied to the piezoelectric vibrator 21.

Accordingly, the first pulse signal PS21 is supplied to the piezoelectric vibrator 21 in the time period t21 and the vibrator potential is raised from the minimum potential VL to the medium potential VM. After this, the first ejection pulse signal DP3 is supplied to the piezoelectric vibrator 21 in the time periods t22 and t23. The second ejection pulse signal DP4 is supplied in the time period t24 and the third ejection pulse signal DP5 is supplied in the time period t25.

When the large dot is recorded, as when the medium dot is recorded, the vibrator potential at the initial time point of each ejection pulse signal and the leading end potential of each ejection pulse signal are both matched with the medium potential VM. Thus, each ejection pulse signal can be smoothly supplied to the piezoelectric vibrator 21 without rapidly changing the vibrator potential.

Next, the control applied if a recording state is indicated in the preceding recording period T will be discussed.

Figure 17:
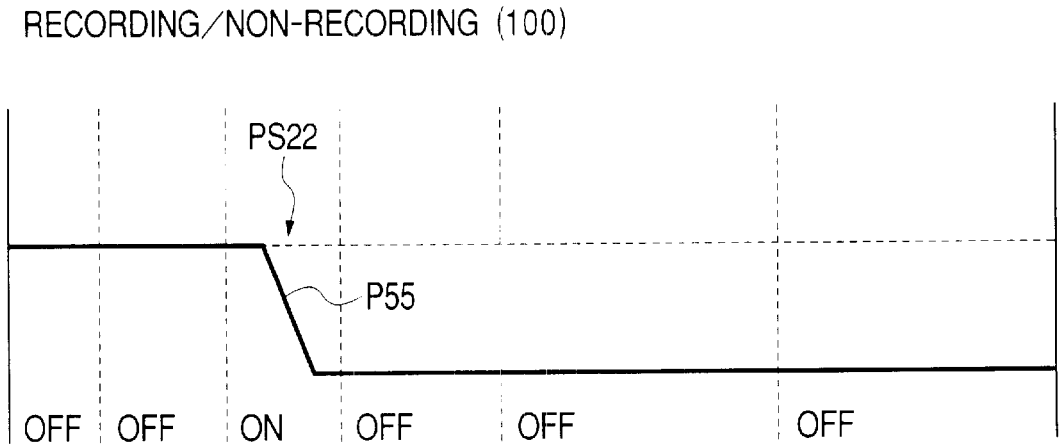
FIG. 17 is a drawing to describe a pulse signal selection pattern in the third embodiment of the invention, wherein the recording state is indicated in the preceding recording period and the non-recording state is indicated in the present recording period.

For example, if the history data in the preceding recording period T is "1" indicating a recording state and the gradation data in the present recording period T is "00" indicating a non-recording state, the decoder 45 generates selection data "001000." Accordingly, the second pulse signal PS22 is selected from among the preparation pulse signal PS20 to the fifth pulse signal PS25 and is supplied to the piezoelectric vibrator 21. That is, as shown in FIG. 17, the switch circuit 48 is turned on in the time period t22 and the drive signal COM is supplied to the piezoelectric vibrator 21 and the switch circuit 48 is turned off in the time periods t20, t21, and t23 to t25 and supplying the drive signal COM to the piezoelectric vibrator 21 is stopped.

Consequently, the second pulse signal PS22 as the second joint pulse signal (second joint element P55) is supplied to the piezoelectric vibrator 21 and the vibrator potential is dropped from the medium potential VM to the minimum potential VL. That is, the fine vibration pulse signal VP3 is not supplied although the gradation data is "00" indicating a non-recording state. After the second pulse signal PS22 is supplied, the vibrator potential becomes the minimum potential VL and thus the voltage supplied to the piezoelectric vibrator 21 is reduced. Accordingly, the load on the piezoelectric vibrator 21 is reduced and the lifetime of the piezoelectric vibrator 21 can be extended.

Figure 18A:
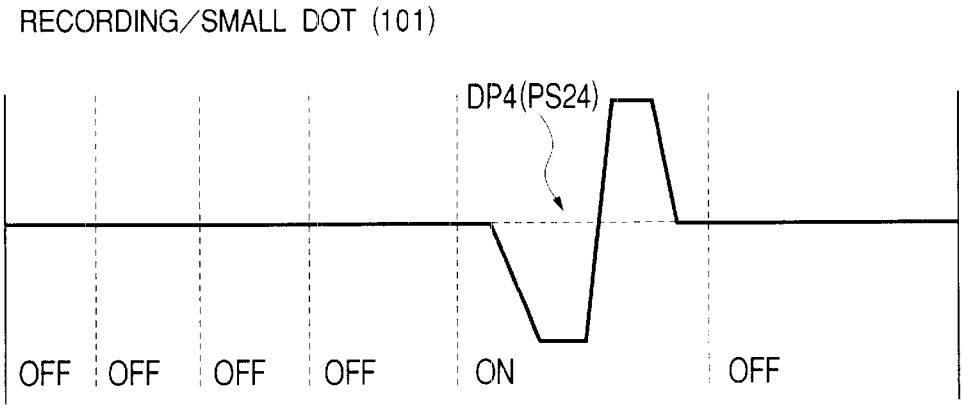
FIGS. 18A to 18C are drawings to describe pulse signal selection patterns in the third embodiment of the invention, wherein the recording state is indicated in both the preceding recording period and the present recording period.

If the history data in the preceding recording period T is "1" indicating a recording state and the gradation data in the present recording period T is "01" indicating a small dot ejection, the decoder 45 generates selection data "000010." Accordingly, the fourth pulse signal PS24 is selected from among the preparation pulse signal PS20 to the fifth pulse signal PS25 and is supplied to the piezoelectric vibrator 21. That is, as shown in FIG. 18A, the switch circuit 48 is turned on in the time period t24 and the drive signal COM is supplied to the piezoelectric vibrator 21 and the switch circuit 48 is turned off in the time periods t20 to t23 and t25 and supplying the drive signal COM to the piezoelectric vibrator 21 is stopped.

In this case, the vibrator potential in the time periods t20 to t23 is held at the medium potential VM of the potential at the termination time point of the preceding recording period T. Supplying the second ejection pulse signal DP4 is started in the time period t24. At this time, the vibrator potential and the leading end potential of the second ejection pulse signal DP4 at the initial time point are both matched with the medium potential VM. Thus, the second ejection pulse signal DP4 can be smoothly supplied to the piezoelectric vibrator 21 without rapidly changing the vibrator potential.

Figure 18B:
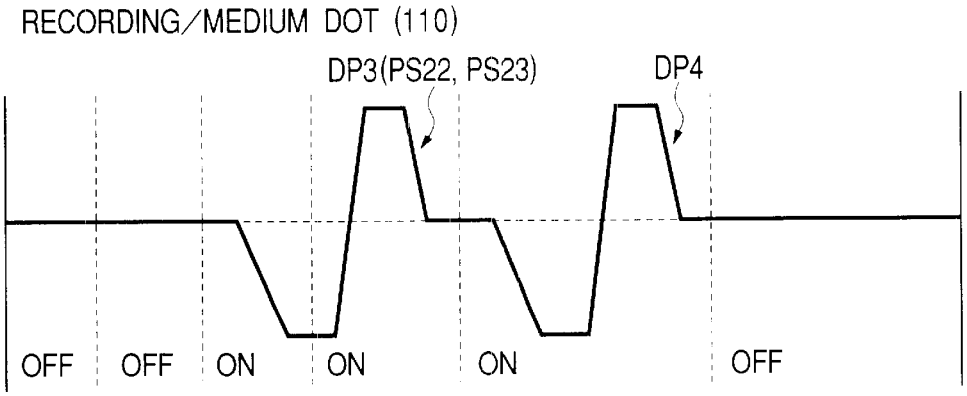

If the history data in the preceding recording period T is "1" indicating a recording state and the gradation data in the present recording period T is "10" indicating a medium dot ejection, the decoder 45 generates selection data "001110." Accordingly, the three pulse signals of the second pulse signal PS22 to the fourth pulse signal PS24 are selected from among the preparation pulse signal PS20 to the fifth pulse signal PS25 and are supplied to the piezoelectric vibrator 21. That is, as shown in FIG. 18B, the switch circuit 48 is turned on in the time periods t22 to t24 and the drive signal COM is supplied to the piezoelectric vibrator 21. On the other hand, the switch circuit 48 is turned off in the time periods t20, t21, and t25 and supplying the drive signal COM to the piezoelectric vibrator 21 is stopped.

In this case, the vibrator potential in the time periods t20 and t21 is held at the medium potential VM of the potential at the termination time point of the preceding recording period T. After this, the first ejection pulse signal DP3 is supplied to the piezoelectric vibrator 21 in the time periods t22 and t23. The vibrator potential at the initial time point of the first ejection pulse signal DP3 and the leading end potential of the first ejection pulse signal DP3 are both the medium potential VM. Thus, the first ejection pulse signal DP3 can be smoothly supplied to the piezoelectric vibrator 21 without rapidly changing the vibrator potential. The subsequent description is similar to that for the condition "from the non-recording state to the medium dot ejection" given above and therefore will not be given again.

Figure 18C:
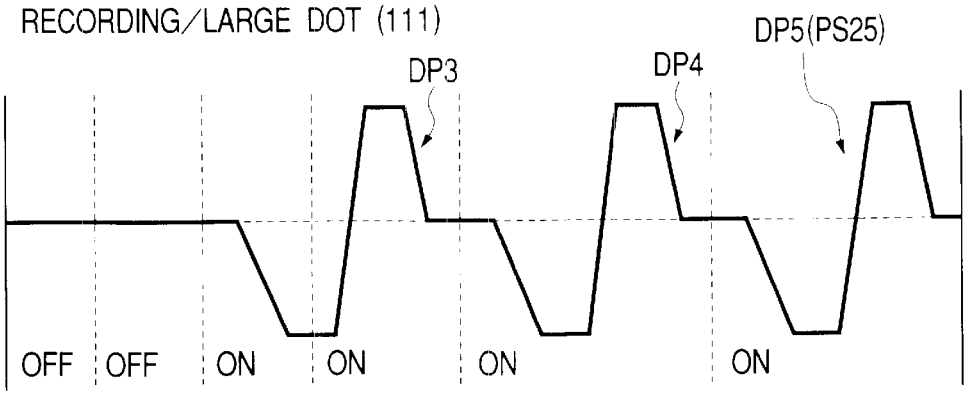

If the history data in the preceding recording period T is "1" indicating a recording state and the gradation data in the present recording period T is "11" indicating a large dot ejection, the decoder 45 generates selection data "001111." Accordingly, the four pulse signals of the second pulse signal PS22 to the fifth pulse signal PS25 are selected from among the preparation pulse signal PS20 to the fifth pulse signal PS25 and are supplied to the piezoelectric vibrator 21. That is, as shown in FIG. 18C, the switch circuit 48 is turned on in the time periods t22 to t25 and the drive signal COM is supplied to the piezoelectric vibrator 21. On the other hand, the switch circuit 48 is turned off in the time periods t20 and t21 and supplying the drive signal COM to the piezoelectric vibrator 21 is stopped.

In this case, the vibrator potential in the time periods t20 and t21 is held at the medium potential VM of the potential at the termination time point of the preceding recording period T. After this, the first ejection pulse signal DP3 to the third ejection pulse signal DP5 are supplied to the piezoelectric vibrator 21 in the time periods t22 to t25. Also in this case, the vibrator potential at the initial time point of the first ejection pulse signal DP3 and the leading end potential of the first ejection pulse signal DP3 are both the medium potential VM, and the first ejection pulse signal DP3 can be smoothly supplied to the piezoelectric vibrator 21.

The subsequent description is similar to that for the condition "from the non-recording state to the large dot ejection" given above and therefore will not be given again.

Figure 19A:
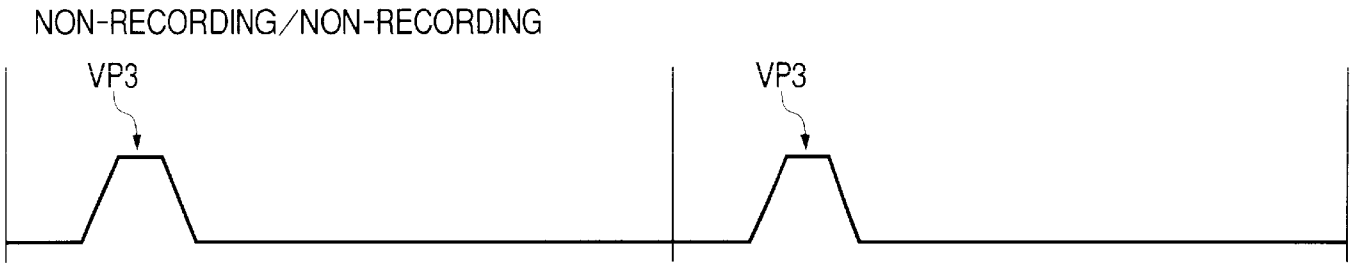
FIGS. 19A to 19C are drawings to describe pulse signal (waveform element) selection patterns in the third embodiment of the invention, wherein the non-recording state is indicated in the preceding recording period.

In the embodiment, if a non-recording state continues in the recording periods T, for example, as shown in FIG. 19A, the fine vibration pulse signal VP3 is supplied at the beginning of each recording period T and then the vibrator potential is held at the minimum potential VL. Thus, the load on the piezoelectric vibrator 21 is reduced and the lifetime of the piezoelectric vibrator 21 can be extended.

The fine vibration pulse signal VP3 is made up of a part of the first pulse signal PS21 (first joint pulse signal) and a part of the second pulse signal PS22 (second joint pulse signal) for adjusting the vibrator potential. Thus, the first pulse signal PS21 and the second pulse signal PS22 can be used for various applications and a plurality of drive pulses can be contained efficiently even in the limited recording period.

Figure 19B:
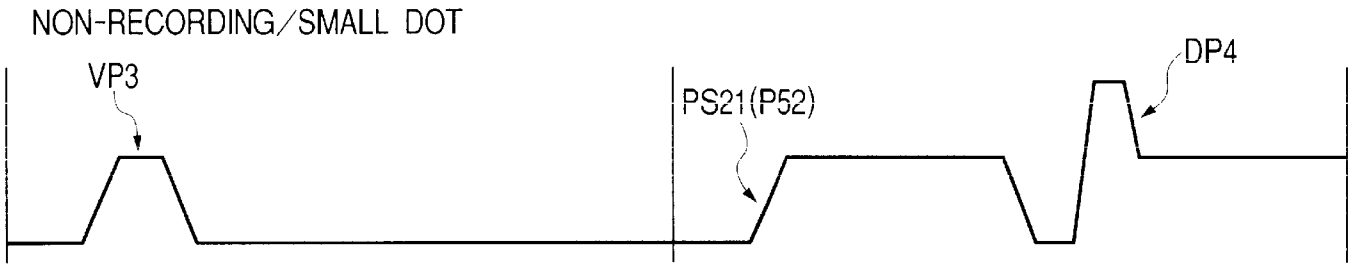
Figure 19C:
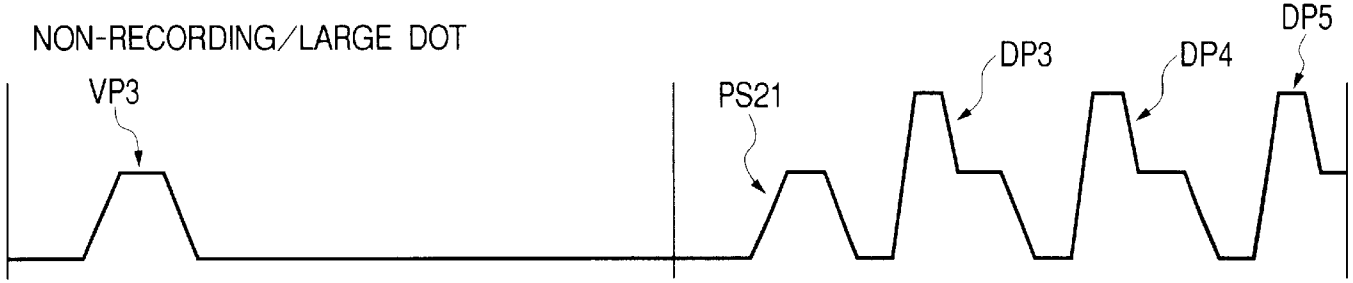

If a non-recording state is indicated in the preceding recording period T and the gradation data in the present recording period T indicates a recording state, for example, as shown in FIGS. 19B and 19C, the first pulse signal PS21 (first joint pulse signal) is supplied to the piezoelectric vibrator 21 at the beginning of the recording period T and the vibrator potential is raised from the minimum potential VL to the medium potential VM before supply of the ejection pulse signals DP3 to DP5. Thus, the ejection pulse signal can be supplied smoothly.

Only one first pulse signal PS21 needs to be placed in the recording period T and a plurality of drive pulses (VP3 and DP3 to DP5) can be contained efficiently even in the limited recording period. Further, the second pulse signal PS22 forms a part of the first ejection pulse signal DP3. Thus, the second pulse signal PS22 is used for various applications and a plurality of drive pulses can also be contained efficiently in the limited recording period.

Figure 20A:
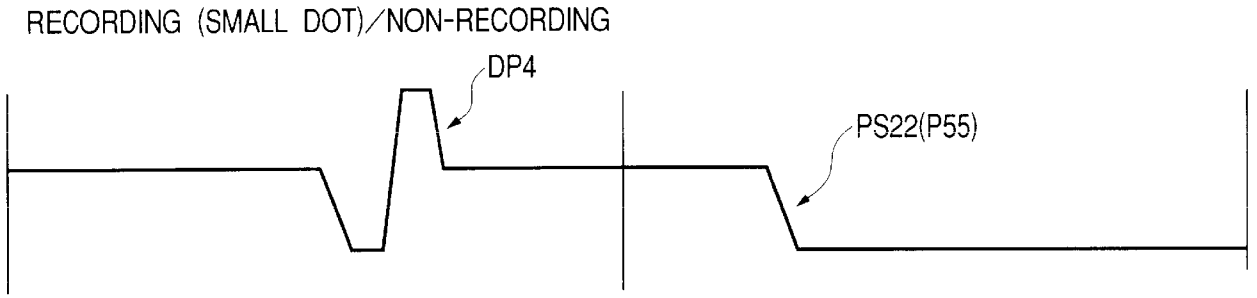
FIGS. 20A to 20C are drawings to describe pulse signal (waveform element) selection patterns in the third embodiment of the invention, wherein the recording state is indicated in the preceding recording period.
Figure 20B:
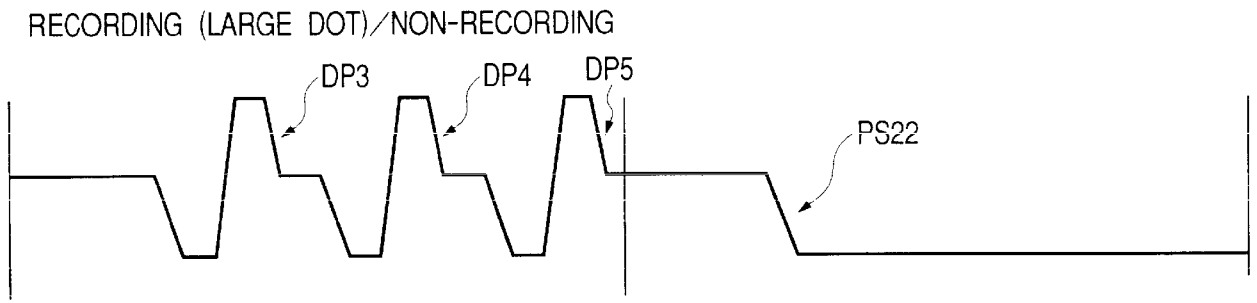

If a dot is recorded in the preceding recording period T and the gradation data in the present recording period T indicates a non-recording state, for example, as shown in FIGS. 20A and 20B, the second pulse signal (second joint pulse signal) PS22 is selected in the present time period T and the second joint element P55 is supplied to the piezoelectric vibrator 21, whereby the vibrator potential is dropped from the medium potential VM to the minimum potential VL. Accordingly, the vibrator potential is held at the minimum potential VL, the load on the piezoelectric vibrator 21 is reduced, and the lifetime of the piezoelectric vibrator 21 can be extended.

Figure 20C:
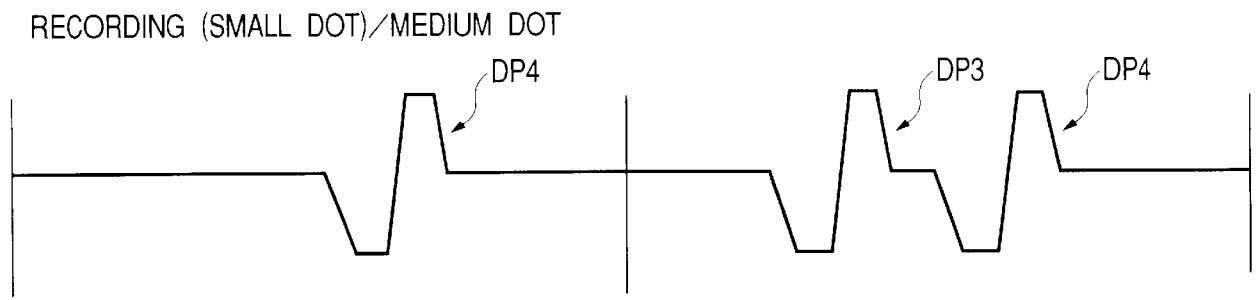

If a dot is recorded in the preceding recording period T and a dot is recorded in the present recording period T, for example, as shown in FIG. 20C, the vibrator potential is maintained at the medium potential VM in the preceding recording period T and then the ejection pulse signal (DP3, DP4) is supplied. In this case, in the time period from the supply termination time of the ejection pulse signal in the preceding recording period T to the initial time of the ejection pulse signal in the present recording period T, the vibrator potential becomes constant at the medium potential VM and is not rapidly raised or dropped in a short time. Thus, the load on the piezoelectric vibrator 21 is reduced and the piezoelectric vibrator 21 can be protected. Further, since the vibrator potential is constant, the volume of the pressure chamber 33 is not changed and ink pressure can be stabilized. Consequently, the deflected flight of an ink droplet can also be prevented.

By the way, the invention is not limited to the specific embodiments and various modifications may be made without departing from the sprit of the invention or the scope of the claims.

To begin with, in the first embodiment, the second pulse signal PS2 (first joint pulse signal) for raising the potential from the medium potential VM (base potential) to the maximum potential VH (drive potential) and the fourth pulse signal PS4 (second joint pulse signal) for dropping the potential from the maximum potential VH to the medium potential VM are contained in the drive signal COM and the pulse signals are selectively supplied to the piezoelectric vibrator 21 for adjusting the vibrator potential, but the invention is not limited to the configuration.

For example, the vibrator potential adjuster may be made up of a resistance element and an adjustment switcher which connects the piezoelectric vibrator 21 to a power source supplying the drive potential or the base potential through the resistance element. The drive potential or the base potential may be supplied through the resistance element for adjusting the vibrator potential. A fourth embodiment of the invention thus configured will be discussed.

Figure 21A:
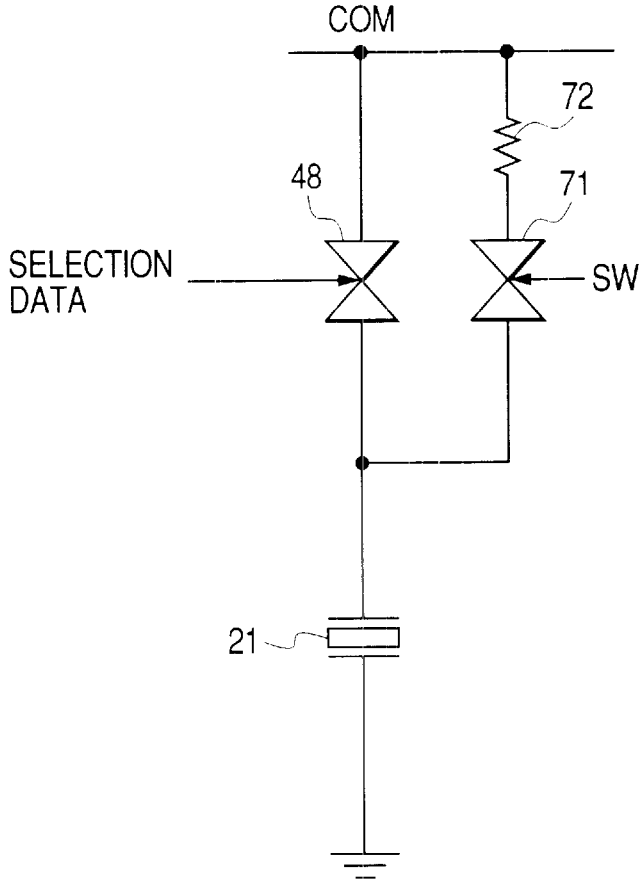
FIG. 21A is a diagram to describe the configuration of the main part of a fourth embodiment of the invention.
Figure 21B:
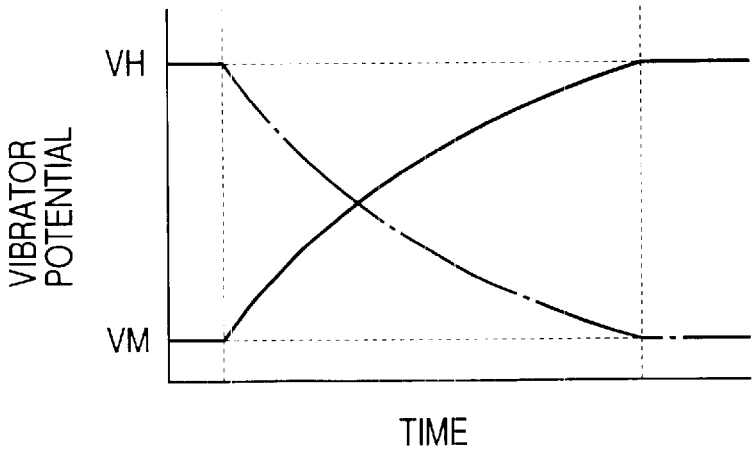
FIG. 21B is a drawing to describe change in vibrator potential in the fourth embodiment of the invention.

FIG. 21A is a diagram to describe the circuit configuration of the main part and FIG. 21B is a drawing to describe the vibrator potential. In the fourth embodiment, an adjustment switch 71 (the adjustment switcher) is placed in parallel with a switch circuit 48 and a supply line of a drive signal COM (a kind of drive potential source and a kind of base potential source) can be connected to a piezoelectric vibrator 21 through the adjustment switch 71 and a resistance element 72. With this, the drive signal COM constant at maximum potential VH in time period t2 and constant at medium potential VM in time period t4 is generated from the drive signal generation circuit 9 in the first embodiment.

The control of the fourth embodiment basically is similar to that of the first embodiment; the adjustment switch 71 is turned on with the switch circuit 48 turned off in place of selecting second pulse signal PS2 in the time period t2. The adjustment switch 71 is turned on with the switch circuit 48 turned off in place of selecting fourth pulse signal PS4 in the time period t4.

The maximum potential VH (drive potential) is supplied to the supply line of the drive signal COM in the time period t2 and the medium potential VM (base potential) is supplied in the time period t4. Thus, if the adjustment switch 71 is turned on over the time period t2, the maximum potential VH is supplied to the piezoelectric vibrator 21 through the resistance element 72. Accordingly, the vibrator potential rises relatively moderately with the passage of time as indicated by the solid line in FIG. 21B. Consequently, as with the case where the second pulse signal PS2 (first joint pulse signal) is supplied, the vibrator potential can be raised from the medium potential VM to the maximum potential VH before the time period t3 comes. In this case, the gradient of the vibrator potential can be adjusted by changing the resistance value of the resistance element 72. Thus, the adjustment is also easy to make.

Likewise, if the adjustment switch 71 is turned on over the time period t4, the medium potential VM is supplied to the piezoelectric vibrator 21 through the resistance element 72. Accordingly, the vibrator potential drops relatively moderately with the passage of time as indicated by the alternate long and short dashed line in FIG. 21B. Consequently, as with the case where the fourth pulse signal PS4 (second joint pulse signal) is supplied, the vibrator potential can be dropped from the maximum potential VH to the medium potential VM before the next recording period T comes.

The on/off control of the adjustment switch 71 can be performed by a control section 6, but the invention is not limited thereto. For example, the durations of the time periods t2 and t4 are already known and thus turning on/off the adjustment switch 71 may be controlled by a switch with a timer function (for example, a watchdog timer) which is turned on in response to input of channel signal CH1, CH3 and is continued on over the time period t2, t4

In this configuration, the maximum potential VH may be generated in the time period t2 and the medium potential VM may be generated in the time period t4, namely, a constant-potential signal may be generated and thus the control section 6 as a signal waveform generation controller need not control the drive signal generation circuit 9 over the time period t2, t4. The time required for the on/off control of the adjustment switch 71 may be an extremely short time at the on time point and the off time point. Thus, the control section 6 can perform any other processing in the time periods t2 and t4, such as controlling to generate pulse signals in other time periods or controlling a carriage mechanism 11, a paper delivery mechanism 12, etc. Therefore, the limited time can be used efficiently.

The vibrator potential adjuster using the adjustment switch 71 and the resistance element 72 can also be applied to the second and third embodiments in a similar manner.

In the third embodiment, the ejection pulse signals have the same waveform, but the invention is not limited to it and they may have different waveforms. The drive potential is not limited to the medium potential VM and can be set to any desired potential higher than the base potential. Likewise, the base potential is not limited to the ground potential if it is a low potential fitted for protecting the piezoelectric vibrator 21.

In the third embodiment, the second joint pulse signal is formed of a part of the ejection pulse signal by way of example; the first joint pulse signal can also be formed of a part of the ejection pulse signal as the waveform of the ejection pulse signal is changed.

In the first and second embodiments, the base potential in the drive signal COM is not limited to the medium potential VM and may be any if it is lower than the initial and termination potential of the third pulse signal PS3 (namely, the drive potential). For example, the base potential may be set to the minimum potential VL as in the third embodiment.

The recording head 8 in each embodiment has the piezoelectric vibrators 21 in the so-called flexure vibration mode, but may have piezoelectric vibrators in the so-called longitudinal vibration mode.

Next, a drive signal COM according to a fifth embodiment of the invention will be discussed. The drive signal can be generated by the drive signal generation circuit 9 shown in FIG. 11. Incidentally, the OR circuit 66 may be replaced with a third shift register.

Figure 22:
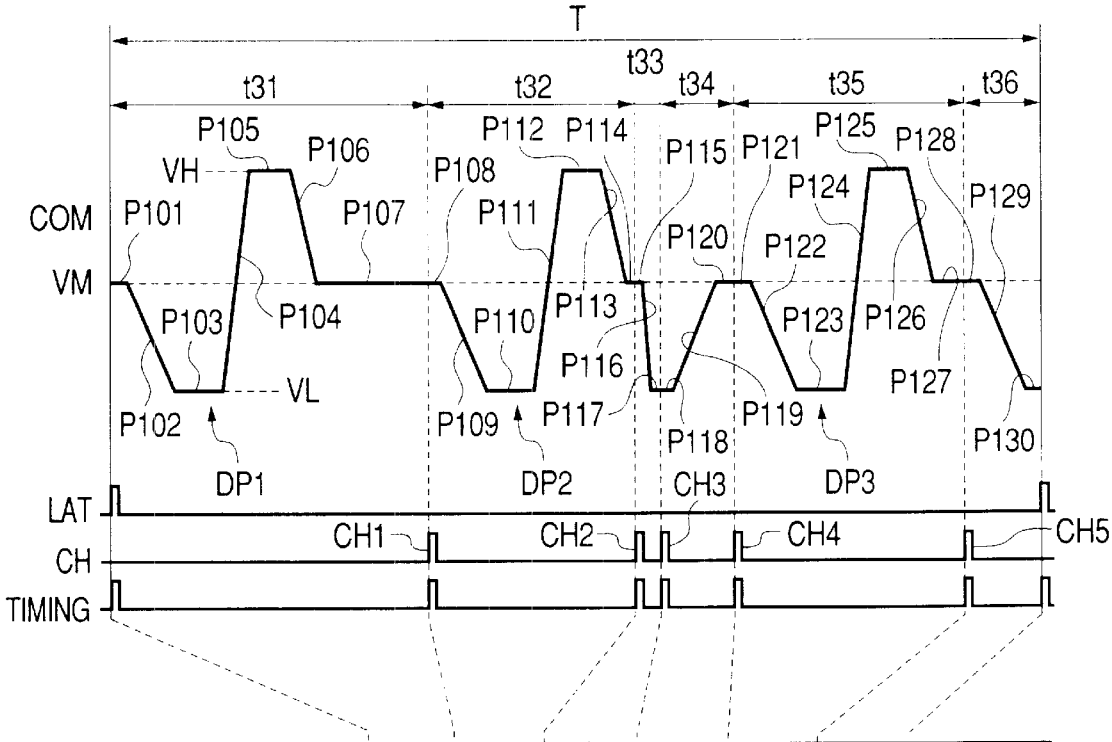
FIG. 22 is a drawing to describe a drive signal in a fifth embodiment of the invention.

As shown in FIG. 22, the drive signal is a group of signals consisting of a first pulse signal PS31, a second pulse signal PS32, a third pulse signal PS33, a fourth pulse signal PS34, a fifth pulse signal PS35, and a sixth pulse signal PS36. The first pulse signal PS31 is produced during a first period t31 within a recording period T; the second pulse signal PS32 is produced during a second period t32; and the third pulse signal PS33 is produced during a third period t33. Further, the fourth pulse signal PS34 is produced during a fourth period t34; the fifth pulse signal PS35 is produced during a fifth period t35; and the sixth pulse signal PS36 is produced during a sixth period t36.

The first pulse signal PS31 includes a leading constant potential element P101; an expansion element P102; an expansion hold element P103; an ejection element P104; a damping hold element P105; a damping element P106; and a trailing constant potential element P107. The leading constant potential element P101 is constant at a medium potential VM. The expansion element P102 causes a potential to decrease to a minimum potential VL at such a constant gradient as not to eject ink droplets from the medium potential VM. The expansion hold element P103 holds the minimum voltage VL for a predetermined duration of time. The ejection element P104 causes the potential to rise from the minimum potential VL to the maximum potential VH at a steep gradient. The damping hold element P105 retains the maximum potential VH for a given duration of time. The damping element P106 lowers the potential to the medium potential VM at such a given gradient at which no ink droplets are ejected from the maximum potential VH. The trailing constant potential element P107 is constant at the medium potential VM. Of the waveform elements, the expansion element P102, the expansion hold element P103, the ejection element P104, the damping hold element P105, and the damping element P106 constitute a first ejection waveform element DP1 to be used for ejecting a given amount of ink droplets.

The second pulse signal PS32 also includes a leading constant potential element P108; an expansion element P109; an expansion hold element P110; an ejection element P111; a damping hold element P112; a damping element P113; and a trailing constant potential element P114. A second ejection waveform element DP2 is constituted of the expansion element P109 to the damping element P113. The elements ranging from the expansion element P109 to the damping element P113 are set to the same potential and duration as those of the elements P102 to P106 included in the first pulse signal PS31. Accordingly, the first ejection waveform element DP1 included in the first pulse signal PS31 and the second ejection waveform element DP2 included in the second pulse signal PS32 assume identical waveforms.

The third pulse signal PS33 includes a leading constant potential element P115 which is constant at the medium potential VM; a connection element P116 which lowers the potential from the medium potential VM to the minimum potential VL at a steep gradient; and a trailing constant potential element P117 which is given at the minimum potential VL. The connection element P116 is an element for connecting the termination potential of the second pulse signal PS32 that is generated immediately before the third pulse signal PS33 (i.e., the second ejection waveform element DP2) with the initial potential of a fourth pulse signal PS34 generated immediately after the third pulse signal PS33 (i.e., the first joint element P119). The connection element P116, the leading constant potential element P115, and the trailing constant potential element P117 are not supplied to the piezoelectric vibrator 21. For this reason, a gradient for the connection element P116 is set so as to become as steep as possible. Moreover, a period of generation of the leading constant potential element P115 and a period of generation of the trailing constant potential element P117 are set to as short a period as possible, thereby minimizing an interval between generation of the second pulse signal PS32 and generation of the fourth pulse signal PS34.

The fourth pulse signal PS34 includes a leading constant potential element P118 which is constant at the minimum potential VL; the first joint element P119 which raises the potential at a given gradient from the minimum potential VL to the medium potential VM; and a trailing constant potential element P120 which is constant at the medium potential VM.

The first joint element P119 is a waveform element for raising a vibrator potential from the minimum potential VL to the medium potential VM. The gradient is set to such an extent that the load to be imposed on the piezoelectric vibrator 21 becomes lighter and that pressure variations which do not cause ejection of ink droplets arise in the ink stored in a pressure chamber 33.

The fifth pulse signal PS35 includes a leading constant potential element P121, an expansion element P122, an expansion hold element P123, an ejection element P124, a damping hold element P125, a damping element P126, and a trailing constant potential element P127. A third ejection waveform element DP3 is constituted of elements ranging from the expansion element P122 to the damping element P126. The expansion element P122 to the damping element P126 are set to the same potentials and durations as those of the elements included in the first pulse signal PS31 and those including in the second pulse signal PS32. Accordingly, the third ejection waveform element DP3 is identical in waveform pattern with the first and second ejection waveform elements DP1 and DP2.

The sixth pulse signal PS36 includes a leading constant potential element P128 which is constant at the medium potential VM; a second joint element P129 which lowers the potential from the medium potential VM to the minimum potential VL at a given gradient; and a trailing constant potential element P130 which is constant at the minimum potential VL. Accordingly, with this drive signal COM, the second joint element P129 is produced after the third ejection waveform element DP3, which is the final ejection waveform element in the recording period T. The third ejection waveform element DP3 is produced between the second joint element P129 and the first joint element P119.

The second joint element P129 is a waveform element for lowering the potential of the vibrator from the medium potential VM to the minimum potential VL. As in the case of the first joint element P119, the gradient is set to such an extent that the load to be imposed on the piezoelectric vibrator 21 becomes lighter and that pressure variations which do not cause ejection of ink droplets arise in the ink stored in the pressure chamber 33.

With the drive signal, when an ejection waveform element (any one of DP1 to DP3) is supplied to the piezoelectric vibrator 21, a predetermined amount of ink is ejected from the nozzle orifices 30. As a result of supply of an expansion element (P102, P109, or P122), the pressure chamber 33 is expanded from a steady volume specified by the medium potential VM to the maximum volume specified by the minimum potential VL. The ink stored in the pressure chamber 33 is resultantly subjected to decompression, thereby exciting pressure vibration. Next, an expansion hold element (P103, P110, or P123) is supplied, whereby the expanded state of the pressure chamber 33 is maintained. In the meantime, the pressure of the ink stored in the pressure chamber 33 is changed to a positive pressure. An ejection element (P104, P111, or P124) is supplied at a timing at which the pressure of the ink has been changed to a positive pressure, whereby the volume of the pressure chamber 33 is sharply diminished to the minimum volume specified by the maximum potential VH. As a result, the ink stored in the pressure chamber 33 is squeezed, and a predetermined quantity of ink droplets is ejected from the nozzle orifices 30. Subsequently, when a damping hold element (P105, P112, or P125) is supplied, the contracted state of the pressure chamber 33 is maintained. During this period of time, variations arise in the pressure of the pressure chamber 33. A damping element (P106, P113, and P126) is supplied at a timing at which the pressure of the ink stored in the pressure chamber 33 becomes positive. The pressure chamber 33 expands as a result of supply of the damping element, thereby canceling the variations in the pressure of the ink.

With the drive signal, when the first joint element P119 is supplied to the piezoelectric vibrator 21, the potential of the vibrator rises from the minimum potential VL to the medium potential VM. In accordance with a rise in the potential of the vibrator, the pressure chamber 33 expands from the minimum volume specified by the minimum potential VL to the steady volume specified by the medium potential VM. As a result of expansion, the ink stored in the pressure chamber 33 is slightly susceptible to negative pressure to such an extent that ink droplets are not ejected, thereby exciting pressure vibration.

When the second joint element P129 is supplied to the piezoelectric vibrator 21, the potential of the vibrator lowers from the medium potential VM to the minimum potential VL. In association with a decrease in the potential of the vibrator, the volume of the pressure chamber 33 is diminished from the steady volume to the minimum volume. With this contraction, the ink stored in the pressure chamber 33 is subjected to pressure vibration which is excited to such an extent that ink droplets are not ejected.

In the embodiment, when gradation data pertaining to a present recording period T represent a non-recording operation and history data pertaining to a subsequent dot recording period T represent a non-recording operation; that is, in the case of output data [000], the waveform element supplier supplies the first joint element P119 and the second joint element P129 to the piezoelectric vibrator 21 during the present recording period T. As a result, pressure vibration which does not cause ejection of ink droplets is excited in the ink stored in the pressure chamber 33 during the recording period T. Meniscus of ink in the nozzle orifice 30 is finely vibrated, thereby preventing an increase in the viscosity of ink therein. In this case, the potential of the vibrator at the end of the present recording period T is adjusted to the minimum potential VL.

When gradation data pertaining to the present recording period represent a non-recording operation and history data pertaining to the next recording period represent a recording operation; that is, in the case of output data [001], the waveform element supplier supplies the first joint element P119 to the piezoelectric vibrator 21 during the present recording period T. As a result, during the end of the present recording period T, the potential of the vibrator rises from the minimum potential VL to the medium potential VM. Consequently, when an ejection waveform element is supplied during the present recording period T, the potential of the vibrator matches the initial potential of the ejection waveform element, thereby activating the piezoelectric vibrator 21 smoothly.

Further, when gradation data pertaining to the present recording period represent recording of any one from a small dot, a medium dot, and a large dot and history data pertaining to the next recording period represent a non-recording operation; for example, in the case of output data [110] (the present recording period is a large dot, and the next recording period is a non-recording operation), the waveform element supplier supplies the second joint element P129 to the piezoelectric vibrator 21 during the present recording period T. As a result, at the end of the present recording period T, the potential of the vibrator drops from the medium potential VM to the minimum potential VL. Consequently, during the next recording period T, the potential of the vibrator can be maintained at the minimum potential VL, thereby enabling protection of the piezoelectric vibrator 21.

Moreover, when gradation data pertaining to the present recording period represent recording of any one from a small dot, a medium dot, and a large dot and history data pertaining to the next recording period represent a recording operation; for example, in the case of output data [011] (the present recording period is a small dot, and the next recording period is a recording operation), the waveform element supplier supplies neither the first joint element P119 nor the second joint element P129 to the piezoelectric vibrator 21 during the present recording period T. As a result, at the end of the present recording period T, the potential of the vibrator assumes the medium potential VM. Consequently, when the ejection waveform element is supplied during the next recording period T, the potential of the vibrator matches the initial potential of the ejection waveform element, thereby activating the piezoelectric vibrator 21 smoothly.

Control of the piezoelectric vibrator 21 will now be described in detail. First will be described control of the piezoelectric vibrator 21 to be performed in the case of the present recording period T relating to a non-recording operation (i.e., in the case of gradation data [00]).

On the basis of output data (i.e., gradation data and history data), the waveform element supplier of the embodiment determines pulse signals PS31 to PS36 to be selected.

Figure 23A:
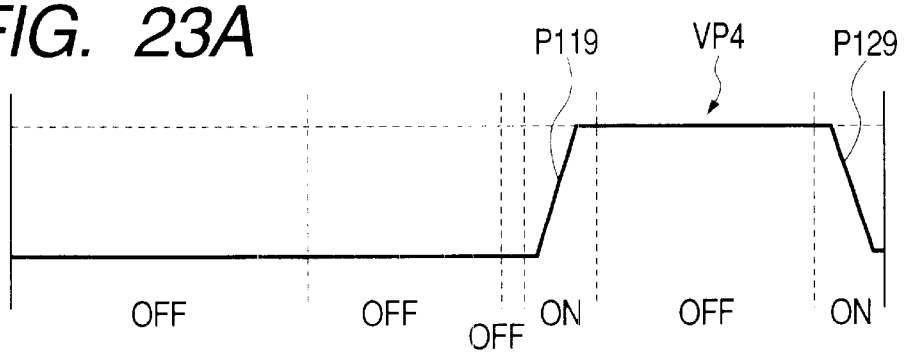
FIG. 23A is a drawing to describe a pulse signal selection pattern in the fifth embodiment of the invention, wherein the a non-recording state is indicated in a present recording period and a non-recording state is indicated in a next recording period.

When output data are [000]; that is, when history data pertaining to the next recording period represent [0], the decoder 45 products the selection data [000101]. As a result, the fourth pulse signal PS34 and the sixth pulse signal PS36 are selected from the first pulse signal PS31 to the sixth pulse signal PS36, and the thus-selected pulse signals are supplied to the piezoelectric vibrator 21. As shown in FIG. 23A, the switch circuit 48 is activated during a period from the fourth period t34 to the sixth period t36, whereupon a drive signal is supplied to the piezoelectric vibrator 21. During a period from the first period t31 to the third period t33, and during the fifth period t35, the switch circuit 48 becomes inactive, thereby suspending supply of a drive signal to the piezoelectric vibrator 21.

Consequently, the micro-vibration consisting of the first joint element P119 and the second joint element P129 is supplied to the piezoelectric vibrator 21, thereby inducing pressure vibration which does not cause ejection of ink droplets within the pressure chamber 33. As a result, the ink located in the vicinity of the nozzle orifices 30 is agitated. After the fine vibration pulse signal VP4 has been supplied, the potential of the vibrator becomes the minimum potential VL. Hence, a voltage to be supplied to the piezoelectric vibrator 21 is reduced to a low level. As a result, the load imposed on the piezoelectric vibrator 21 is mitigated, and hence the lifetime of the piezoelectric vibrator 21 can be prolonged.

In this case, the fine vibration pulse signal VP4 is constituted of the first joint element P119 and the second joint element P129, which are intended for adjusting the potential of the vibrator. The first joint element P119 and the second joint element P129 can be used for various uses. Even in the case of a limited recording period T, a plurality of waveform elements can be efficiently packed in the period. Further, the fourth pulse signal PS34 including the first joint element P119 is produced at a time between the second ejection waveform element DP2 (P109 to P113) and the third ejection waveform element DP3 (P122 to P126). Even in this point, a plurality of waveform elements can be efficiently packed in the limited recording period T.

Figure 23B:
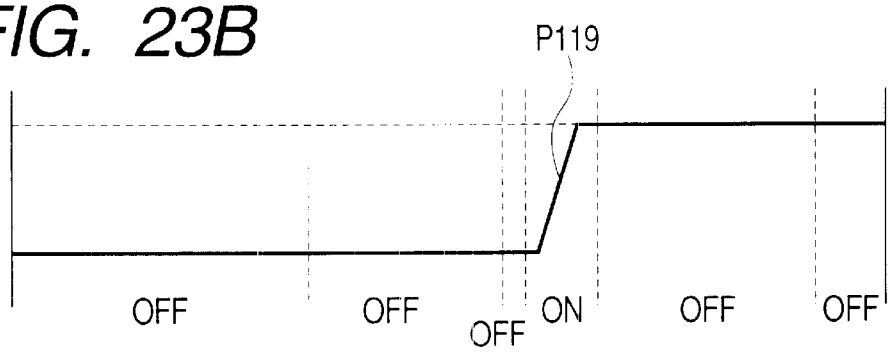
FIG. 23B is a drawing to describe a pulse signal selection pattern in the fifth embodiment of the invention, wherein the a non-recording state is indicated in the present recording period and a recording state is indicated in the next recording period.

In the case of output data [001]; that is, when history data pertaining to the next recording period assumes a value of [1] representing a recording operation, the decoder 45 produces selection data [000100]. As a result, only the fourth pulse signal PS34 is selected from the first pulse signal PS31 to the sixth pulse signal PS36, and the thus-selected pulse signal is supplied to the piezoelectric vibrator 21. As shown in FIG. 23B, the switch circuit 48 becomes active during duration t34, whereupon a drive signal is supplied to the piezoelectric vibrator 21. During a period from the first period t31 to the third period t33 and a period from the fifth period t35 to the sixth period t36, the switch circuit 48 becomes inactive, thereby stopping supply of the drive signal to the piezoelectric vibrator 21.

As a result, the potential of the vibrator 21 is caused to rise from the minimum potential VL to the medium potential VM by the first joint element P119 supplied during the fourth period t34. Subsequently, an ejection waveform element is supplied during the next recording period T, and the potential of the vibrator obtained at the start of supply of a waveform element, the initial potential of the ejection waveform element, and the termination potential of the ejection waveform element match the medium potential VM. Therefore, the ejection waveform element can be smoothly supplied to the piezoelectric vibrator 21 without involvement of a sudden change in the potential of the vibrator 21. Therefore, even when a non-recording operation is performed during the recording period T, the potential of the vibrator can be increased to the medium potential VM. Hence, the ejection waveform element can be supplied without imposing any load on the piezoelectric vibrator 21.

There will now be described control of the piezoelectric vibrator 21 to be performed in the case of the present recording period T relating to a small dot (i.e., gradation data [01]).

Figure 24A:
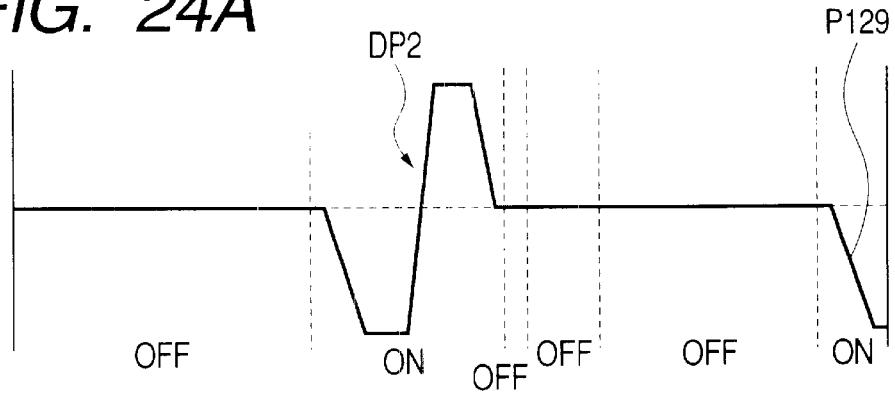
FIG. 24A is a drawing to describe a pulse signal selection pattern in the fifth embodiment of the invention, wherein the a small-dot recording state is indicated in the present recording period and a non-recording state is indicated in the next recording period.

When output data are [010]; that is, when history data pertaining to the next recording period represent [0], the decoder 45 products the selection data [01000101]. As a result, the fourth pulse signal PS34 and the sixth pulse signal PS36 are selected from the first pulse signal PS31 to the sixth pulse signal PS36, and the thus-selected pulse signals are supplied to the piezoelectric vibrator 21. As shown in FIG. 24A, the switch circuit 48 is activated during a period from the second period t32 and the sixth period t36, whereupon a drive signal is supplied to the piezoelectric vibrator 21. During the first period t31 and a period from the third period t33 to the fifth period t35, the switch circuit 48 is deactivated, thereby halting supply of a drive signal to the piezoelectric vibrator 21.

Consequently, the second ejection waveform element DP2 is supplied to the piezoelectric vibrator 21, whereby a predetermined amount of ink droplets is ejected once. After ejection of ink droplets, the second joint element P129 is supplied, whereby the potential of the vibrator becomes the minimum potential VL. Therefore, the potential of the vibrator is maintained at the minimum potential VL during the next recording period T. As a result, a load to be imposed on the piezoelectric vibrator 21 is mitigated, and hence the lifetime of the piezoelectric vibrator 21 can be prolonged.

Figure 24B:
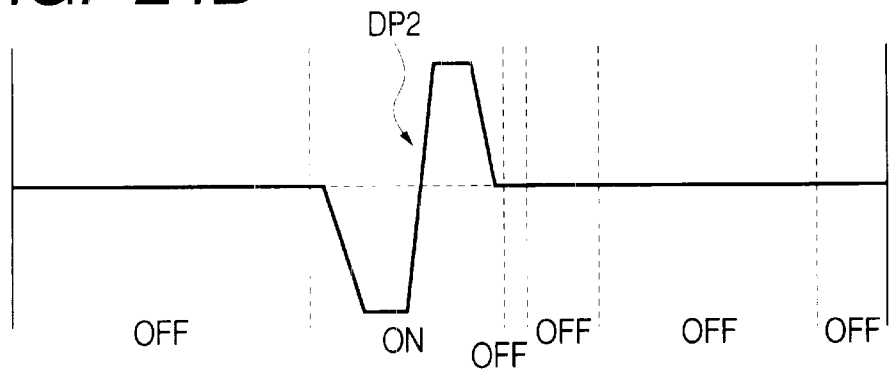
FIG. 24B is a drawing to describe a pulse signal selection pattern in the fifth embodiment of the invention, wherein the a small-dot recording state is indicated in the present recording period and a recording state is indicated in the next recording period.

In contrast, when output data assume a value of [011]; that is, when history data pertaining to the next recording period assume a value of [1] representing a recording operation, the decoder 45 produces selection data [010000]. As a result, the second pulse signal PS32 is selected from the first pulse signal PS31 to the sixth pulse signal PS36 and supplied to the piezoelectric vibrator 21. As shown in FIG. 24B, the switch circuit 48 is activated during the second period t32, whereupon a drive signal is supplied to the piezoelectric vibrator 21. During the first period t31 and during a period from the third period t33 to the sixth period t36, the switch circuit 48 is deactivated, thereby halting supply of the drive signal to the piezoelectric vibrator 21.

Consequently, the second ejection waveform element DP2 is supplied to the piezoelectric vibrator 21, whereby a predetermined amount of ink droplets is ejected once. After ink droplets have been ejected, the potential of the vibrator is maintained at the medium potential VM. For this reason, during the next recording period T, the potential of the vibrator and the initial potential of the ejection waveform element match the medium potential VM, whereby the ejection waveform element can be supplied smoothly to the piezoelectric vibrator 21. For this reason, the ejection waveform element can be supplied without imposing load on the piezoelectric vibrator 21.

There will now be described control of the piezoelectric vibrator 21 to be performed in the case of the present recording period T relating to a medium dot (i.e., gradation data [10]).

Figure 25A:
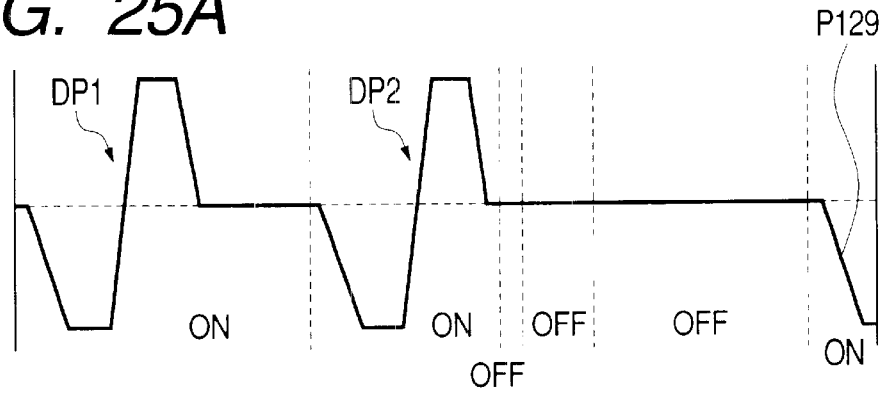
FIG. 25A is a drawing to describe a pulse signal selection pattern in the fifth embodiment of the invention, wherein the a medium-dot recording state is indicated in the present recording period and a non-recording state is indicated in the next recording period.

When output data are [100]; that is, when history data pertaining to the next recording period represent [0], the decoder 45 produces the selection data [110001]. As a result, the first pulse signal PS31, the second pulse signal PS32, and the sixth pulse signal PS36 are selected from the first pulse signal PS31 to the sixth pulse signal PS36, and the thus-selected pulse signals are supplied to the piezoelectric vibrator 21. As shown in FIG. 25A, the switch circuit 48 is activated during the periods t31, t32, and t36, whereupon a drive signal is supplied to the piezoelectric vibrator 21. During a period from the third period t33 to the fifth period t35, the switch circuit 48 is deactivated, thereby halting supply of a drive signal to the piezoelectric vibrator 21.

Consequently, the first ejection waveform element DP1 (P102 to P106) and the second ejection waveform element DP2 are supplied to the piezoelectric vibrator 21, whereby a predetermined amount of ink droplets is ejected twice. After ejection of ink droplets, the second joint element P129 is supplied, whereby the potential of the vibrator becomes the minimum potential VL. As a result, a load to be imposed on the piezoelectric vibrator 21 is mitigated, and hence the lifetime of the piezoelectric vibrator 21 can be prolonged.

Figure 25B:
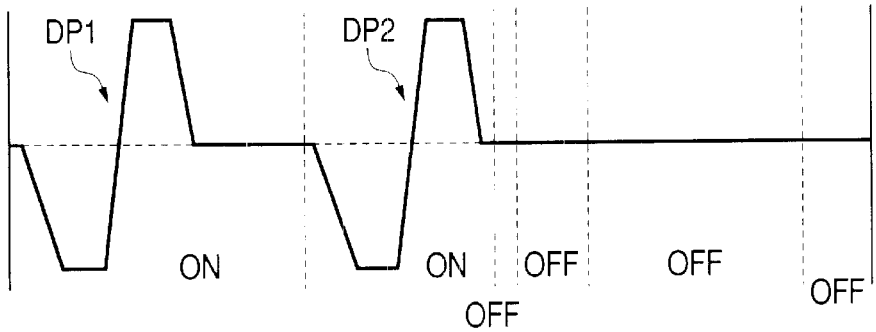
FIG. 25B is a drawing to describe a pulse signal selection pattern in the fifth embodiment of the invention, wherein the a medium-dot recording state is indicated in the present recording period and a recording state is indicated in the next recording period.

In contrast, when output data assume a value of [101]; that is, when history data pertaining to the next recording period assume a value of [1] representing a recording operation, the decoder 45 produces selection data [110000]. As a result, the first pulse signal PS31 and the second pulse signal PS32 are selected from the first pulse signal PS31 to the sixth pulse signal PS36 and supplied to the piezoelectric vibrator 21. As shown in FIG. 25B, the switch circuit 48 is activated during the periods t31 and t32, whereupon a drive signal is supplied to the piezoelectric vibrator 21. During a period from the third period t33 to the sixth period t36, the switch circuit 48 is deactivated, thereby halting supply of the drive signal to the piezoelectric vibrator 21.

Consequently, the first ejection waveform element DP1 and the second ejection waveform element DP2 are supplied to the piezoelectric vibrator 21, whereby a predetermined amount of ink droplets is ejected twice. After ink droplets have been ejected, the potential of the vibrator is maintained at the medium potential VM. During the next recording period T, the ejection waveform element can be supplied smoothly to the piezoelectric vibrator 21. For this reason, the ejection waveform element can be supplied without imposing load on the piezoelectric vibrator 21.

There will now be described control of the piezoelectric vibrator 21 to be performed in the case of the present recording period T relating to a large dot (i.e., gradation data [11]).

Figure 26A:
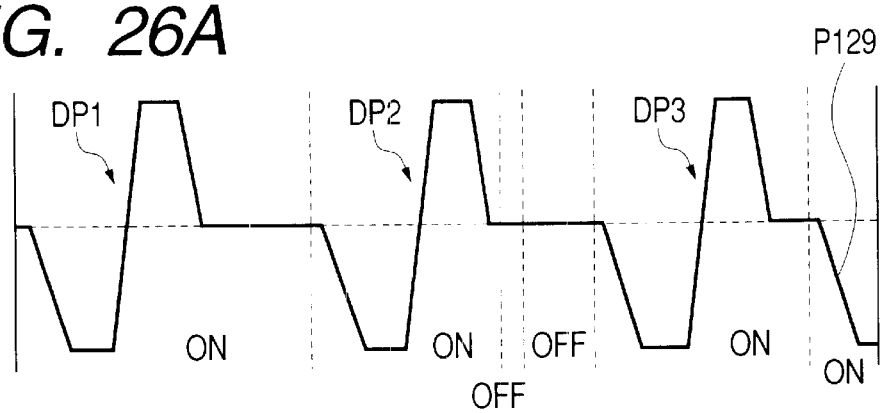
FIG. 26A is a drawing to describe a pulse signal selection pattern in the fifth embodiment of the invention, wherein the a large-dot recording state is indicated in the present recording period and a non-recording state is indicated in the next recording period.

When output data are [110]; that is, when history data pertaining to the next recording period represent [0], the decoder 45 produces the selection data [110011]. As a result, the first pulse signal PS31, the second pulse signal PS32, the fifth pulse signal PS35, and the sixth pulse signal PS36 are selected from the first pulse signal PS31 to the sixth pulse signal PS36, and the thus-selected pulse signals are supplied to the piezoelectric vibrator 21. As shown in FIG. 26A, the switch circuit 48 is activated during the periods t31, t32, t35, and t36, whereupon a drive signal is supplied to the piezoelectric vibrator 21. During a period from the third period t33 to the fourth period t34, the switch circuit 48 is deactivated, thereby halting supply of a drive signal to the piezoelectric vibrator 21.

Consequently, the first ejection waveform element DP1, the second ejection waveform element DP2, and the third ejection waveform element DP3 are supplied to the piezoelectric vibrator 21, whereby a predetermined amount of ink droplets is ejected three times. After ejection of ink droplets, the potential of the vibrator becomes the minimum potential VL. As a result, a load to be imposed on the piezoelectric vibrator 21 is mitigated, and hence the lifetime of the piezoelectric vibrator 21 can be prolonged.

In this case, the second joint element P129 is produced after the third ejection waveform element DP3, which is the final ejection waveform element. Hence, even when the recording period T immediately before a non-recording operation relates to recording of a large dot; that is, a recording operation with use of the third ejection waveform element DP3, the recording operation can be performed without any problems.

Figure 26B:
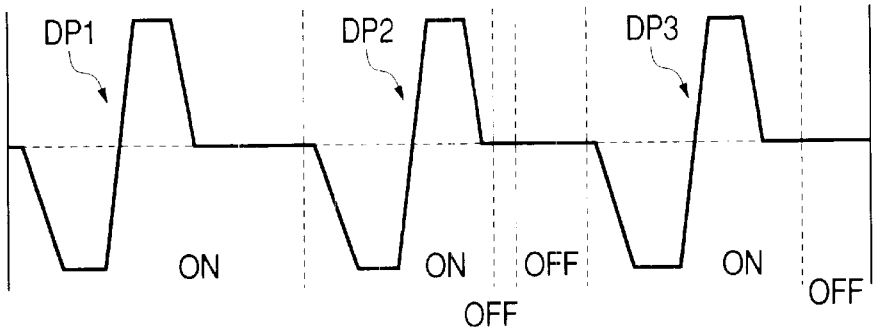
FIG. 26B is a drawing to describe a pulse signal selection pattern in the fifth embodiment of the invention, wherein the a large-dot recording state is indicated in the present recording period and a recording state is indicated in the next recording period.

In contrast, when output data assume a value of [111]; that is, when history data pertaining to the next recording period assume a value of [1] representing a recording operation, the decoder 45 produces selection data [110010]. As a result, the first pulse signal PS31, the second pulse signal PS32, and the fifth pulse signal PS35 are selected from the first pulse signal PS31 to the sixth pulse signal PS36 and supplied to the piezoelectric vibrator 21. As shown in FIG. 26B, the switch circuit 48 is activated during the periods t31, t32, and t35, whereupon a drive signal is supplied to the piezoelectric vibrator 21. During the periods t33, t34 and t36, the switch circuit 48 is deactivated, thereby halting supply of the drive signal to the piezoelectric vibrator 21.

Consequently, the first ejection waveform element DP1, the second ejection waveform element DP2, and the third ejection waveform element DP3 are supplied to the piezoelectric vibrator 21, whereby a predetermined amount of ink droplets is ejected three times. After ink droplets have been ejected, the potential of the vibrator is maintained at the medium potential VM. During the next recording period T, the ejection waveform element can be supplied smoothly to the piezoelectric vibrator 21. For this reason, the ejection waveform element can be supplied without imposing load on the piezoelectric vibrator 21.

Figure 27:
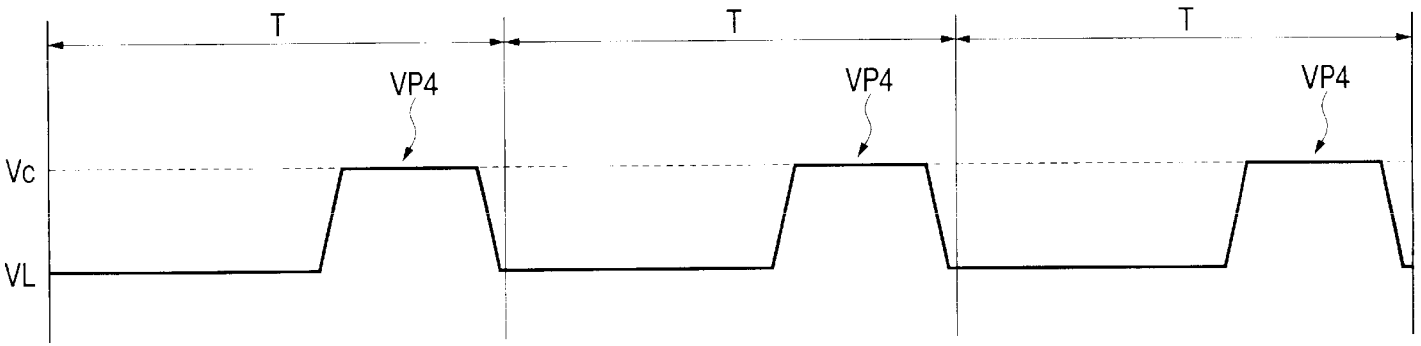
FIG. 27 is a drawing to describe a pulse signal selection pattern in the fifth embodiment of the invention, wherein a non-recording state is continued.

In the embodiment, when a non-recording operation consecutively arises in respective recording periods T, the fine vibration pulse signal VP4, for example, is supplied during respective recording periods T, as shown in FIG. 27. The potential of the vibrator is maintained at the minimum potential VL for a period of time during which the fine vibration pulse signal VP4 is not supplied. Therefore, load to be imposed on the piezoelectric vibrator 21 can be mitigated, thereby prolonging the lifetime of the vibrator.

Figure 28:
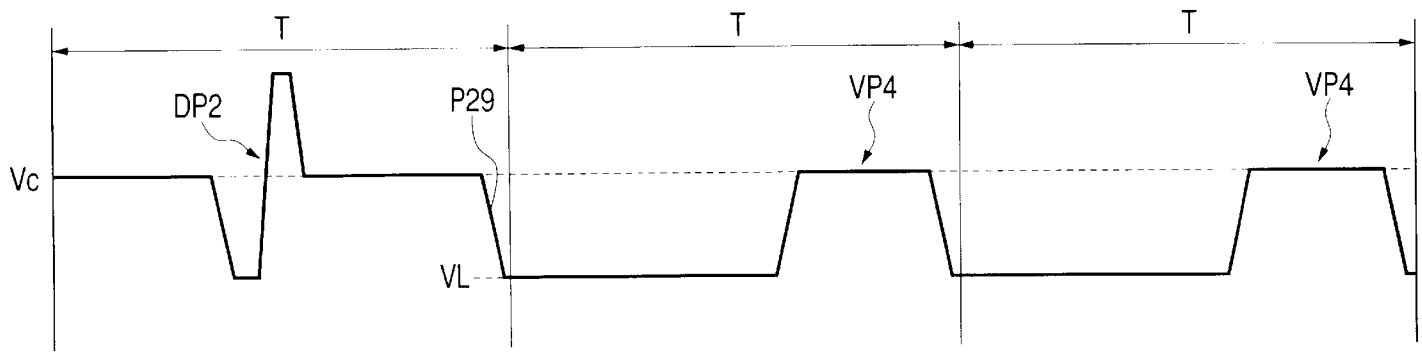
FIG. 28 is a drawing to describe a pulse signal selection pattern in the fifth embodiment of the invention, wherein a recording mode is shifted from the small-dot recording state to the non-recording recording state.

In the case of a shift from recording of a dot to a non-recording operation, as shown in FIG. 28, the second joint element P129, for example, is supplied to the piezoelectric vibrator 21 immediately before there arises a shift to the recording period T of the non-recording operation, whereupon the potential of the vibrator decreases to the minimum potential VL. Accordingly, the potential of the vibrator is maintained at the minimum potential VL during the recording period T of the non-recording operation, whereby the lifetime of the piezoelectric vibrator 21 can be prolonged.

Figure 29:
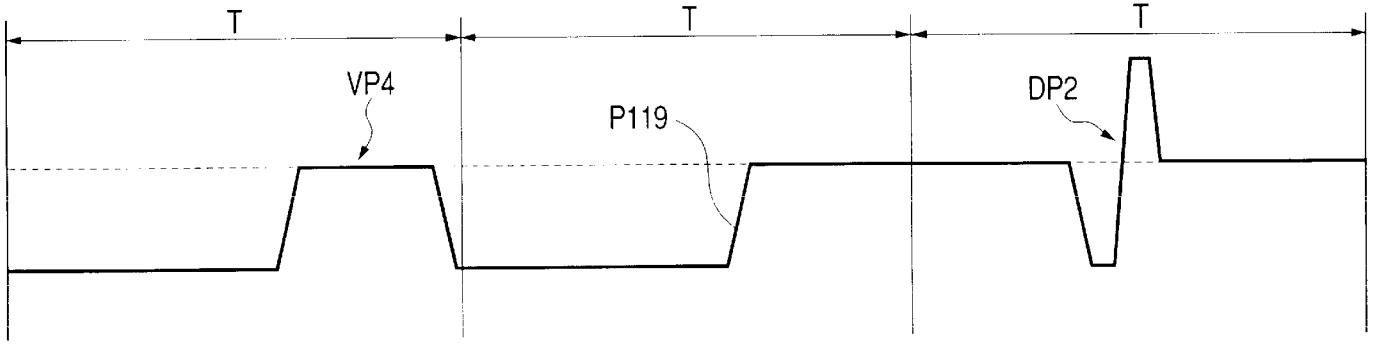
FIG. 29 is a drawing to describe a pulse signal selection pattern in the fifth embodiment of the invention, wherein a recording mode is shifted from the non-recording recording state to the small-dot recording state.

In contrast, when a shift arises from non-recording of a dot to a recording operation, as shown in FIG. 29, the first joint element P119, for example, is supplied to the piezoelectric vibrator 21 immediately before there arises a shift to the recording period T of the non-recording operation, whereupon the potential of the vibrator rises to the medium potential VM. Accordingly, the potential of the vibrator is maintained at the medium potential VM until the ejection waveform element (DP2) is supplied in the next recording period T, thereby enabling smooth supply of the ejection waveform element.

Figure 30:
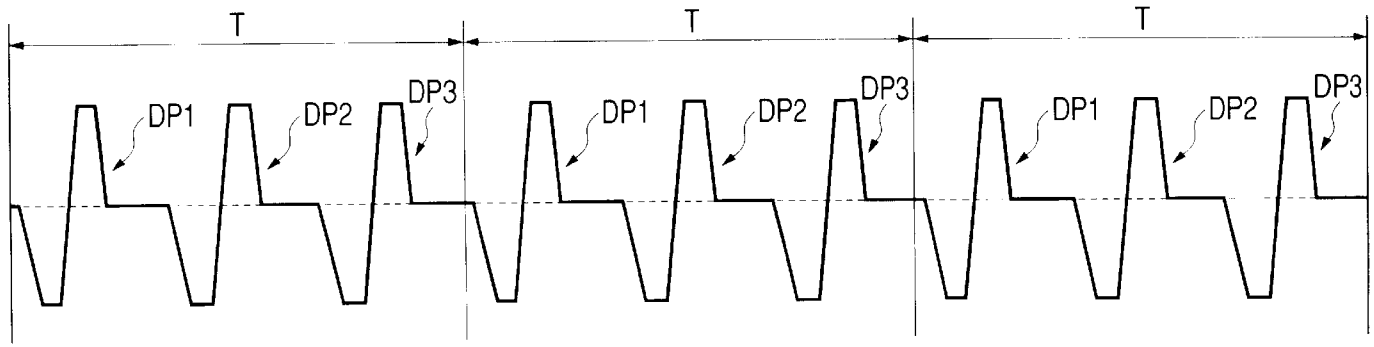
FIG. 30 is a drawing to describe a pulse signal selection pattern in the fifth embodiment of the invention, wherein the large-dot recording state is continued.

When dots are recorded successively during a preceding recording period T and a present recording period T, as shown in FIG. 30, the second joint element P129 is not supplied during the present recording period T and the potential of the vibrator obtained at the end of the recording period T is taken as the medium potential VM. As a result, the potential of the vibrator becomes constant at the medium potential VM from when supply of an ejection waveform element (DP3) to be performed during the present recording period T is completed until when supply of another ejection waveform element (DP1) is started during the next recording period T. Thus, neither a sudden increase nor a sudden decrease arises within a short period of time. Therefore, load to be imposed on the piezoelectric vibrator 21 is mitigated, and hence the piezoelectric vibrator 21 can be protected. Since the potential of the vibrator is constant, no change arises in the volume of the pressure change 33, thereby rendering the pressure of ink stable. Therefore, a deflection in trajectory of an ink droplet can be prevented.

In the embodiment, the first joint element P119 to be used for increasing a potential from the minimum potential VL (base potential) to the medium potential VM (drive potential) and the second joint element P129 to be used for decreasing a potential from the medium potential VM to the minimum potential VL are included in the drive signal. The first joint element P119 and the second joint element P129 is supplied to the piezoelectric vibrator 21, thereby adjusting the potential of the vibrator.

However, the vibrator potential adjuster may be constituted of a resistor element, and a switcher for connecting a piezoelectric vibrator to a base potential supply source via the resistor element. The potential of the vibrator may be adjusted by supplying a drive potential via the resistor element. A sixth embodiment of the invention as constructed the above will be described hereinbelow.

Figure 31A:
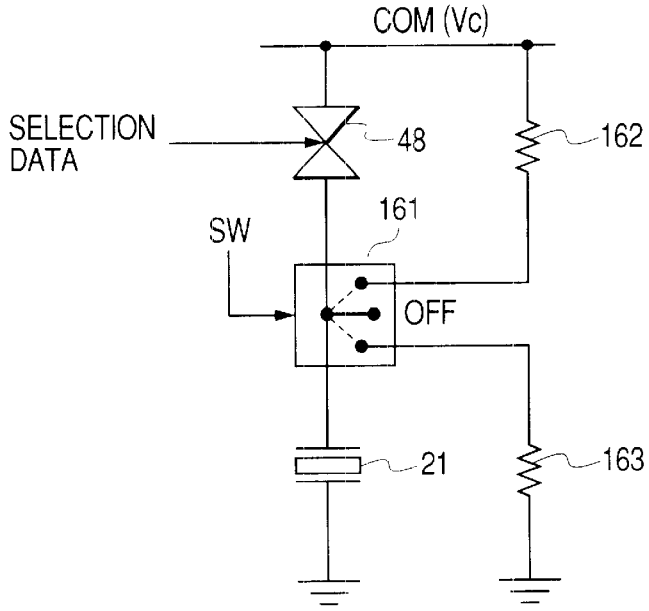
FIG. 31A is a diagram to describe the configuration of the main part of a sixth embodiment of the invention.

As shown in FIG. 31A, an adjustment switch 161 is provided between the switch circuit 48 and the piezoelectric vibrator 21. The piezoelectric vibrator 21 can be selectively connected to a drive potential supply source or a base potential supply source via the adjustment switch 161 and resistor elements 162, 163. In association with such a configuration, the third pulse signal PS33, the fourth pulse signal PS34, and the sixth pulse signal PS36 are not produced during the periods t33, t34, and t36 in connection with the drive signal to be produced by the drive signal generation circuit 9 (see FIG. 22). Instead, a given medium potential VM is produced. During the periods t31, t32, and t35, the pulse signals PS31, PS32, and PS35 are produced.

Control of the piezoelectric vibrator to be performed in the embodiment is essentially identical with that performed in the above embodiments. However, the following difference exists between the above embodiments and this embodiment. Specifically, during duration t34, the adjustment switch 161 is connected to a resistor element 162 (i.e., the drive potential supply source side) while the switch circuit 48 is maintained in an inactive state rather than the fourth pulse signal PS34 being selected. Further, during duration t36, the adjustment switch 161 is connected to the resistor element 163 (i.e., the base potential supply side) while the switch circuit 48 is maintained at an inactive state rather than the sixth pulse signal PS36 being selected.

Figure 31B:
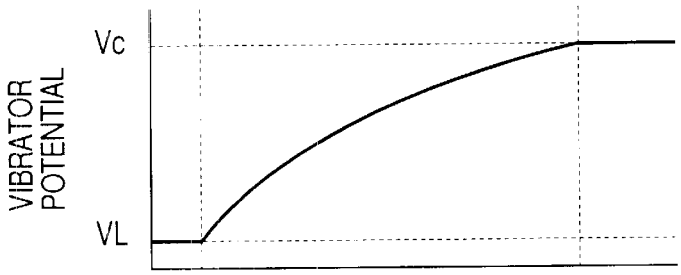
FIGS. 31B and 31C are drawings to describe changes in vibrator potential in the sixth embodiment of the invention.

With this control operation, the drive potential supply source is connected to the piezoelectric vibrator 21, and the piezoelectric vibrator 21 is recharged by way of the resistor element 162. As a result, as shown in FIG. 31B, the potential of the vibrator rises comparatively gently with lapse of time. Consequently, as in a case where the fourth pulse signal PS34 is supplied, the potential of the vibrator obtained at the end of the fourth period t34 can be adjusted to the medium potential VM.

Figure 31C:
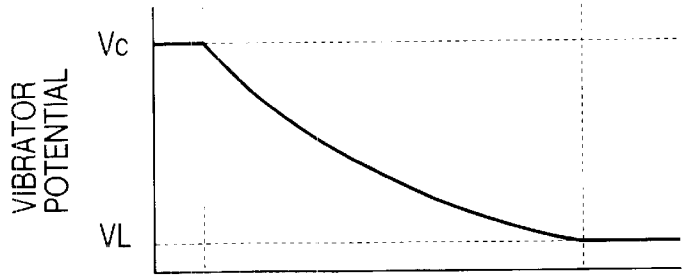

When the base potential supply source is connected to the piezoelectric vibrator 21 over the sixth period t36, the piezoelectric vibrator 21 is discharged by way of the resistor element 163. As a result, as shown in FIG. 31C, the potential of the vibrator decreases comparatively gently with lapse of time. As a result, as in a case where the sixth pulse signal PS36 is supplied, the potential of the vibrator can be adjusted to the minimum potential VL before arrival of the next recording period T.

In these cases, the degree (i.e., gradient) of increase or decrease in the potential of the vibrator can be adjusted by changing resistance values of the resistor elements 162, 163. Hence, adjustment also becomes easy.

Activation and deactivation of the adjustment switch 161 can be controlled by the control section 6. However, the invention is not limited to such a control operation. For instance, a control operation may be performed through use of a switch having a timer function.

According to the foregoing configuration, the only requirement is to cause the drive signal generation circuit 9 to produce the medium potential VM during the periods t33, t34, and t36. Hence, the control section 6 does not need to control the drive signal generation circuit 9 over each period. Further, a very small time, which arises at a point of time when the switch is activated and a point of time when the switch is deactivated, is sufficient for the time required for controlling activation and deactivation of the adjustment switch 161.

Therefore, the control section 6 can perform other processing operations during the periods t33, t34, and t36; for example, control of the carriage mechanism 11 or control of the paper delivery mechanism 12. Hence, a limited time can be utilized efficiently.

In the embodiments, the plurality of ejection drive pulses each assume the same waveform pattern. However, the invention is not limited to the embodiments; the pulses may assume different waveform patterns. Further, the drive potential to be set is not limited to the medium potential VM, but can be an arbitrary potential higher than the base potential. Likewise, the base potential is not limited to a ground potential, so long as the base potential is a low potential suitable for protecting the piezoelectric vibrator 21.

The invention can be applied to liquid jetting apparatus of not only printers, but also plotters, facsimiles, etc., but also an electrode member ejection head for an electrode forming apparatus, an organic substance jetting head for a bio-chip manufacturing apparatus, or the like.

What is claimed is:

1. A liquid jetting apparatus, comprising:

a liquid jetting head, provided with a pressure chamber, a piezoelectric vibrator which causes pressure fluctuation to the pressure chamber and a nozzle orifice communicated with the pressure chamber;

a drive signal generator, which generates a drive signal including a base potential, an initial and termination potential which is a drive potential higher than the base potential, and at least one ejection pulse signal for ejecting an ink droplet from the nozzle orifice, the drive signal generating the drive signal every recording period;

a drive signal supplier, which selectively supplies the ejection pulse signal to the piezoelectric vibrator in accordance with recording data which indicates whether a liquid jetting is performed;

a jetting data storage, which stores the jetting data with regard to each of successive two jetting periods including a present jetting period; and a vibrator potential adjuster, which changes a potential of the piezoelectric vibrator to the base potential when the jetting data stored in the jetting data storage indicates that the liquid jetting is not performed in a latter jetting period, and changes the potential of the piezoelectric vibrator to the drive potential before the ejection pulse is supplied when the jetting data indicates that the liquid jetting is performed in the latter jetting period.

2. The liquid jetting apparatus as set forth in claim 1, wherein:

the jetting data is binary data which is associated with whether the liquid jetting is performed;

the jetting data storage stores jetting data with regard to the present jetting period and a next jetting period; and a potential of the piezoelectric vibrator when the present jetting period is terminated is changed to the base potential or the drive potential.

3. The liquid jetting apparatus as set forth in claim 1, wherein the jetting data includes:

gradation data which indicates a gradation of an ink dot recording in the present jetting period; and history data which indicates whether an ink dot recording was performed in a previous jetting period.

4. The liquid jetting apparatus as set forth in claim 1, wherein:

the drive signal includes:

a first joint pulse signal which raises the potential of the piezoelectric vibrator from the base potential to the drive potential; and a second joint pulse signal which drops the potential of the piezoelectric vibrator from the drive potential to the base potential; and the vibrator potential adjuster supplies either the first joint pulse signal or the second joint pulse signal.

5. The liquid jetting apparatus as set forth in claim 4, wherein the drive signal generator generates the first joint pulse signal before the ejection pulse signal, and generates the second joint pulse signal after the ejection pulse signal.

6. The liquid jetting apparatus as set forth in claim 4, wherein at least one of the first joint pulse signal and the second joint pulse signal constitutes a part of the ejection pulse signal.

7. The liquid jetting apparatus as set forth in claim 4, wherein:

the drive signal includes a vibrating pulse signal which vibrates a meniscus of liquid in the nozzle orifice such an extent that a liquid drop is not ejected from the nozzle orifice; and at least one of the first joint pulse signal and the second joint pulse signal constitutes a part of the vibrating pulse signal.

8. The liquid jetting apparatus as set forth in claim 4, wherein a time period for which the potential of the piezoelectric vibrator is varied by the first joint pulse signal and the second joint pulse signal is substantially identical with a natural period of ink in the pressure chamber.

9. The liquid jetting apparatus as set forth in claim 4, wherein the drive signal generator generates the first joint pulse signal and the second joint signal before the ejection pulse signal.

10. The liquid jetting apparatus as set forth in claim 1, wherein the vibrator potential adjuster includes a resistance element and a switch which connects the piezoelectric vibrator to either a source of the base potential or a source of the drive potential, via the resistance element.

11. The liquid jetting apparatus as set forth in claim 1, wherein a first dummy data indicating that the liquid jetting is not performed is provided before a first data of jetting data associated with one main scanning of the liquid jetting head, and a second dummy data indicating that the liquid jetting is not performed is provided after a last data of the jetting data.

12. A method of driving a liquid jetting apparatus which comprises a liquid jetting head provided with a pressure chamber, a piezoelectric vibrator which causes pressure fluctuation to the pressure chamber and a nozzle orifice communicated with the pressure chamber, the method comprising the steps of:

generating a drive signal every jetting period, the drive signal including a base potential, an initial and termination potential which is a drive potential higher than the base potential, and at least one ejection pulse signal for ejecting a liquid droplet from the nozzle orifice;

storing jetting data which indicates whether a liquid jetting is performed, with regard to each of successive two jetting periods including a present jetting period;

changing a potential of the piezoelectric vibrator to the base potential when the jetting data stored in the jetting data storage indicates that the liquid jetting is not performed in a latter jetting period;

changing the potential of the piezoelectric vibrator to the drive potential before the ejection pulse is supplied when the jetting data indicates that the liquid jetting is performed in the latter jetting period; and supplying selectively the ejection pulse signal to the piezoelectric vibrator in accordance with the jetting data.

13. The driving method as set forth in claim 12, wherein:

the jetting data is binary data which is associated with whether the liquid jetting is performed; and the jetting data storage stores jetting data with regard to the present jetting period and a next jetting period, so that a potential of the piezoelectric vibrator when the present jetting period is terminated is changed to the base potential or the drive potential.

14. The driving method as set forth in claim 12, wherein the jetting data includes:

gradation data which indicates a gradation of an ink dot recording in the present jetting period; and history data which indicates whether an ink dot recording was performed in a previous jetting period.

15. The driving method as set forth in claim 12, wherein:

the drive signal includes:

a first joint pulse signal which raises the potential of the piezoelectric vibrator from the base potential to the drive potential; and a second joint pulse signal which drops the potential of the piezoelectric vibrator from the drive potential to the base potential; and the vibrator potential adjuster supplies either the first joint pulse signal or the second joint pulse signal.

16. The driving method as set forth in claim 12, wherein the piezoelectric vibrator is connected to either a source of the base potential or a source of the drive potential via a resistance element to adjust the potential of the piezoelectric vibrator.

* * * * *

UNITED STATES PATENT AND TRADEMARK OFFICE

CERTIFICATE OF CORRECTION

PATENT NO. : 6,685,293 B2
DATED : February 03, 2004
INVENTOR(S) : Chang Junhua

It is certified that error appears in the above-identified patent and that said Letters Patent is hereby corrected as shown below:

Title page,
Item [30], Foreign Application Priority Data, please add the following Japanese applications to the current application listed:

-- May 2, 2001 (JP) P2001-134797
August 28, 2001 (JP) P2001-257334
April 23, 2002 (JP) P2002-121257 --

Signed and Sealed this

Thirteenth Day of July, 2004

JON W. DUDAS
*Acting Director of the United States Patent and Trademark Office*